US010076689B2

(12) United States Patent
de la Cruz et al.

(10) Patent No.: US 10,076,689 B2
(45) **Date of Patent: *Sep. 18, 2018**

(54) GOLF CLUB HEAD WITH DEPRESSION

(71) Applicant: Acushnet Company, Fairhaven, MA (US)

(72) Inventors: Noah de la Cruz, San Diego, CA (US); Darryl C. Galvan, El Cajon, CA (US); Nick Frame, Vista, CA (US); Charles E. Golden, Encinitas, CA (US); John Morin, Poway, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/474,326

(22) Filed: Mar. 30, 2017

(65) Prior Publication Data

US 2017/0203167 A1 Jul. 20, 2017

Related U.S. Application Data

(63) Continuation of application No. 14/587,360, filed on Dec. 31, 2014, now Pat. No. 9,636,559, which is a (Continued)

(51) Int. Cl.
*A63B 53/04* (2015.01)
*A63B 60/52* (2015.01)

(52) U.S. Cl.
CPC ..... *A63B 53/0466* (2013.01); *A63B 60/52* (2015.10); *A63B 2053/0408* (2013.01); *A63B 2053/0433* (2013.01)

(58) Field of Classification Search
USPC ..... 473/324–350
See application file for complete search history.

(56) References Cited

U.S. PATENT DOCUMENTS

| | | | |
|---|---|---|---|
| 819,900 | A | 5/1906 | Martin |
| 1,705,997 | A | 3/1929 | Quynn |

(Continued)

FOREIGN PATENT DOCUMENTS

| | | |
|---|---|---|
| JP | 1091876 | 4/1989 |
| JP | 1259876 | 10/1989 |

(Continued)

OTHER PUBLICATIONS

English language translation of JP Patent Publication No. 2002-52099 (full text).

*Primary Examiner* — Alvin Hunter
(74) *Attorney, Agent, or Firm* — Kevin N. McCoy

(57) ABSTRACT

A golf club head comprising a crown defining an upper surface of the golf club head; a sole defining a lower surface of the golf club head, wherein said sole is substantially convex in shape; a skirt extending between the crown and the sole; a face defining a ball-striking surface and intersecting said sole at a leading edge; an interior cavity defined by said crown, sole, skirt, and face; a coordinate system with an x-axis located horizontal to said face, a y-axis located vertical to said face, and a z-axis located through said face, said z-axis and said x-axis parallel to a ground plane when said golf club head is held at address on said ground plane; a depression formed in said sole, wherein said depression is substantially concave and protrudes inwards towards said interior cavity of said golf club head.

18 Claims, 50 Drawing Sheets

Related U.S. Application Data continuation-in-part of application No. 14/089,574, filed on Nov. 25, 2013, now Pat. No. 9,320,949, which is a continuation-in-part of application No. 13/850,992, filed on Mar. 26, 2013, now Pat. No. 8,715,109, which is a continuation of application No. 13/085,711, filed on Apr. 13, 2011, now Pat. No. 8,419,569, which is a continuation of application No. 12/340,925, filed on Dec. 22, 2008, now Pat. No. 7,931,546, which is a continuation-in-part of application No. 12/193,110, filed on Aug. 18, 2008, now Pat. No. 7,758,454, which is a continuation of application No. 11/552,729, filed on Oct. 25, 2006, now Pat. No. 7,497,789, said application No. 14/089,574 is a continuation-in-part of application No. 13/854,709, filed on Apr. 1, 2013, now Pat. No. 8,894,508, which is a continuation of application No. 13/207,344, filed on Aug. 10, 2011, now Pat. No. 8,409,032, said application No. 14/089,574 is a continuation-in-part of application No. 13/844,954, filed on Mar. 16, 2013, now Pat. No. 8,986,133, which is a continuation-in-part of application No. 13/720,885, filed on Dec. 19, 2012, now Pat. No. 8,834,290, which is a continuation-in-part of application No. 13/618,963, filed on Sep. 14, 2012, now Pat. No. 8,834,289.

(56) References Cited

U.S. PATENT DOCUMENTS 2,968,486 A 1/1961 Walton
3,084,940 A 4/1963 Cissel
3,166,320 A 1/1965 Onions
3,957,194 A 5/1976 Woodard
3,975,023 A 8/1976 Inamori
3,976,299 A * 8/1976 Lawrence ..... A63B 53/04 473/327
4,027,885 A 6/1977 Rogers
4,139,196 A 2/1979 Riley
4,220,276 A 9/1980 Weisert et al.
4,420,156 A 12/1983 Campau
4,471,961 A 9/1984 Masghati et al.
4,575,447 A 3/1986 Hariguchi
4,603,808 A 8/1986 Stacher
4,754,974 A 7/1988 Kobayashi
4,850,593 A * 7/1989 Nelson ..... A63B 53/04 473/327
5,076,585 A 12/1991 Bouquet
D323,035 S 1/1992 Yang
5,092,599 A 3/1992 Okumoto et al.
5,094,457 A 3/1992 Kinoshita
5,193,810 A 3/1993 Antonious
5,205,560 A 4/1993 Hoshi et al.
5,221,086 A 6/1993 Antonious
5,228,615 A 7/1993 Iijima et al.
5,299,807 A 4/1994 Hutin
5,346,216 A 9/1994 Aizawa
5,429,357 A * 7/1995 Kobayashi ..... A63B 53/04 473/311
D366,508 S 1/1996 Hutin
5,492,327 A 2/1996 Biafore, Jr.
5,511,786 A 4/1996 Antonious
D372,512 S 8/1996 Simmons
D375,130 S 10/1996 Hlinka et al.
5,584,770 A 12/1996 Jensen
D377,509 S 1/1997 Katayama
D378,770 S 4/1997 Hlinka et al.
5,616,088 A 4/1997 Aizawa et al.
5,632,695 A 5/1997 Hlinka
5,643,108 A 7/1997 Cheng
D382,612 S 8/1997 Oyer
5,669,827 A 9/1997 Nagamoto
5,681,228 A 10/1997 Mikame et al.
5,735,754 A * 4/1998 Antonious ..... A63B 53/04 473/328
D394,688 S 5/1998 Fox
5,772,527 A 6/1998 Liu
5,785,605 A * 7/1998 Helmstetter ..... A63B 53/04 473/291
5,785,609 A * 7/1998 Sheets ..... A63B 53/04 473/327
D397,750 S 9/1998 Frazetta
5,839,975 A 11/1998 Lundberg
D403,037 S 12/1998 Stone et al.
D405,488 S 2/1999 Burrows
D413,952 S 9/1999 Oyer
5,971,867 A * 10/1999 Galy ..... A63B 53/04 473/334
5,993,329 A 11/1999 Shieh
5,993,331 A 11/1999 Shieh
6,017,280 A * 1/2000 Hubert ..... A63B 53/04 473/324
6,033,319 A * 3/2000 Farrar ..... A63B 53/0487 473/313
6,042,486 A 3/2000 Gallagher
6,048,278 A 4/2000 Meyer et al.
6,074,308 A 6/2000 Domas
6,077,172 A * 6/2000 Butler ..... A63B 53/02 473/305
6,086,485 A 7/2000 Hamada et al.
6,120,389 A * 9/2000 Kruse ..... A63B 53/04 473/328
6,123,627 A 9/2000 Antonious
6,183,377 B1 * 2/2001 Liang ..... A63B 53/04 164/112
6,183,381 B1 2/2001 Grant et al.
6,217,461 B1 * 4/2001 Galy ..... A63B 53/04 473/328
6,319,149 B1 11/2001 Lee
6,332,848 B1 * 12/2001 Long ..... A63B 53/04 473/328
6,344,001 B1 2/2002 Hamada
6,348,013 B1 2/2002 Kosmatka
6,354,961 B1 3/2002 Allen
6,368,232 B1 4/2002 Hamada et al.
6,390,932 B1 5/2002 Kosmatka et al.
6,425,832 B2 7/2002 Cackett et al.
6,491,592 B2 * 12/2002 Cackett ..... A63B 53/02 473/342
6,506,129 B2 1/2003 Chen
6,524,194 B2 2/2003 McCabe
6,530,847 B1 3/2003 Antonious
6,558,272 B2 5/2003 Helmstetter et al.
6,602,149 B1 8/2003 Jacobson
6,607,452 B2 8/2003 Helmstetter et al.
D482,089 S 11/2003 Burrows
D482,090 S 11/2003 Burrows
D482,420 S 11/2003 Burrows
D484,208 S 12/2003 Burrows
6,663,506 B2 12/2003 Nishimoto
6,679,782 B2 1/2004 Tang et al.
6,679,786 B2 * 1/2004 McCabe ..... A63B 53/02 473/305
D486,542 S 2/2004 Burrows
6,695,715 B1 2/2004 Chikaraishi
6,716,110 B1 4/2004 Ballow
6,719,644 B2 4/2004 Beach
6,719,645 B2 4/2004 Kouno
6,739,984 B1 * 5/2004 Ciasullo ..... A63B 53/0466 473/345
6,743,118 B1 6/2004 Soracco
6,783,465 B2 8/2004 Matsunaga
6,783,466 B2 * 8/2004 Seki ..... A63B 53/04 473/345
D501,036 S 1/2005 Burrows
D501,523 S 2/2005 Dogan et al.
D501,903 S 2/2005 Tanaka
6,855,068 B2 2/2005 Antonious
D504,478 S 4/2005 Burrows
6,875,129 B2 * 4/2005 Erickson ..... A63B 53/0466 473/345

(56) References Cited

U.S. PATENT DOCUMENTS 6,878,073 B2 * 4/2005 Takeda ..... A63B 53/04 473/345
6,880,222 B2 * 4/2005 Matsunaga ..... A63B 53/0466 148/405
6,887,165 B2 * 5/2005 Tsurumaki ..... A63B 53/0466 473/344
D506,236 S 6/2005 Evans et al.
D508,274 S 8/2005 Burrows
6,932,716 B2 8/2005 Ehlers et al.
6,955,612 B2 * 10/2005 Lu ..... A63B 53/0466 219/121.59
6,979,270 B1 12/2005 Allen
6,991,558 B2 1/2006 Beach et al.
7,029,403 B2 4/2006 Rice et al.
D520,585 S 5/2006 Hasebe
D523,104 S 6/2006 Hasebe
7,097,572 B2 8/2006 Yabu
7,097,573 B2 * 8/2006 Erickson ..... A63B 53/0466 473/342
7,140,974 B2 11/2006 Chao et al.
7,156,750 B2 * 1/2007 Nishitani ..... A63B 53/0466 473/329
7,166,038 B2 * 1/2007 Williams ..... A63B 53/0466 473/329
7,169,060 B2 * 1/2007 Stevens ..... A63B 53/0466 473/329
D536,402 S 2/2007 Kawami
7,182,699 B2 * 2/2007 Matsunaga ..... A63B 53/0466 473/324
7,198,575 B2 4/2007 Beach et al.
7,204,768 B2 * 4/2007 Nakahara ..... A63B 53/0466 473/329
7,207,898 B2 4/2007 Rice et al.
7,211,006 B2 5/2007 Chang
7,226,366 B2 6/2007 Galloway
7,241,230 B2 7/2007 Tsunoda et al.
7,258,626 B2 * 8/2007 Gibbs ..... A63B 53/04 473/329
D552,701 S 10/2007 Ruggiero et al.
7,294,064 B2 * 11/2007 Tsurumaki ..... A63B 53/0466 473/329
7,318,782 B2 1/2008 Imamoto et al.
7,344,452 B2 3/2008 Imamoto et al.
7,347,795 B2 3/2008 Yamagishi et al.
7,347,796 B2 * 3/2008 Takeda ..... A63B 53/0466 473/345
7,361,099 B2 4/2008 Rice et al.
7,367,899 B2 5/2008 Rice et al.
7,410,428 B1 * 8/2008 Dawson ..... A63B 53/0466 473/345
7,413,517 B2 8/2008 Butler, Jr. et al.
7,413,519 B1 * 8/2008 Dawson ..... A63B 53/0466 473/345
7,413,520 B1 * 8/2008 Hocknell ..... A63B 53/0466 473/345
7,419,442 B1 * 9/2008 Alan ..... A63B 53/0466 473/345
7,431,666 B2 * 10/2008 Vincent ..... A63B 53/0466 473/345
7,431,667 B2 * 10/2008 Vincent ..... A63B 53/0466 473/345
7,438,649 B2 10/2008 Ezaki et al.
7,470,201 B2 12/2008 Nakahara et al.
7,497,789 B2 * 3/2009 Burnett ..... A63B 53/0466 473/342
7,500,924 B2 * 3/2009 Yokota ..... A63B 53/0466 473/332
7,530,901 B2 5/2009 Imamoto et al.
7,530,903 B2 5/2009 Imamoto et al.
7,549,935 B2 * 6/2009 Foster ..... A63B 53/0466 473/335
7,572,193 B2 8/2009 Yokota et al.
7,582,024 B2 * 9/2009 Shear ..... A63B 53/0466 473/329
7,585,233 B2 9/2009 Horacek et al.
7,632,193 B2 * 12/2009 Thielen ..... A63B 53/0466 473/334
7,632,195 B2 * 12/2009 Jorgensen ..... A63B 53/0466 473/345
7,637,822 B2 * 12/2009 Foster ..... A63B 53/0466 473/329
7,682,264 B2 3/2010 Hsu et al.
7,717,806 B2 * 5/2010 Kubota ..... A63B 53/0487 473/340
D616,952 S 6/2010 Oldknow
7,749,097 B2 * 7/2010 Foster ..... A63B 53/0466 473/329
7,753,807 B2 * 7/2010 Nakano ..... A63B 53/02 473/335
7,758,454 B2 * 7/2010 Burnett ..... A63B 53/0466 473/345
7,775,903 B2 8/2010 Kawaguchi et al.
7,857,711 B2 * 12/2010 Shear ..... A63B 53/0466 473/329
7,874,938 B2 1/2011 Chao
7,896,753 B2 3/2011 Boyd et al.
7,931,546 B2 * 4/2011 Bennett ..... A63B 53/0466 473/345
7,934,998 B2 5/2011 Yokota
8,025,591 B2 9/2011 De La Cruz et al.
8,157,671 B1 * 4/2012 Beach ..... A63B 53/0466 473/329
8,235,841 B2 * 8/2012 Stites ..... A63B 53/0466 473/328
8,235,844 B2 8/2012 Albertsen et al.
8,241,143 B2 8/2012 Albertsen et al.
8,241,144 B2 * 8/2012 Albertsen ..... A63B 53/0466 473/345
8,267,808 B2 9/2012 De La Cruz et al.
8,328,659 B2 * 12/2012 Shear ..... A63B 53/0466 473/329
8,353,782 B1 * 1/2013 Beach ..... A63B 53/0466 473/329
8,403,771 B1 * 3/2013 Rice ..... A63B 53/04 473/328
8,419,569 B2 * 4/2013 Bennett ..... A63B 53/0466 473/345
8,430,763 B2 * 4/2013 Beach ..... A63B 53/06 473/307
8,435,134 B2 * 5/2013 Tang ..... A63B 53/04 473/329
8,517,860 B2 * 8/2013 Albertsen ..... A63B 53/0466 473/329
8,529,368 B2 * 9/2013 Rice ..... A63B 53/04 473/329
8,632,419 B2 * 1/2014 Tang ..... A63B 53/04 473/329
8,641,555 B2 * 2/2014 Stites ..... A63B 53/0466 473/328
8,702,532 B2 * 4/2014 Shear ..... A63B 53/0466 473/329
8,721,471 B2 * 5/2014 Albertsen ..... A63B 53/0466 473/322
8,821,312 B2 * 9/2014 Burnett ..... A63B 53/0466 473/329
8,834,289 B2 * 9/2014 de la Cruz ..... A63B 53/0466 473/329
8,834,290 B2 * 9/2014 Bezilla ..... A63B 53/0466 473/329
8,900,069 B2 * 12/2014 Beach ..... A63B 53/06 473/329
8,956,242 B2 * 2/2015 Rice ..... A63B 53/0466 473/329
8,961,332 B2 * 2/2015 Galvan ..... A63B 53/04 473/329
8,986,133 B2 * 3/2015 Bennett ..... A63B 53/06 473/329

(56) References Cited

U.S. PATENT DOCUMENTS

| | | | | |
|---|---|---|---|---|
| 9,011,267 | B2 * | 4/2015 | Burnett | A63B 53/04 473/329 |
| 9,089,747 | B2 * | 7/2015 | Boyd | A63B 53/0466 |
| 9,387,371 | B1 * | 7/2016 | Beach | A63B 53/0466 |
| 9,636,559 | B2 * | 5/2017 | de la Cruz | A63B 60/54 |
| 2002/0055396 | A1 | 5/2002 | Nishimoto | |
| 2002/0183134 | A1 * | 12/2002 | Allen | A63B 53/04 473/329 |
| 2003/0220154 | A1 | 11/2003 | Anelli | |
| 2004/0176183 | A1 * | 9/2004 | Tsurumaki | A63B 53/0466 473/345 |
| 2004/0192463 | A1 * | 9/2004 | Tsurumaki | A63B 53/0466 473/329 |
| 2005/0049081 | A1 | 3/2005 | Boone | |
| 2007/0026961 | A1 * | 2/2007 | Hou | A63B 53/0466 473/329 |
| 2007/0082751 | A1 | 4/2007 | Lo | |
| 2011/0319188 | A1 | 12/2011 | Narita et al. | |
| 2012/0034991 | A1 | 2/2012 | Hartwell et al. | |
| 2012/0142452 | A1 | 6/2012 | Burnett et al. | |
| 2012/0196701 | A1 | 8/2012 | Stites | |
| 2012/0202615 | A1 | 8/2012 | Beach et al. | |
| 2012/0244960 | A1 | 9/2012 | Tang et al. | |
| 2012/0270676 | A1 | 10/2012 | Burnett | |
| 2012/0277029 | A1 | 11/2012 | Albertsen | |
| 2012/0277030 | A1 | 11/2012 | Albertsen | |
| 2012/0289361 | A1 | 11/2012 | Beach et al. | |
| 2013/0165252 | A1 | 6/2013 | Rice et al. | |
| 2013/0165254 | A1 | 6/2013 | Rice et al. | |
| 2013/0184100 | A1 | 7/2013 | Burnett et al. | |
| 2013/0210542 | A1 | 8/2013 | Harbert et al. | |
| 2014/0080634 | A1 | 3/2014 | Golden et al. | |

FOREIGN PATENT DOCUMENTS

| | | | | | |
|---|---|---|---|---|---|
| JP | 02063482 | A | * | 3/1990 | A63B 53/04 |
| JP | 4-347179 | | | 12/1992 | |
| JP | 04347179 | A | * | 12/1992 | |
| JP | 7-155410 | | | 6/1995 | |
| JP | 07155410 | A | * | 6/1995 | |
| JP | 9-51968 | | | 2/1997 | |
| JP | 09051968 | A | * | 2/1997 | |
| JP | 9-215786 | | | 8/1997 | |
| JP | 09215786 | A | * | 8/1997 | |
| JP | 11-114107 | | | 4/1999 | |
| JP | 11-114112 | | | 4/1999 | |
| JP | 11114107 | A | * | 4/1999 | |
| JP | 11114112 | A | * | 4/1999 | |
| JP | 11-178955 | | | 7/1999 | |
| JP | 11178955 | A | * | 7/1999 | |
| JP | 2000-126339 | | | 5/2000 | |
| JP | 2000126339 | A | * | 5/2000 | |
| JP | 2000-176056 | | | 6/2000 | |
| JP | 2000176056 | A | * | 6/2000 | |
| JP | 2000-262656 | | | 9/2000 | |
| JP | 2001190720 | A | * | 7/2001 | A63B 53/047 |
| JP | 2002-52099 | | | 2/2002 | |
| JP | 2003-062135 | | | 3/2003 | |
| JP | 2003062135 | A | * | 3/2003 | |
| JP | 2003-093554 | | | 4/2003 | |
| JP | 2003-190340 | | | 7/2003 | |
| JP | 2003190340 | A | * | 7/2003 | A63B 53/047 |
| JP | 2003-265657 | | | 9/2003 | |
| JP | 2003265657 | A | * | 9/2003 | |
| JP | 2003-290397 | | | 10/2003 | |
| JP | 2003325709 | A | * | 11/2003 | |
| JP | 2004-121395 | | | 4/2004 | |
| JP | 2004121395 | A | * | 4/2004 | |
| JP | 2004-174224 | | | 6/2004 | |
| JP | 2004174224 | A | * | 6/2004 | A63B 53/0466 |
| JP | 2004-261451 | | | 9/2004 | |
| JP | 2004261451 | A | * | 9/2004 | |
| JP | 2004-313762 | | | 11/2004 | |
| JP | 2004313762 | A | * | 11/2004 | |
| JP | 2004-351054 | | | 12/2004 | |
| JP | 2004-351173 | | | 12/2004 | |
| JP | 2004351054 | A | * | 12/2004 | |
| JP | 2005-576 | | | 1/2005 | |
| JP | 2005000576 | A | * | 1/2005 | |
| JP | 2005-177092 | | | 7/2005 | |
| JP | 2005177092 | A | * | 7/2005 | |
| JP | 2006-198248 | | | 8/2006 | |
| JP | 2006198248 | A | * | 8/2006 | |
| JP | 2007-136069 | | | 6/2007 | |
| JP | 2007136069 | A | * | 6/2007 | A63B 53/0466 |
| JP | 2007-275253 | | | 10/2007 | |
| JP | 2007275253 | A | * | 10/2007 | A63B 53/0466 |
| JP | 2009279373 | A | * | 12/2009 | A63B 53/0466 |
| JP | 2010-029590 | | | 2/2010 | |
| JP | 2010029590 | A | * | 2/2010 | A63B 53/0466 |
| JP | 2010-279847 | | | 12/2010 | |
| JP | 2010279847 | A | * | 12/2010 | |
| WO | WO 2007-136069 | | | 6/2007 | |

* cited by examiner

GOLF CLUB HEAD WITH DEPRESSION

CROSS-REFERENCE TO RELATED APPLICATIONS

This application is continuation of U.S. patent application Ser. No. 14/587,360 filed on Dec. 31, 2014, which is a Continuation-in-part of U.S. patent application Ser. No. 14/089,574, filed on Nov. 25, 2013, now U.S. Pat. No. 9,320,949, which is a continuation-in-part of U.S. patent application Ser. No. 13/850,992, filed on Mar. 26, 2013, now U.S. Pat. No. 8,715,109, which is a continuation of U.S. patent application Ser. No. 13/085,711, filed on Apr. 13, 2011, now U.S. Pat. No. 8,419,569, which is a continuation of U.S. patent application Ser. No. 12/340,925, filed on Dec. 22, 2008, now U.S. Pat. No. 7,931,546, which is a continuation-in-part of U.S. patent application Ser. No. 12/193,110, filed Aug. 18, 2008, now U.S. Pat. No. 7,758,454, which is a continuation of U.S. patent application Ser. No. 11/552,729, filed Oct. 25, 2006, now U.S. Pat. No. 7,497,789, and U.S. patent application Ser. No. 14/089,574, filed on Nov. 25, 2013, now U.S. Pat. No. 9,320,949, is a continuation-in-part of U.S. patent application Ser. No. 13/854,709, filed on Apr. 1, 2013, now U.S. Pat. No. 8,894,508, which is a continuation of U.S. patent application Ser. No. 13/207,344, filed Aug. 10, 2011, now U.S. Pat. No. 8,409,032, and U.S. patent application Ser. No. 14/089,574, filed on Nov. 25, 2013, now U.S. Pat. No. 9,320,949, is a continuation-in-part of U.S. patent application Ser. No. 13/844,954, filed on Mar. 16, 2013, now U.S. Pat. No. 8,986,133, which is a continuation-in-part of U.S. patent application Ser. No. 13/720,885, filed on Dec. 19, 2012, now U.S. Pat. No. 8,834,290, which is a continuation-in-part of U.S. patent application Ser. No. 13/618,963, filed on Sep. 14, 2012, now U.S. Pat. No. 8,834,289, the disclosures of which are hereby incorporated by reference in their entireties.

FIELD OF THE INVENTION

The present invention relates to an improved golf club head. More particularly, the present invention relates to a golf club head having a depression.

BACKGROUND

The complexities of golf club design are well known. The specifications for each component of the club (i.e., the club head, shaft, grip, and subcomponents thereof) directly impact the performance of the club. Thus, by varying the design specifications, a golf club can be tailored to have specific performance characteristics.

The design of club heads has long been studied. Among the more prominent considerations in club head design are loft, lie, face angle, horizontal face bulge, vertical face roll, center of gravity (CG), inertia, material selection, and overall head weight. While this basic set of criteria is generally the focus of golf club engineering, several other design aspects must also be addressed. The interior design of the club head may be tailored to achieve particular characteristics, such as the inclusion of hosel or shaft attachment means, perimeter weights on the club head, and fillers within hollow club heads.

Golf club heads must also be strong to withstand the repeated impacts that occur during collisions between the golf club and the golf ball. The loading that occurs during this transient event can create a peak force of over 2,000 lbs. Thus, a major challenge is designing the club face and body to resist permanent deformation or failure by material yield or fracture. Conventional hollow metal wood drivers made from titanium typically have a face thickness exceeding 2.5 mm to ensure structural integrity of the club head.

Players generally seek a metal wood driver and golf ball combination that delivers maximum distance and landing accuracy. The distance a ball travels after impact is dictated by the magnitude and direction of the ball's translational velocity and the ball's rotational velocity or spin. Environmental conditions, including atmospheric pressure, humidity, temperature, and wind speed, further influence the ball's flight. However, these environmental effects are beyond the control of the golf equipment manufacturer. Golf ball landing accuracy is driven by a number of factors as well. Some of these factors are attributed to club head design, such as center of gravity and club face flexibility.

The United States Golf Association (USGA), the governing body for the rules of golf in the United States, has specifications for the performance of golf balls. These performance specifications dictate the size and weight of a conforming golf ball. One USGA rule limits the golf ball's initial velocity after a prescribed impact to 250 feet per second+2% (or 255 feet per second maximum initial velocity). To achieve greater golf ball travel distance, ball velocity after impact and the coefficient of restitution of the ball-club impact must be maximized while remaining within this rule.

Generally, golf ball travel distance is a function of the total kinetic energy imparted to the ball during impact with the club head, neglecting environmental effects. During impact, kinetic energy is transferred from the club and stored as elastic strain energy in the club head and as viscoelastic strain energy in the ball. After impact, the stored energy in the ball and in the club is transformed back into kinetic energy in the form of translational and rotational velocity of the ball, as well as the club. Since the collision is not perfectly elastic, a portion of energy is dissipated in club head vibration and in viscoelastic relaxation of the ball. Viscoelastic relaxation is a material property of the polymeric materials used in all manufactured golf balls.

Viscoelastic relaxation of the ball is a parasitic energy source, which is dependent upon the rate of deformation. To minimize this effect, the rate of deformation must be reduced. This may be accomplished by allowing more club face deformation during impact. Since metallic deformation may be purely elastic, the strain energy stored in the club face is returned to the ball after impact thereby increasing the ball's outbound velocity after impact.

A variety of techniques may be utilized to vary the deformation of the club face, including uniform face thinning, thinned faces with ribbed stiffeners and varying thickness, among others. These designs should have sufficient structural integrity to withstand repeated impacts without permanently deforming the club face. In general, conventional club heads also exhibit wide variations in initial ball speed after impact, depending on the impact location on the face of the club. Hence, there remains a need in the art for a club head that has a larger "sweet zone" or zone of substantially uniform high initial ball speed.

Technological breakthroughs in recent years provide the average golfer with more distance, such as making larger head clubs while keeping the weight constant or even lighter, by casting consistently thinner shell thickness and going to lighter materials such as titanium. Also, the faces of clubs have been steadily becoming extremely thin. The thinner face maximizes the coefficient of restitution (COR). The more a face rebounds upon impact, the more energy that may be imparted to the ball, thereby increasing distance. In order to make the faces thinner, manufacturers have moved to forged, stamped or machined metal faces which are generally stronger than cast faces. Common practice is to attach the forged or stamped metal face by welding them to the body or sole. The thinner faces are more vulnerable to failure. The present invention provides a novel manner for providing the face of the club with the desired flex and rebound at impact thereby maximizing COR.

SUMMARY OF THE INVENTION

The present invention relates to a golf club head including a depression that alters the acoustic behavior of a golf club head.

One non-limiting embodiment of the present technology includes a golf club head, comprising: a crown defining an upper surface of the golf club head; a sole defining a lower surface of the golf club head, said sole comprising a transmittal portion, a flexure, and a rear portion; a skirt extending between the crown and the sole; a hosel extending from the crown and including a shaft bore; a face defining a ball-striking surface and intersecting said sole at a leading edge; an interior cavity defined by said crown, sole, skirt, and face; a coordinate system with an x-axis located horizontal to said face, a y-axis located vertical to said face, and a z-axis located through said face, said z-axis and said x-axis parallel to a ground plane when said golf club head is held at address on said ground plane; wherein said flexure is spaced aftward of said face by said transmittal portion, extending in a generally heel-to-toe direction and substantially parallel to the leading edge of the golf club head, wherein said flexure is defined by a front wall and a rear wall coupled by an apex, wherein said front wall and said rear wall extend into said interior cavity, wherein said rear portion of said sole is located aft of said flexure, wherein said rear portion of said sole is substantially convex; a depression formed in said rear portion of said sole, wherein said depression is substantially concave and protrudes inwards towards said interior cavity of said golf club head.

In an additional non-limiting embodiment of the present technology said depression comprises an external surface opposite said interior cavity, wherein said external surface of said depression comprises a perimeter defined by an inflection border where the concavity of the sole inverts between said convex sole and said concave depression, wherein said depression comprises a length, Ld, measured along said z-axis from the aft most portion of said depression to the forward most portion of said depression, wherein said depression comprises a width, Wd, measured along said x-axis from the toe most portion of said depression to the heel most portion of said depression, wherein said depression comprises a height, Hd, measured along said y-axis from said ground plane to the highest point of said external surface of said depression, wherein Ld is greater than about 20 mm, Wd is greater than about 10 mm and Wd is less than about 80 mm, and Hd is greater than about 4 mm and less than about 20 mm.

In an additional non-limiting embodiment of the present technology Ld is greater than about 30 mm, Wd is greater than about 20 mm and less than about 60 mm, and Hd is greater than about 6 mm and less than about 14 mm.

In an additional non-limiting embodiment of the present technology Ld is greater than about 40 mm, Wd is greater than about 30 mm and less than about 50 mm, and Hd is greater than about 6 mm and less than about 10 mm.

In an additional non-limiting embodiment of the present technology said depression comprises an outer surface, said depression further comprising a fore-aft depression curve defined by the intersection of said outer surface and a fore-aft plane, said fore-aft plane parallel to said y-axis and said z-axis, said fore-aft plane passing through the center of said depression, said fore-aft depression curve passing a fore-aft radius gauge test utilizing a circular fore-aft radius gauge having a radius of 10 mm, said depression further comprising a heel-toe depression curve defined by the intersection of said outer surface and a heel-toe plane, said heel-toe plane parallel to said y-axis and said x-axis, and located at the widest portion of said depression, said heel-toe depression curve passing a heel-toe radius gauge test utilizing a circular heel-toe radius gauge having a radius of 5 mm.

In an additional non-limiting embodiment of the present technology wherein said height of said depression, Hd, is between 60% and 120% of the height, H, of the flexure.

In an additional non-limiting embodiment of the present technology width, Wd, of said depression is at least two times the width, W, of the flexure.

An additional non-limiting embodiment of the present technology includes a golf club head, comprising: a crown defining an upper surface of the golf club head; a sole defining a lower surface of the golf club head, said sole comprising a transmittal portion, a flexure, and a rear portion; a skirt extending between the crown and the sole; a hosel extending from the crown and including a shaft bore; a face defining a ball-striking surface and intersecting said sole at a leading edge; an interior cavity defined by said crown, sole, skirt, and face; a coordinate system with an x-axis located horizontal to said face, a y-axis located vertical to said face, and a z-axis located through said face, said z-axis and said x-axis parallel to a ground plane when said golf club head is held at address on said ground plane; wherein said flexure is spaced aftward of said face by said transmittal portion, extending in a generally heel-to-toe direction and substantially parallel to the leading edge of the golf club head, wherein said flexure is defined by a front wall and a rear wall coupled by an apex, wherein said front wall and said rear wall extend into said interior cavity, and wherein said rear portion of said sole is located aft of said flexure wherein said rear portion of said sole is substantially convex; a depression formed in said rear portion of said sole, wherein said depression is substantially concave and protrudes inwards towards said interior cavity of said golf club head; wherein said flexure further comprises a flexure channel, said flexure channel located between said front wall and said rear wall and external to said golf club head; wherein said depression further comprises a depression channel, said depression channel located inside said depression and external to said golf club head; wherein said depression channel communicates with said flexure channel.

In an additional non-limiting embodiment of the present technology wherein said depression comprises an external surface opposite said interior cavity, wherein said external surface of said depression comprises a perimeter defined by an inflection border where the concavity of the sole inverts between said convex sole and said concave depression, wherein said depression comprises a length, Ld, measured along said z-axis from the aft most portion of said depression to an intersection of said external surface of said depression and an external surface of said rear wall of said flexure, wherein said depression comprises a width, Wd, measured along said x-axis from the toe most portion of said depression to the heel most portion of said depression, wherein said depression comprises a height, Hd, measured along said y-axis from said ground plane to the highest point of said external surface of said depression, wherein Ld is greater than about 20 mm, Wd is greater than about 10 mm and Wd is less than about 80 mm, and Hd is greater than about 4 mm and less than about 20 mm.

In an additional non-limiting embodiment of the present technology Ld is greater than about 30 mm, Wd is greater than about 20 mm and less than about 60 mm, and Hd is greater than about 6 mm and less than about 14 mm.

In an additional non-limiting embodiment of the present technology Ld is greater than about 40 mm, Wd is greater than about 30 mm and less than about 50 mm, and Hd is greater than about 6 mm and less than about 10 mm.

In an additional non-limiting embodiment of the present technology said depression comprises an outer surface, said depression further comprising a fore-aft depression curve defined by the intersection of said outer surface and a fore-aft plane, said fore-aft plane parallel to said y-axis and said z-axis, said fore-aft plane passing through the center of said depression, said fore-aft depression curve passing a fore-aft radius gauge test utilizing a circular fore-aft radius gauge having a radius of 10 mm, said depression further comprising a heel-toe depression curve defined by the intersection of said outer surface and a heel-toe plane, said heel-toe plane parallel to said y-axis and said x-axis, and located at the widest portion of said depression, said heel-toe depression curve passing a heel-toe radius gauge test utilizing a circular heel-toe radius gauge having a radius of 5 mm.

In an additional non-limiting embodiment of the present technology said height of said depression, Hd, is between 60% and 120% of the height, H, of the flexure.

In an additional non-limiting embodiment of the present technology width, Wd, of said depression is at least two times the width, W, of the flexure.

An additional non-limiting embodiment of the present technology includes a golf club head, comprising: a crown defining an upper surface of the golf club head; a sole defining a lower surface of the golf club head, said sole comprising an interior surface and an exterior surface, wherein said sole is substantially convex in shape; a skirt extending between the crown and the sole; a hosel extending from the crown and including a shaft bore; a face defining a ball-striking surface and intersecting said sole at a leading edge; an interior cavity defined by said crown, sole, skirt, and face; a coordinate system with an x-axis located horizontal to said face, a y-axis located vertical to said face, and a z-axis located through said face, said z-axis and said x-axis parallel to a ground plane when said golf club head is held at address on said ground plane; a depression formed in said sole, wherein said depression is substantially concave and protrudes inwards towards said interior cavity of said golf club head.

In an additional non-limiting embodiment of the present technology said depression comprises an external surface opposite said interior cavity, wherein said external surface of said depression comprises a perimeter defined by an inflection border where the concavity of the sole inverts between said convex sole and said concave depression, wherein said depression comprises a length, Ld, measured along said z-axis from the aft most portion of said depression to the forward most portion of said depression, wherein said depression comprises a width, Wd, measured along said x-axis from the toe most portion of said depression to the heel most portion of said depression, wherein said depression comprises a height, Hd, measured along said y-axis from said ground plane to the highest point of said external surface of said depression, wherein Ld is greater than about 20 mm, Wd is greater than about 10 mm and Wd is less than about 80 mm, and Hd is greater than about 4 mm and less than about 20 mm.

In an additional non-limiting embodiment of the present technology Ld is greater than about 30 mm, Wd is greater than about 20 mm and less than about 60 mm, and Hd is greater than about 6 mm and less than about 14 mm.

In an additional non-limiting embodiment of the present technology Ld is greater than about 40 mm, Wd is greater than about 30 mm and less than about 50 mm, and Hd is greater than about 6 mm and less than about 10 mm.

In an additional non-limiting embodiment of the present technology said depression comprises an outer surface, said depression further comprising a fore-aft depression curve defined by the intersection of said outer surface and a fore-aft plane, said fore-aft plane parallel to said y-axis and said z-axis, said fore-aft plane passing through the center of said depression, said fore-aft depression curve passing a fore-aft radius gauge test utilizing a circular fore-aft radius gauge having a radius of 10 mm, said depression further comprising a heel-toe depression curve defined by the intersection of said outer surface and a heel-toe plane, said heel-toe plane parallel to said y-axis and said x-axis, and located at the widest portion of said depression, said heel-toe depression curve passing a heel-toe radius gauge test utilizing a circular heel-toe radius gauge having a radius of 5 mm.

In an additional non-limiting embodiment of the present technology said fore-aft depression curve passes a fore-aft radius gauge test utilizing a circular fore-aft radius gauge having a radius of 20 mm, and said heel-toe depression curve passes a heel-toe radius gauge test utilizing a circular heel-toe radius gauge having a radius of 10 mm.

BRIEF DESCRIPTION OF THE DRAWINGS

Preferred features of the present invention are disclosed in the accompanying drawings, wherein similar reference characters denote similar elements throughout the several views, and wherein:

FIG. 84 is a bottom view of an additional embodiment of a golf club head.

FIG. 89 is a rear view of the golf club head of FIG. 87.

DETAILED DESCRIPTION OF THE PREFERRED EMBODIMENT

Figure 1:
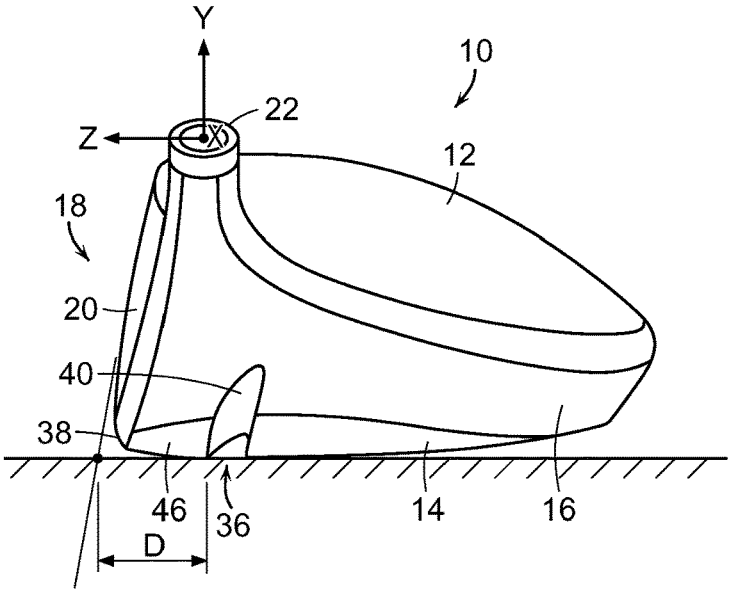
FIG. 1 is a side view of an embodiment of a golf club head of the present invention.

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Coefficient of restitution, or "COR", is a measure of collision efficiency. COR is the ratio of the velocity of separation to the velocity of approach. As an example, such as for a golf ball struck off of a golf tee, COR may be determined using the following formula:

$$(M_{ball}(V_{ball\text{-}post}-V_{ball\text{-}pre})+M_{club}(V_{ball\text{-}post}-V_{club\text{-}pre}))/M_{club}(V_{club\text{-}pre}-V_{ball\text{-}pre})$$

where, $V_{club\text{-}post}$ represents the velocity of the club after impact;

$V_{ball\text{-}post}$ represents the velocity of the ball after impact;

$V_{club\text{-}pre}$ represents the velocity of the club before impact (a value of zero for USGA COR conditions); and $V_{ball\text{-}pre}$ represents the velocity of the ball before impact.

Because the initial velocity of the ball is 0.0 during the collision, because it is stationary on a golf tee, the formula reduces to the following:

$$(M_{ball}V_{ball\text{-}post}+M_{club}(V_{ball\text{-}post}-V_{club\text{-}pre}))/M_{club}(V_{club\text{-}pre})$$

COR, in general, depends on the shape and material properties of the colliding bodies. A perfectly elastic impact has a COR of one (1.0), indicating that no energy is lost, while a perfectly inelastic or perfectly plastic impact has a COR of zero (0.0), indicating that the colliding bodies did not separate after impact resulting in a maximum loss of energy. Consequently, high COR values are indicative of greater ball velocity and distance.

Referring to FIGS. 1-4, an embodiment of a golf club head 10 of the present invention is shown. Club head 10 includes a construction that improves behavior of the club when struck by a golf ball, particularly when a lower portion of the face is struck. Club head 10 is a hollow body that includes a crown 12, a sole 14, a skirt 16, or side wall, that extends between crown 12 and sole 14, a face 18 that provides a ball striking surface 20, and a hosel 22. It should be understood that skirt 16 may comprise perimeter portions of crown 12 and sole 14 that curve towards each other to form the transition between an upper surface and a lower surface of the golf club head. The hollow body defines an inner cavity 24 that may be left empty or may be partially filled. If it is filled, it is preferable that inner cavity 24 be filled with foam or another low specific gravity material. Additionally, golf club head 10 includes at least one weight mounting feature 34 so that the overall weight of the golf club head can be altered and/or so the location of the center-of-gravity may be altered, and any number of weight mounting features may be included anywhere on the golf club head.

When club head 10 is in the address position, crown 12 provides an upper surface and sole 14 provides a lower surface of the golf club head. Skirt 16 extends between crown 12 and sole 14 and forms a perimeter of the club head. Face 18 provides a forward-most ball-striking surface 20 and includes a perimeter that is coupled to crown 12, sole 14 and skirt 16 to enclose cavity 24. Face 18 includes a toe portion 26 and a heel portion 28 on opposite sides of a geometric center of face 18. Hosel 22 extends outward from crown 12 and skirt 16 adjacent heel portion 28 of face 18 and provides an attachment structure for a golf club shaft (not shown).

Figure 2:
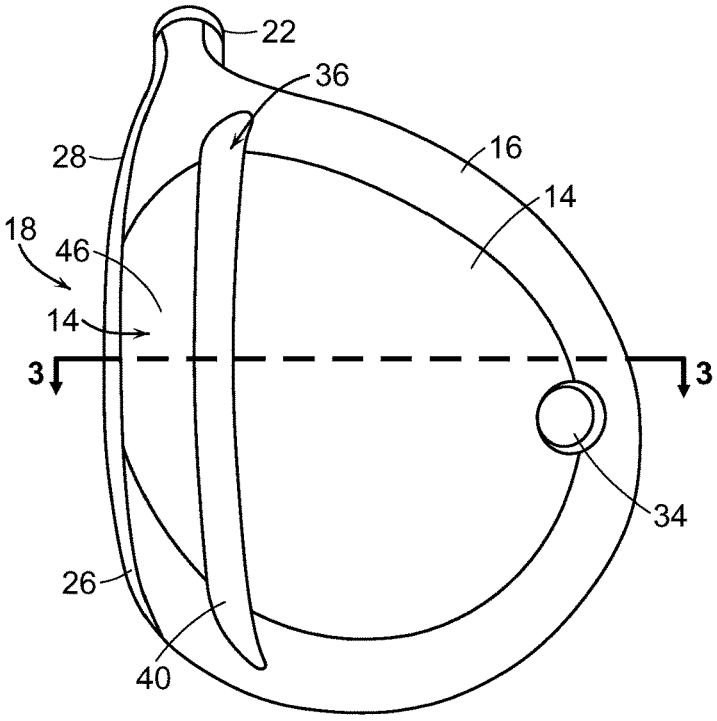
FIG. 2 is bottom plan view of the golf club head of FIG. 1.
Figure 3:
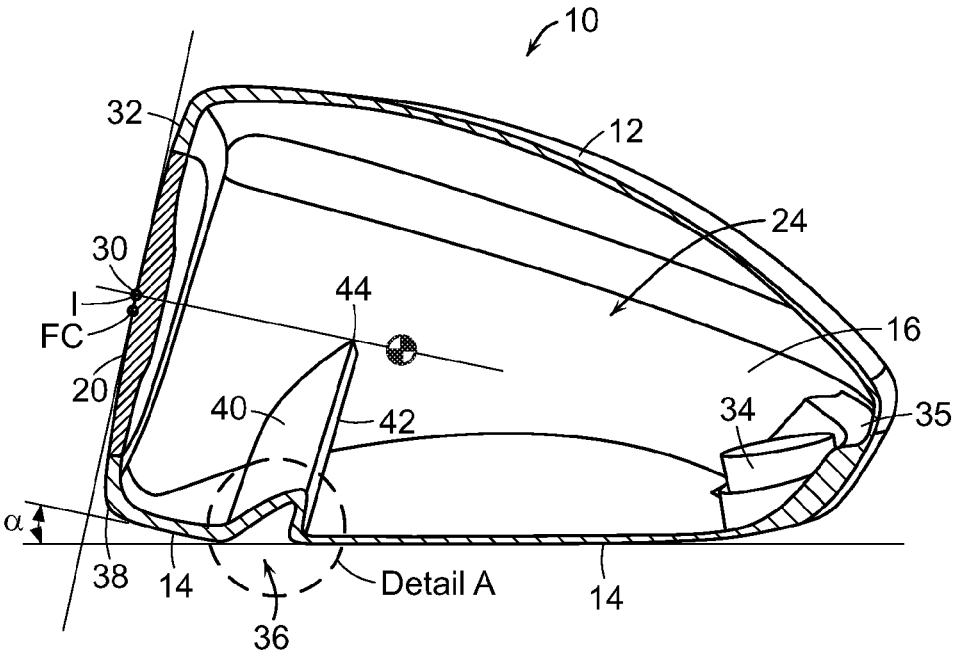
FIG. 3 is a cross-sectional view, corresponding to line 3-3 of FIG. 2.

Hosel 22 may have a through-bore or a blind hosel construction. In particular, hosel 22 is generally a tubular member and it may extend through cavity 24 from crown 12 to the bottom of the club head 10 at sole 14 or it may terminate at a location between crown 12 and sole 14. Furthermore, a proximal end of hosel 22 may terminate flush with crown 12, rather than extending outward from the club head away from crown 12 as shown in FIGS. 1 and 2.

Inner cavity 24 may have any volume, but is preferably greater than 100 cubic centimeters, and the golf club head may have a hybrid, fairway or driver type constructions. Preferably, the mass of the inventive club head 10 is greater than about 150 grams, but less than about 220 grams, although the club head may have any suitable weight for a given length to provide a desired overall weight and swing weight. The body may be formed of stamped, forged, cast and/or molded components that are welded, brazed and/or adhered together. Golf club head 10 may be constructed from a titanium alloy, any other suitable material or combinations of different materials. Further, weight members constructed of high density mater, such as tungsten, may be coupled to any portion of the golf club head, such as the sole.

Face 18 may include a face insert 30 that is coupled to a face perimeter 32, such as a face flange. The face perimeter 32 defines an opening for receiving the face insert 30. The face insert 30 is preferably connected to the perimeter 32 by welding. For example, a plurality of chads or tabs (not shown) may be provided to form supports for locating the face insert 30 or a face insert may be tack welded into position, and then the face insert 30 and perimeter 32 may be integrally connected by laser or plasma welding. The face insert 30 may be made by milling, casting, forging or stamping and forming from any suitable material, such as, for example, titanium, titanium alloy, carbon steel, stainless steel, beryllium copper, and carbon fiber composites and combinations thereof. Additionally, crown 12 or sole 14 may be formed separately and coupled to the remainder of the body.

The thickness of the face insert 30 is preferably between about 0.5 mm and about 4.0 mm. Additionally, the insert 30 may be of a uniform thickness or a variable thickness. For example, the face insert 30 may have a thicker center section and thinner outer section. In another embodiment, the face insert 30 may have two or more different thicknesses and the transition between thicknesses may be radiused or stepped. Alternatively, the face insert 30 may increase or decrease in thickness towards toe portion 26, heel portion 28, crown 12 and/or sole 14. It will be appreciated that one or both of the ball-striking surface or the rear surface of face 18 may have at least a portion that is curved, stepped or flat to vary the thickness of the face insert 30.

As mentioned above, club head 10 includes a construction that improves behavior of the club when it strikes a golf ball, particularly when a lower portion of the face impacts a golf ball. A flexure 36 is formed in a forward portion of the crown, sole and/or skirt. Flexure 36 is an elongate corrugation that extends in a generally heel to toe direction and that is formed in a forward portion of sole 14.

Flexure 36 is generally flexible in a fore/aft direction and provides a flexible portion in the club head 10 away from face 18 so that it allows at least a portion of face 18 to translate and rotate as a unit, in addition to flexing locally, when face 18 impacts a golf ball. The golf club head is designed to have two distinct vibration modes of the face between about 3000 Hz and about 6000 Hz, and the flexure is generally constructed to add the second distinct vibration mode of the face. The first face vibration mode primarily includes the local deflection of the face during center face impacts with a golf ball. The deflection profile of the second face vibration mode generally includes the entire face deflecting similar to an accordion and provides improved performance for off-center impacts between the face and a golf ball.

Flexure 36 is also configured to generally maintain the stiffness of sole 14 in a crown/sole direction so that the sound of the golf club head is not significantly affected. A lower stiffness of the sole in the crown/sole direction will generally lower the pitch of the sound that the club head produces, and the lower pitch is generally undesirable.

Flexure 36 allows the front portion of the club, including face 18, to flex differently than would otherwise be possible without altering the size and/or shape of face 18. In particular, a portion of the golf club head body adjacent the face is designed to elastically flex during impact. That flexibility reduces the reduction in ball speed, and reduces the backspin, that would otherwise be experienced for ball impacts located below the ideal impact location. The ideal impact location is a location on the ball-striking surface that intersects an axis that is normal to the ball-striking surface and that extends through the center of gravity of the golf club head, and as a result the ideal impact location is generally located above the geometric face center by a distance between about 0.5 mm and 5.0 mm. By providing flexure 36 in sole 14, close to face 18, the club head provides less of a reduction in ball speed, and lower back spin, when face 18 impacts a golf ball at a location below the ideal impact location. Thus, ball impacts at the ideal impact location and lower on the club face of the inventive club head will go farther than the same impact location on a conventional club head for the same swing characteristics. Locating flexure 36 in sole 14 is especially beneficial because the ideal impact location is generally located higher than the geometric face center in metal wood-type golf clubs. Therefore, a large portion of the face area is generally located below the ideal impact location. Additionally, there is a general tendency of golfers to experience golf ball impacts low on the face. Similar results, however, may be found for a club head 10 with flexures provided on other portions of the club head 10 for impacts located toward the flexure from the geometric face center. For example, a club having a flexure disposed in the crown may improve performance for ball impacts that are between the crown and the geometric face center.

In an embodiment, flexure 36 is provided such that it is substantially parallel to at least a portion of a leading edge 38 of the club head 10, so that it is generally curved with the leading edge, and is provided within a selected distance D from ball-striking surface 20. Preferably, flexure 36 is provided a distance D within 30 mm of ball-striking surface 20, more preferably within 20 mm of ball-striking surface 20, and more preferably between about 5.0 mm and 20.0 mm. For smaller golf club heads, such as those with fairway wood or hybrid constructions, it is preferable that the flexure 36 is provided within 10 mm of ball striking surface 20.

Flexure 36 is constructed from a first member 40 and a second member 42. First member 40 is coupled to a rearward edge of a forward transmittal portion 46 of sole 14 and curves into inner cavity 24 from sole 14. Second member 42 is coupled to a forward edge of a rearward portion of sole 14 and also curves into inner cavity 24 from sole 14. The ends of first member 40 and second member 42 that are spaced away from sole 14 are coupled to each other at an apex 44. Preferably, the flexure is elongate and extends in a generally heel to toe direction.

Figure 4:
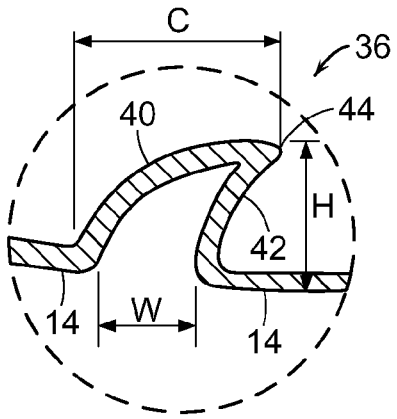
FIG. 4 is a cross-sectional view of a portion, shown in FIG. 3 as detail A, of the golf club head of FIG. 1.

The dimensions of flexure 36 are selected to provide a desired flexibility during a ball impact. Flexure 36 has a height H, a width W, and a curl length C, as shown in FIG. 4. Height H extends in the direction of the Y-axis between apex 44 and an outer surface of sole 14. Width W is the width of an opening in the sole that is created by flexure 36 and extends in the direction of the Z-axis between the junctions of flexure 36 with sole 14. Curl length C extends in the direction of the Z-axis and extends between the forward junction of flexure 36 with sole 14 and apex 44. Preferably, flexure 36 has a height that is greater than 4.0 mm, preferably about 5.0 mm to about 15.0 mm, more preferably about 6.0 mm to about 11.0 mm. Further, flexure 36 preferably has a width that is greater than 4.0 mm, preferably about 5.0 mm to about 12.0 mm, more preferably about 7.0 to about 11.0 mm. The flexure also has a wall thickness between about 0.8 mm and about 2.0 mm, and those dimensions preferably extend over a length that is at least 25% of the overall club head length along the X-axis. Further, first member 40 is curved inward, into the inner cavity, from the sole and preferably has a radius of curvature between about 20.0 mm and about 45.0 mm. Table 1, below, illustrates dimensions for inventive examples that provide a more efficient energy transfer, and therefore higher COR, for ball impacts that are below the ideal impact location of the golf club head.

TABLE 1

| Flexure Dimensions | Height [mm] | Width [mm] | Curl Length [mm] |
|---|---|---|---|
| Inv. Example 1 | 10.0 | 10 | 13 |
| Inv. Example 2 | 6.5 | 10 | 13 |
| Inv. Example 3 | 10.0 | 8 | 13 |
| Inv. Example 4 | 6.5 | 8 | 13 |
| Inv. Example 5 | 5.0 | 8 | 13 |

The inventive examples described above were analyzed using finite element analysis to determine the effect on COR and vibration response of the golf club head. In particular, a club head lacking a flexure (i.e., Baseline) was compared to the inventive examples. Table 2 summarizes the comparison.

TABLE 2

| Comparison | Weight Penalty [g] | Ball Speed [mph] | Extra Mode [Hz] | Mode 2 [Hz] | Mode 3 [Hz] | Mode 4 [Hz] |
|---|---|---|---|---|---|---|
| Baseline | N/A | 160.67 | N/A | 3409 | 3538 | 3928 |
| Inv. Example 1 | 7.0 | 157.16 | 2157 | 3608 | 3767 | 3907 |
| Inv. Example 2 | 5.4 | 161.28 | 3196 | 3639 | 3840 | 4002 |
| Inv. Example 3 | 7.6 | No data | 2186 | 3559 | 3706 | 3895 |
| Inv. Example 4 | 5.6 | 161.28 | 3406 | 3603 | 3796 | 4019 |
| Inv. Example 5 | 4.1 | 160.87 | N/A | 3540 | 3675 | 4163 |

In the above table, "extra mode" refers to a mode shape, or a natural mode of vibration that does not exist unless a flexure is present. The extra mode generally presents itself as the face portion rotating and flexing relative to the remainder of the golf club body. In particular, the inventive examples include a flexure that extends across a portion of the sole and the extra mode includes the face rotating about the interface between the face and crown so that the flexure flexes. The flexure is tuned so that that extra mode takes place in a range of frequencies from about 2900 Hz to about 4000 Hz, and more preferably at approximately 3600 Hz, which has been analyzed to be most effective in increasing the ball speed after impact. Practically speaking, that tuning results in the width W of the flexure varying sinusoidally, immediately after impact, at a frequency of about 2900 Hz to about 4000 Hz. If the extra mode takes place at a frequency that is higher or lower than that range, the ball speed can actually be lower compared to the baseline example that does not include a flexure. It has been determined using FEA analysis of inventive example 1 that a flexure that is tuned to provide an extra mode with a frequency below 2900 Hz, particularly approximately 2157 Hz, the ball speed is reduced below the baseline golf club head that does not include a flexure. Additionally, including a flexure that is too rigid provides a golf club head that does not include the extra mode, as shown by inventive example 5, and only provides minimal increase in ball speed after impact.

Transmittal portion 46 of sole 14 extends between flexure 36 and leading edge 38. Transmittal portion 46 is preferably constructed so that the force of a golf ball impact is transmitted to flexure 18 without transmittal portion 46 flexing significantly. For example, transmittal portion is oriented so that it is less inclined to bend. In particular, a transmittal plane that is tangent to the center of transmittal portion 46 (in both fore/aft and heel/toe directions) of sole 14 is angled relative to the ground plane by an angle $\alpha$. Angle $\alpha$ is preferably less than, or equal to, the loft angle of the golf club head at address, so that the angle between the transmittal plane and the ball striking surface is generally equal to, or less than, 90° so that transmittal portion 46 is less likely to bend during a ball impact.

Flexure 36 may be formed by any suitable manner. For example, flexure 36 may be cast as an integral part of sole 14. Alternatively, flexure 36 may be stamped or forged into a sole component. Additionally, the flexure may be formed by including a thickened region and machining a recess in that thickened region to form the flexure. For example, a spin-milling process may be used to provide a desired recess, the spin-milling process is generally described in U.S. Pat. No. 8,240,021 issued Aug. 14, 2012 as applied to face grooves, but a flexure with a desired profile may be machined using that process by increasing the size of the spin mill tool and altering the profile of the cutter. In general, that process utilizes a tool having an axis of rotation that is parallel to the sole and perpendicular to the leading edge of the golf club head and a cutting end that is profiled to create the desired profile of the flexure. The tool is then moved along a cutting path that is generally parallel to the leading edge. As a further alternative described in greater detail below, a separate flexure component may be added to a flexure on the sole to further tune the flexure of the sole, as shown in FIGS. 5 and 6.

As shown in the embodiment of FIG. 1, the face of the golf club head may include a face insert that is stamped, forged and/or machined separately and coupled to the body of the golf club head. Alternatively, the entire face may be stamped, forged or cast as part of a homogeneous shell, as shown in FIGS. 5 and 6, thereby eliminating the need to bond or otherwise permanently secure a separate face insert to the body. As a still further alternative, the face may be part of a stamped or forged face component, such as a face cup, that includes portions of the sole, crown and/or skirt. In such an embodiment, the face component is coupled to the remainder of the club head body away from the face plane by a distance from about 0.2 inches to about 1.5 inches. Preferably, the face component includes a transmittal portion of the sole that extends to a flexure or the face component includes both the transmittal portion and the flexure.

Figure 5:
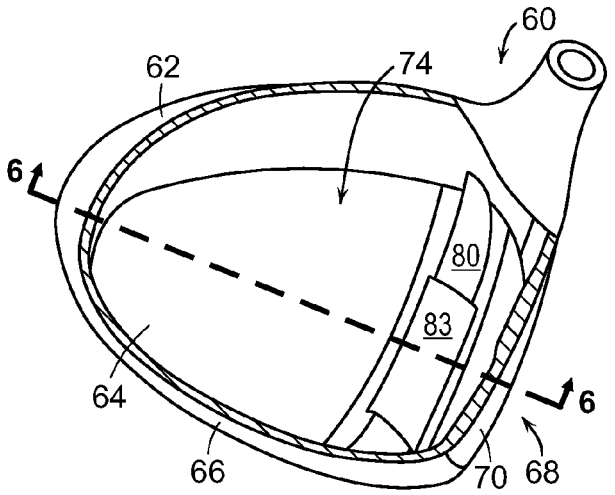
FIG. 5 is a perspective view of a portion of another embodiment of a golf club head of the present invention.
Figure 6:
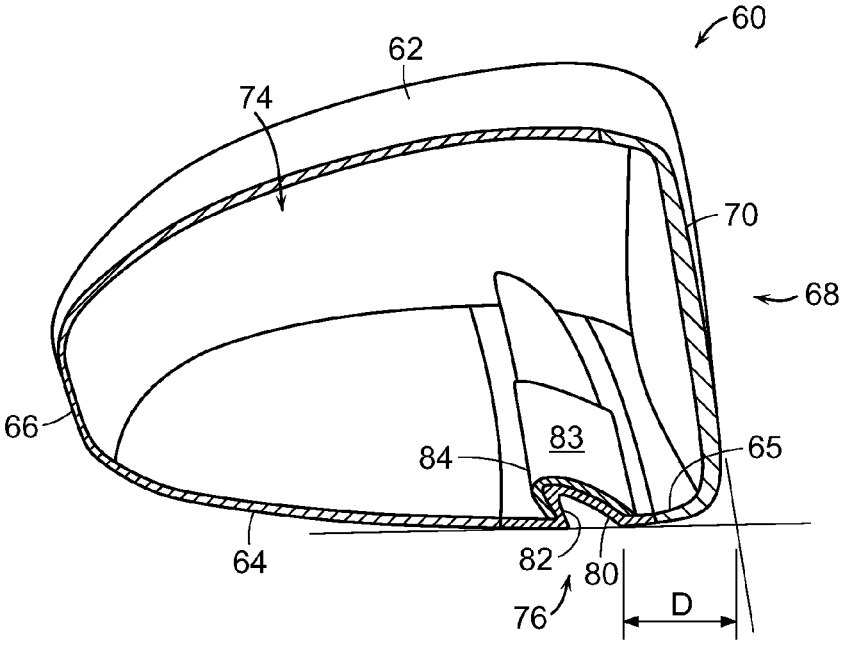
FIG. 6 is a cross-sectional view, corresponding to line 6-6 of FIG. 5.

In another embodiment, illustrated in FIGS. 5 and 6, a golf club head 60 is a hollow body that includes a crown 62, a sole 64, a skirt 66 that extends between crown 62 and sole 64, a face 68 that provides a ball striking surface 70, and a hosel 69. The hollow body defines an inner cavity 74 that may be left empty or it may be fully or partially filled.

A flexure 76 is formed in a forward portion of the sole, but it may alternatively be formed in the crown and/or skirt. Preferably, flexure 76 is an elongate corrugation that extends in a generally heel to toe direction and is formed in a forward portion of sole 64 of the body of golf club head 60. Flexure 76 provides a flexible portion in the club head 60 rearward from face 68 so that it allows at least a portion of face 68 to translate or rotate as a unit, in addition to flexing locally, when face 68 impacts a golf ball.

Flexure 76 allows the front portion of the club, including face 68, to flex differently than would otherwise be possible without altering the size and/or shape of face 68. That flexibility provides less reduction in ball speed that would otherwise be experienced for mis-hits, i.e., ball impacts located away from the ideal impact location, and less spin for impacts below the ideal impact location. For example, by providing flexure 76 in sole 64, close to face 68, the club head provides less of a reduction in ball speed when ball impact is located below the ideal impact location. Thus, during use, ball impacts that occur lower on the club face of the inventive club head will go farther than when compared with the same impact location on a club face of a conventional club head, for common swing characteristics.

In an embodiment, flexure 76 is provided such that it is substantially parallel to at least a portion of a leading edge 78 of the club head 60 and is provided within a certain distance D from ball-striking surface 70. Preferably, flexure 76 is provided a distance D within 30 mm of ball-striking surface 70, more preferably within 20 mm of ball-striking surface 70, and most preferably within 10 mm.

In the present embodiment, flexure 76 is constructed from a first member 80, a second member 82 and a third member 83 and is generally constructed as a separate component that is coupled to sole 64. First member 80 is coupled to a rearward edge of a forward transmittal portion 65 of sole 64 and curves into inner cavity 74 from the transmittal portion 65. Second member 82 is coupled to a forward edge of a rearward portion of sole 64 and also curves into inner cavity 74 from sole 64. The ends of first member 80 and second member 82 that are spaced away from sole 64 are coupled to each other at an apex 84. Preferably, the flexure is elongate and extends in a generally heel to toe direction. Flexure 76 may be bonded, welded or coupled to sole 64 using mechanical fasteners and the material of flexure 76 may be selected from materials having a plurality of densities, Young's moduli and dimensions to provide a plurality of flexures having different masses and stiffnesses. Furthermore, constructing the flexure as a separate component allows the repair of a broken flexure by replacing the flexure, and it allows the flexure to be constructed from different processes compared to the remainder of the golf club head such as by forging the flexure and casting the remainder of the golf club head.

Similar to previous embodiments, the dimensions of flexure 76 are selected to provide a desired elastic flex in response to a ball impact. Flexure 76 defines a height H, a width W, and a curl length C. Preferably, flexure 76 has a height that is greater than 4 mm, preferably about 5 mm to about 15 mm, and a width that is greater than 4 mm, preferably about 5 mm to about 10 mm, and a wall thickness between about 0.8 mm and about 2.0 mm, and those dimensions preferably extend over a length that is at least 25% of the overall club head length along the X-axis.

Flexure 76 includes third member 83 that may be used to tune the flexibility of flexure 76. Third member 83 may be coupled to an inner surface (as shown) or an outer surface of flexure 76 and locally increases the rigidity of flexure 76. Third member 83 is preferably constructed from a material that has a lower specific gravity than the material of at least one of first member 80 and second member 82. Third member 83 may be bonded, such as by using an adhesive, or mechanically coupled, such as by fasteners, welding or brazing, to first member 80 and second member 82. The third member may be constructed from any metallic material, such as aluminum, or non-metallic material, such as a carbon fiber composite material or polyurethane.

Figure 7:
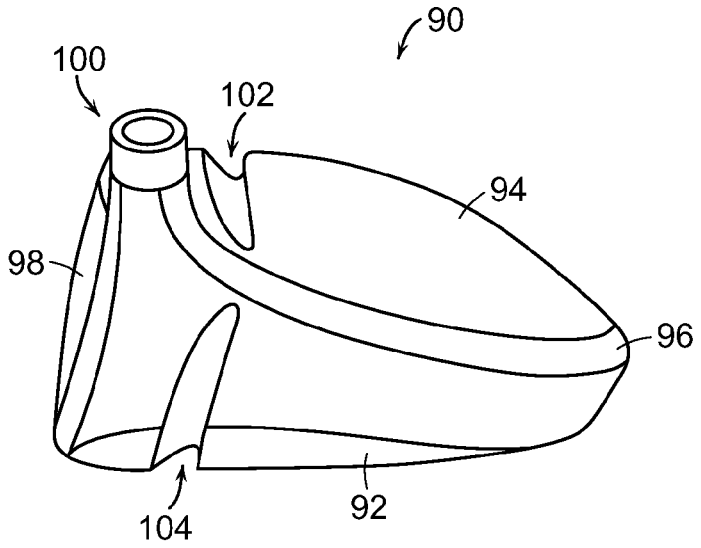
FIG. 7 is a side view of another embodiment of a golf club head of the present invention.
Figure 8:
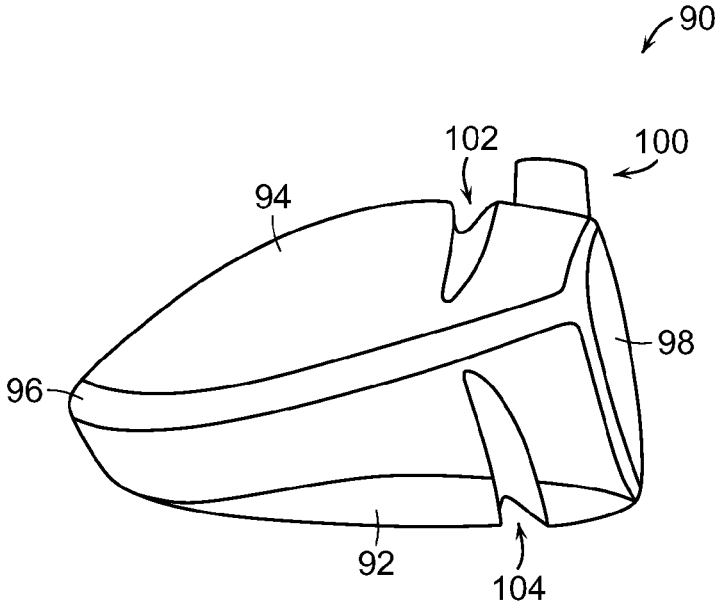
FIG. 8 is another side view of the golf club head of FIG. 7.

The location, dimensions and number of flexures in a golf club head may be selected to provide desired behavior. For example, a plurality of flexures may be included as shown in golf club head 90 of FIGS. 7 and 8. Golf club head 90 has a hollow body construction generally defined by a sole 92, a crown 94, a skirt 96, a face 98, and a hosel 100. A crown flexure 102 is disposed in a forward portion of crown 94 and a sole flexure 104 is disposed in a forward portion of sole 92. Each of the flexures 102, 104 is preferably shaped and dimensioned as the previously described flexures.

Figure 9:
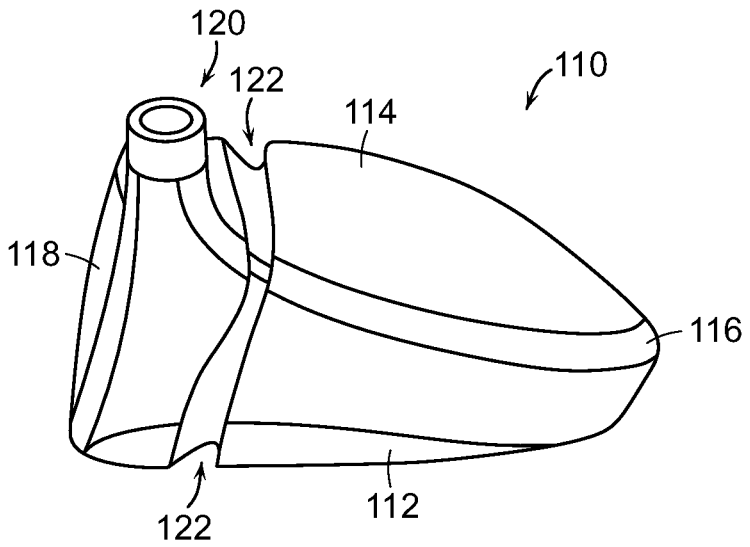
FIG. 9 is a side view of another embodiment of a golf club head of the present invention.
Figure 10:
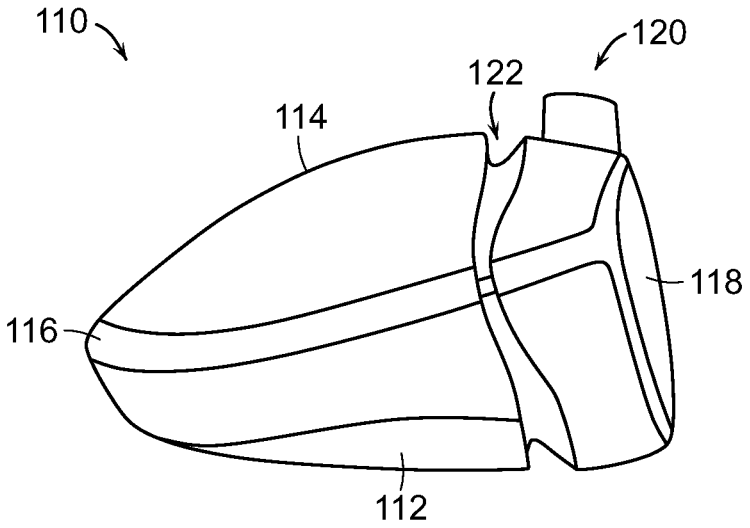
FIG. 10 is another side view of the golf club head of FIG. 9.

In other embodiments, flexures may be included that wrap around a portion of the golf club head body or entirely around the golf club head body. As shown in FIGS. 9 and 10, a golf club head 110 has a hollow body construction that is defined by a sole 112, a crown 114, a skirt 116, a face 118 and a hosel 120. A flexure 122 is formed in a forward portion of the golf club head and wraps around the perimeter of the golf club head. Flexure 122 is generally formed in a plane that is parallel to a face plane of golf club head 110. The distance between flexure 122 and face 118 may vary along its length to tune the local effect that flexure 122 provides to flexibility of the golf club head. For example, portions of flexure 122 may be spaced further from face 118 as compared to other portions. As illustrated, in an embodiment, heel and toe portions of flexure 122 are spaced further from face 118 than sole and crown portions of flexure 122. Additionally, the dimensions of flexure 122 may also be altered to tune the local effect that flexure 122 provides to the flexibility of the golf club head. As illustrated, portions of flexure 122 may have different height, width, and/or curl length to alter the behavior of the portions of flexure 122.

Figure 11:
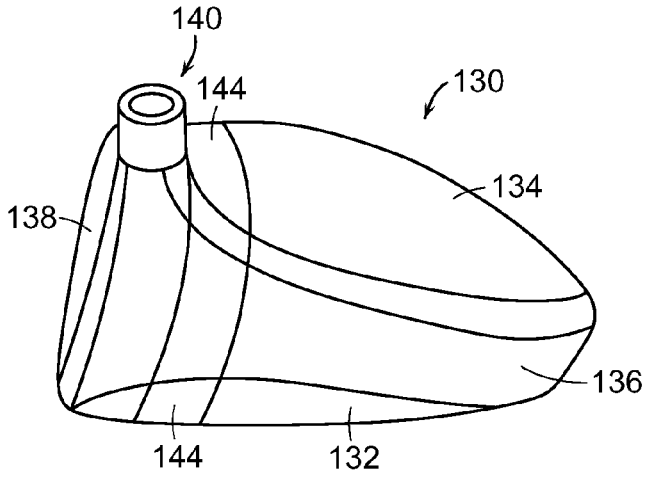
FIG. 11 is a side view of another embodiment of a golf club head of the present invention.
Figure 12:
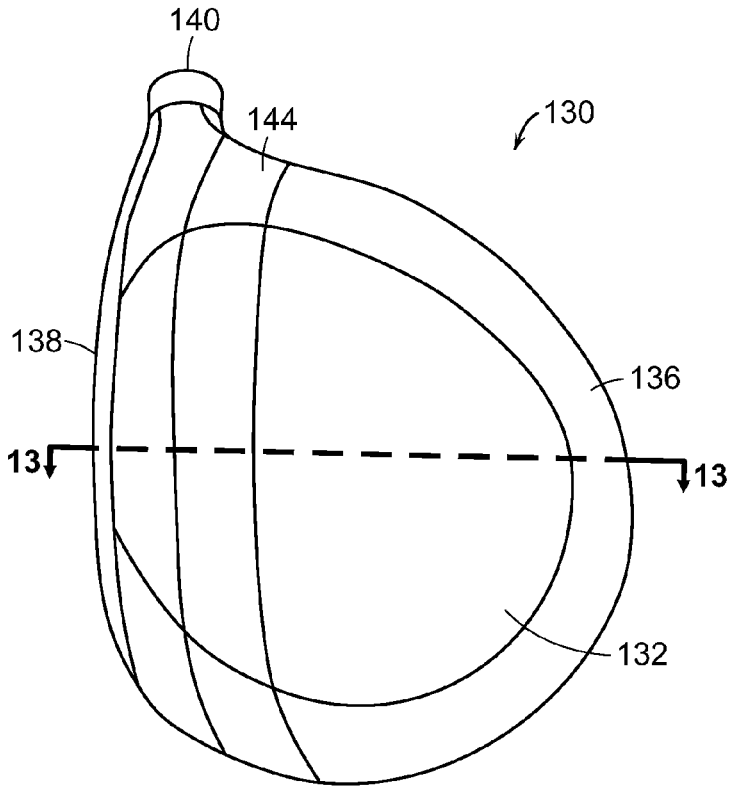
FIG. 12 is a bottom plan view of the golf club head of FIG. 11.
Figure 13:
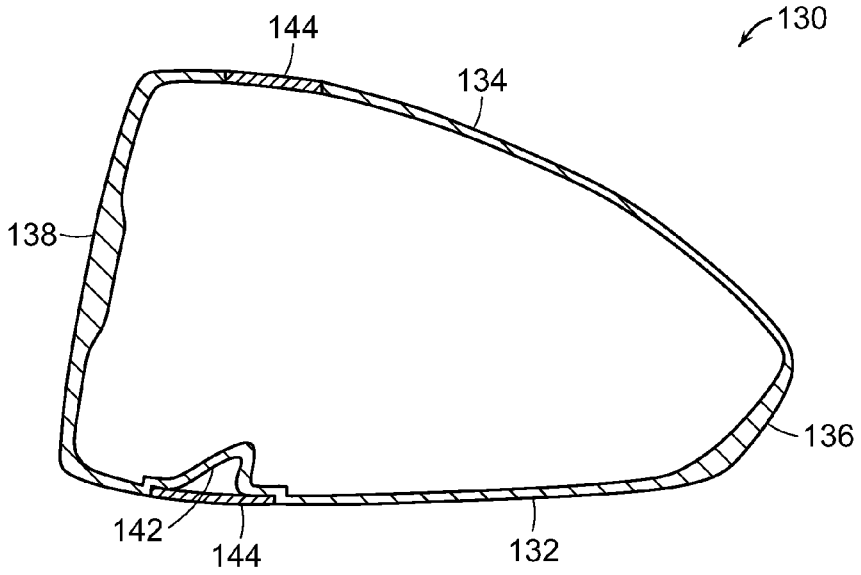
FIG. 13 is a cross-sectional view, corresponding to line 13-13 of FIG. 12.

In additional embodiments, a compliant flexure may be combined with a multi-material, light density cover member, as shown in FIGS. 11-13. For example, golf club head 130 generally has a hollow body construction that is defined by a sole 132, a crown 134, a skirt 136, a face 138 and a hosel 140. Golf club head 130 also includes a flexure 142 that is formed in a forward portion of sole 132 of golf club head 130. A cover 144 is also included in golf club head 130 and is configured to cover the outer surface of the flexure.

Cover 144 is generally a strip of material that is disposed across flexure 142 to generally enclose flexure 142. Cover 144 may be dimensioned so that it covers a portion or all of flexure 142, and it may extend into portions of golf club head 130 that do not include flexure. For example, and as shown in FIGS. 11 and 12, cover 144 extends across, and covers flexure 142 that is disposed on sole 132. Further, cover 144 forms a portion of skirt 136 and crown 134. Preferably, cover 144 is constructed of a material that is different than the materials of sole 132, crown 134 and skirt 136. Cover 144 is coupled to the adjacent portions of golf club head 130 by welding, brazing or adhering to those adjacent portions. Preferably, the flexure and cover are constructed from titanium alloys, such as beta-titanium alloys, and have widths between about 2.0 mm and about 20.0 mm, and thicknesses between about 0.35 mm to 2.0 mm.

The cover may be included to both assist in the control of the address position of the golf club head when the sole is placed on the playing surface and to eliminate undesirable aesthetics of the flexure. In particular, the cover may be included to tune the visual face angle of the golf club head when the head is placed on the playing surface by altering the contact surface of the golf club head. The cover may be configured to wrap around a perimeter of the golf club head to the crown and may replace a portion of the material of the perimeter to create a lower density body structure to provide additional discretionary mass, a lower and/or deeper center of gravity location and a higher moment of inertia, thus improving performance and distance potential.

In effect, cover provides crown compliance and the flexure provides sole compliance. As a further alternative, the cover may be removed from the flexure so that it only provides compliance in portions of the golf club head that are away from the sole. In such an example, the dimensions of the components are preferably in the ranges described with regard to FIG. 11-13.

Figure 14:
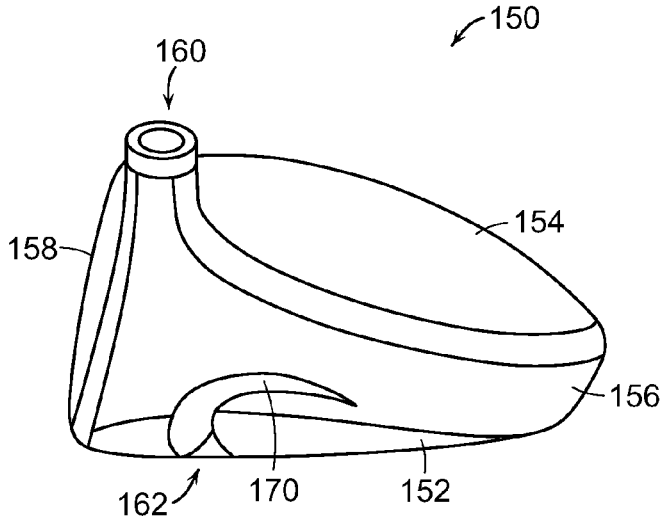
FIG. 14 is a side view of another embodiment of a golf club head of the present invention.
Figure 15:
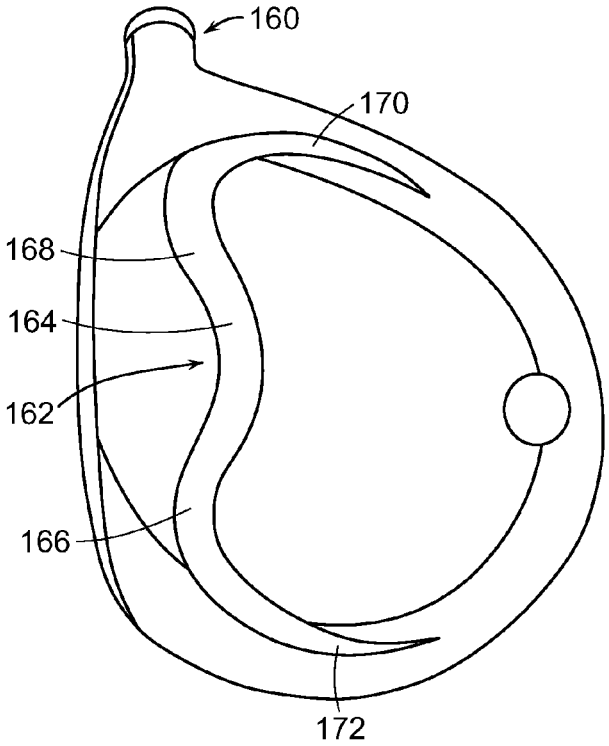
FIG. 15 is a bottom plan view of the golf club head of FIG. 14.

Referring now to FIGS. 14 and 15, a golf club head 150 including a flexure 162 having a varied spatial relationship to the face plane along its heel to toe length will be described. Due to the geometry of a golf club head face coupled with the circular shape of the stress imparted to the face during ball impact, the lower portion of the face generally experiences different magnitudes of stress at different heel-to-toe locations. Generally the portions of the golf club head at the heel and toe ends experience lower stresses than the portion of the golf club directly below the geometric center of the face and that stress gradient translates to the stress on the sole in the region of flexure 162. The distance of the flexure relative to the face plane and/or the leading edge of the face/sole intersection is altered to correspond to the relative amount of stress at the various portions. For example, the heel and toe portions of the flexure are preferably located closer to the face plane and leading edge of the golf club head so that those portions will be more likely to experience flexing even under the lower stress conditions, and especially during off-center ball impacts.

Golf club head 150 has a hollow body construction that is defined by a sole 152, a crown 154, a skirt 156, a face 158 and a hosel 160. Flexure 162 is formed in a forward portion of the golf club head and extends generally across the golf club head in a heel to toe direction through the sole and skirt. Flexure 162 generally includes a central portion 164, a toe portion 166 and a heel portion 168. As described above, the portions of flexure 162 are disposed at varied spatial relationships relative to the face plane so that central portion 164 is further aftward from the face plane compared to toe portion 166 and heel portion 168. Further, flexure 162 includes heel and toe extensions 170, 172 that extend from the heel and toe portions 168, 166, respectively along skirt 156 aftward. Heel and toe extensions 170, 172 may also extend aftward and meet at a location on the skirt or sole.

Figure 16:
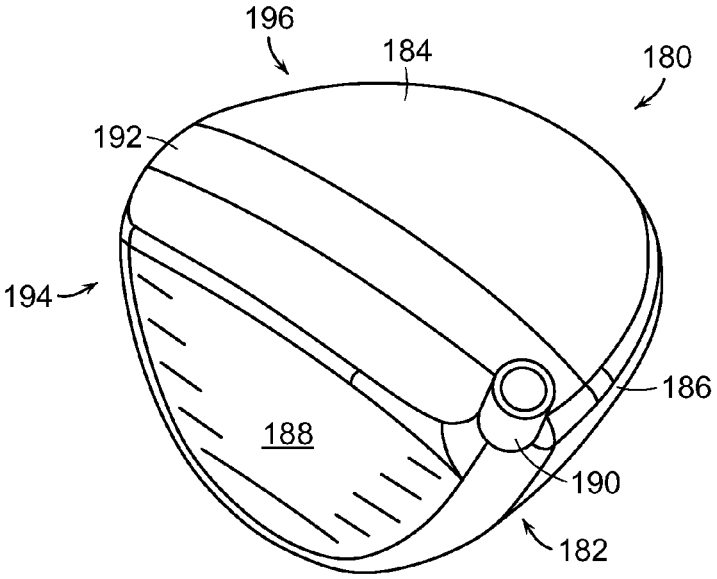
FIG. 16 is a perspective view of another embodiment of a golf club head of the present invention.
Figure 17:
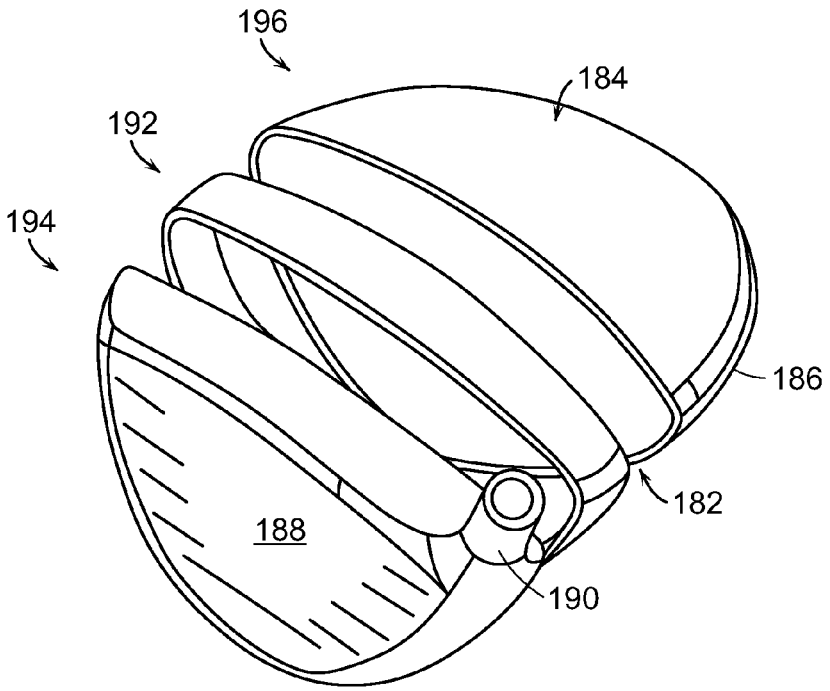
FIG. 17 is an exploded view of the golf club of FIG. 16.
Figure 18:
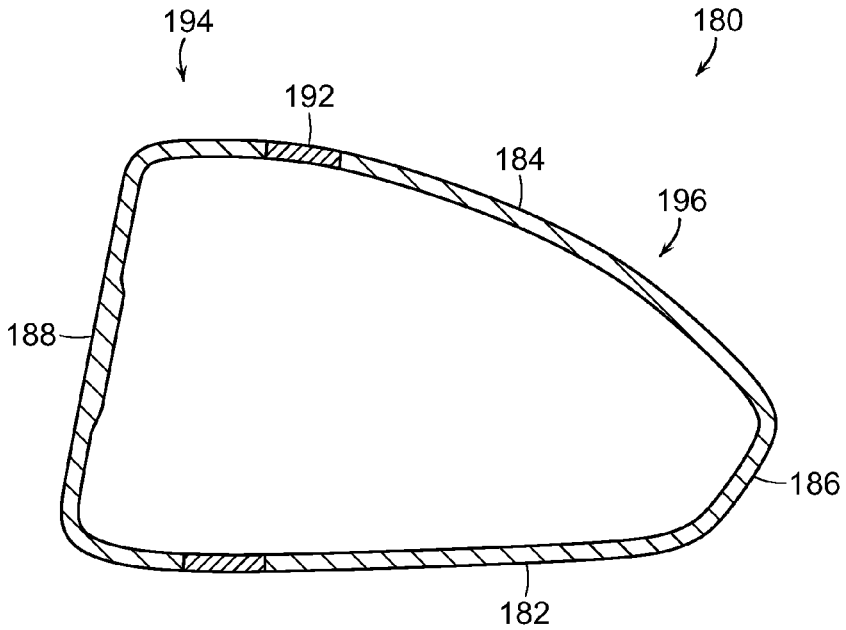
FIG. 18 is a cross-sectional view of the golf club of FIG. 16.

In additional embodiments, the flexure is provided primarily by a multi-material construction. Referring to FIGS. 16-18, a golf club head 180 generally has a hollow body construction that is defined by a sole 182, a crown 184, a skirt 186, a face 188 and a hosel 190, and includes a flexure 192. Flexure 192 is included in a forward portion of golf club head 180 and may be constructed as a tubular member, as shown, that is interposed between a face portion 194 and a rear body portion 196 so that it forms an intermediate ring. The ring has a selected stiffness to allow the face to deflect globally in concert with the deflection that occurs locally at the impact point. Similar to previous embodiments, flexure 192 is tuned so the impact imparts a frequency of vibration across the flexure that is about 2900 Hz to about 4000 Hz. The properties of the ring are selected as an additional means of controlling and optimizing the COR, and corresponding characteristic time (CT), values across the face, especially for ball impacts that are away from the ideal impact location.

Figure 19:
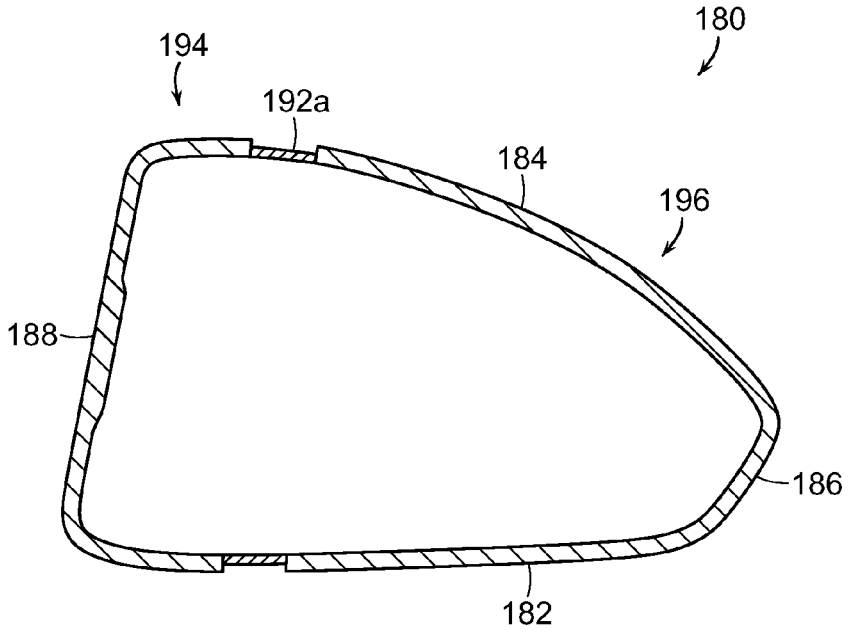
FIG. 19 is a cross-sectional view of an alternative construction of the golf club head of FIG. 16.

Flexure 192 is constructed of a material that provides a lower Young's Modulus than the adjacent portions of face portion 194 and rear body portion 196. Preferably, flexure 192, face portion 194, and rear body portion 196 are constructed from materials that can be easily coupled, such as by welding. For example, face portion 194 and rear body portion 196 are preferably constructed from a first titanium alloy and flexure 192 is constructed from a beta-titanium alloy as described in greater detail below. Flexure 192 may be constructed so that it has a thickness that is about equal to the thickness of the adjacent portions and so that the outer surface of flexure is flush with the outer surface of the adjacent portions, as shown in FIG. 18. Alternatively, as shown in FIG. 19, a flexure **192*a* may be constructed so that the thickness is different than the adjacent portions and so that the outer surface of flexure 192*a*** is recessed compared to the adjacent portions. As further alternatives, the flexure may be constructed so that the outer surface of the flexure is proud, or raised, compared to the adjacent portions.

Alternatively, a carbon composite ring may be incorporated for flexure 192 that provides a lower stiffness. The joint configuration, ring geometry (such as the ring width and thickness which may vary with the location in the ring), ring position, fiber orientation, resin type and percentage resin content are all parameters that are selected to optimize the flexibility of flexure 192 so that the outgoing ball speed is improved across the face of the driver while the durability of the golf club head is maintained. Preferably, a carbon composite flexure is bonded to an adjacent metallic face portion and an adjacent metallic rear body portion. As an example, the flexure may be a ring having a width in a range of about 12.0 mm to about 20.0 mm and a thickness of about 0.5 mm to about 3.0 mm and the thickness may vary depending on the location around the perimeter.

Figure 20:
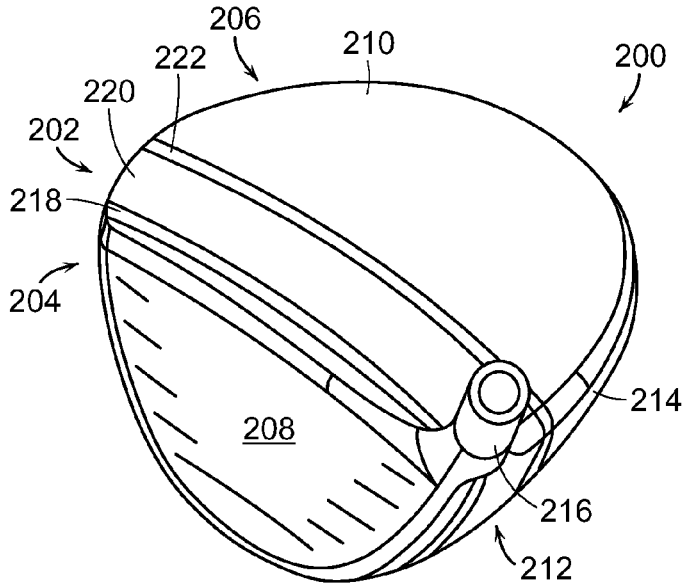
FIG. 20 is a perspective view of another embodiment of a golf club head of the present invention.
Figure 21:
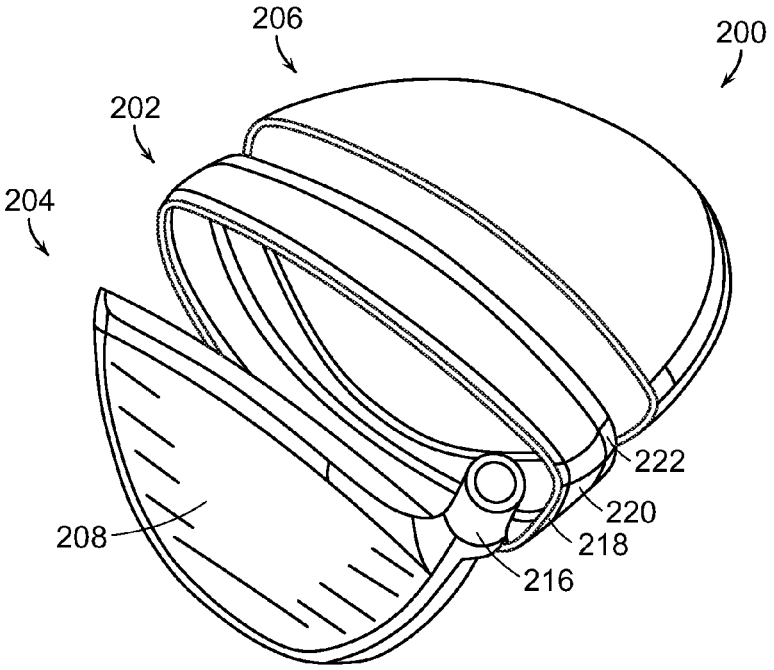
FIG. 21 is an exploded view of the golf club head of FIG. 20.

A multi-material flexure is incorporated into the golf club head of FIGS. 20 and 21. A golf club head 200 includes a flexure 202 that primarily relies upon the material properties to alter the stiffness, similar to flexure 192, but incorporates a multi-material construction. Golf club head 200 is generally constructed as a hollow body that is defined by a face portion 204, flexure 202 and rear body portion 206. When face portion 204, flexure 202 and rear body portion 206 are coupled, they generally form a face 208, a crown 210, a sole 212, a skirt 214 and a hosel 216.

Flexure 202 includes a front member 218, a central member 220, and an aft member 222. Preferably, the materials are chosen so that front member 218 and aft member 222 are easily coupled to face portion 204 and rear body portion 206 and so that central member 220 is thin and flexible enough to provide an extra vibration mode having a frequency in a range of about 2900 Hz to about 4000 Hz. In an embodiment, front member 218 and aft member 222 are metallic, and central member 220 is interposed between front member 218 and aft member 222 and is constructed of a carbon fiber composite. Preferably, aft member 222 is spaced from an interface between face 208 and front member 218 by at least 6.0 mm and more preferably, at least 12.0 mm. Hosel 216 may be constructed of metallic and/or non-metallic materials. In an embodiment, face portion 204 and rear body portion 206 are constructed of a titanium alloy, front member 218 and aft member 222 are constructed of a lower density, and preferably lower modulus, material than titanium, such as an aluminum or magnesium alloy, and central member 220 is constructed of a carbon fiber composite that is thin and flexible enough to provide the desired frequency response. Additionally, the front member and/or the aft member may be co-molded with the composite central member. Generally, the materials are selected to provide adequate bonding strength between the components using common practices, such as adhesive bonding.

Figure 22:
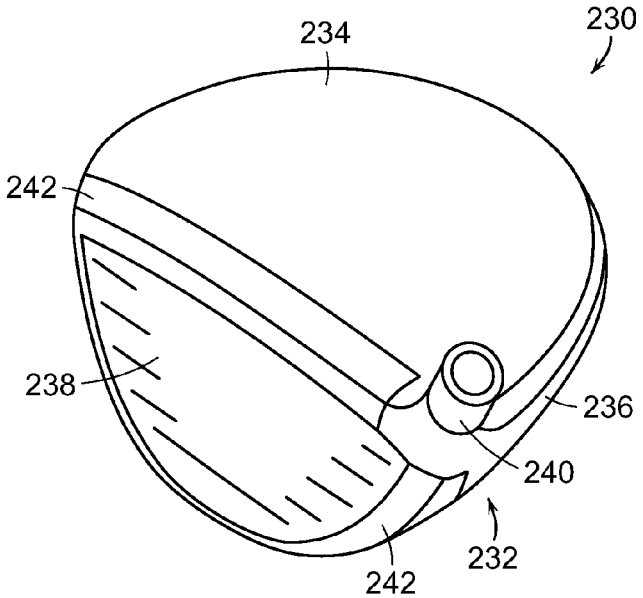
FIG. 22 is a cross-sectional view of an embodiment of a golf club head of the present invention.
Figure 23:
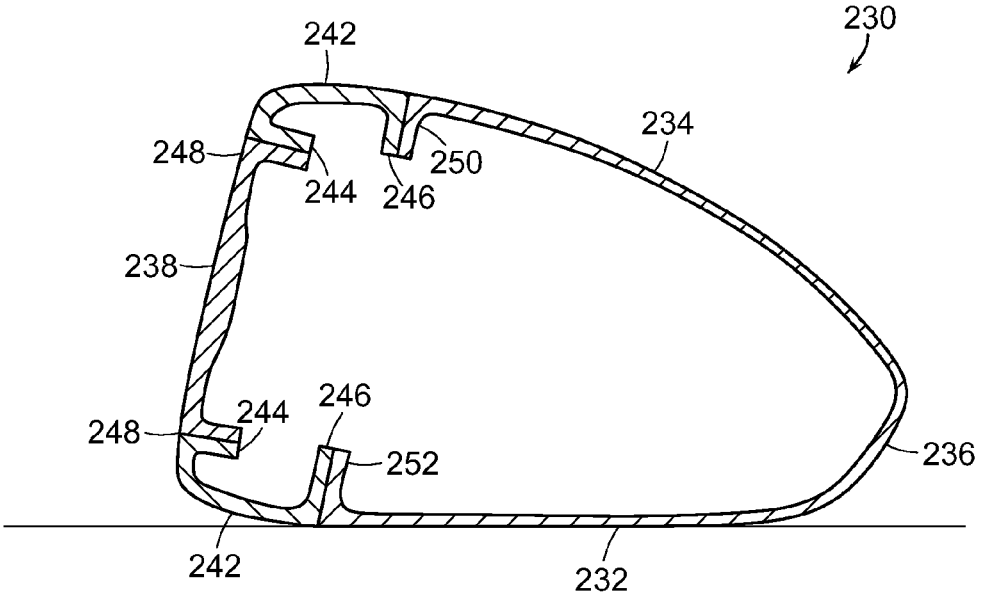
FIG. 23 is a perspective view of an embodiment of a golf club head of the present invention.

Golf club heads of the present invention may also include a flexure that extends across the interface between the rear portion of the golf club head and the face, as shown in FIGS. 22 and 23. A golf club head 230 generally has a hollow body construction that is defined by a sole 232, a crown 234, a skirt 236, a face 238 and a hosel 240, and includes a flexure 242. Flexure 242 is included in a forward portion of golf club head 230 and is interposed between face 238 and sole 232, crown 234 and skirt 236.

The flexure has a selected stiffness to allow the face to deflect globally in concert with the deflection that occurs locally at the impact point. Similar to previous embodiments, flexure 242 is tuned so impact imparts a frequency of vibration across the flexure that is about 2900 Hz to about 4000 Hz. The properties of the ring are selected as an additional means of controlling and optimizing the COR, and corresponding characteristic time (CT), values across the face, especially for ball impacts that are away from the ideal impact location.

Flexure 242 is located generally around the perimeter of face 238 and so that it extends across the transitional curvature from the face of golf club head 230 to the rear portion of the golf club head, e.g., sole 232, crown 234 and skirt 236. Flexure 242 may be discontinuous, as shown, so that it is interrupted by the hosel portion of the golf club head. Flexure 242 terminates at flanges that provide coupling features for mounting flexure 242 in golf club head 230. It should be appreciated that coupling features may be surfaces provided to form butt joints, lap joints, tongue and groove joints, etc. Flexure 242 includes a face flange 244 and a rear flange 246. Face flange 244 is coupled to a perimeter edge 248 of face 238. Portions of rear flange 246 are coupled to portions of perimeter edges of sole 232, crown 234 and skirt 236, such as by being coupled to a crown flange 250 and a sole flange 252. Preferably, the face and rear flanges are between about 2.0 mm and about 12.0 mm.

Flexure 242 is preferably constructed of a material that provides a lower Young's modulus than the adjacent portions of the golf club head. Preferably, flexure 242, face 238, and the rear portion of golf club head 230 are constructed from materials that can be easily coupled, such as by welding. For example, face 238 and the rear portion are preferably constructed from a first titanium alloy and flexure 242 is constructed from a beta-titanium alloy as described in greater detail below.

Alternatively, flexure 242 may be constructed from a carbon fiber composite ring that provides a lower stiffness. The joint configuration, ring geometry, ring position, fiber orientation, resin type and percentage resin content are all parameters that are selected to optimize the flexibility of flexure 242 so that the outgoing ball speed is improved across the face of the driver while the durability of the golf club head is maintained. Preferably, a carbon composite flexure is bonded to an adjacent metallic face and an adjacent metallic rear body portion.

Figure 24:
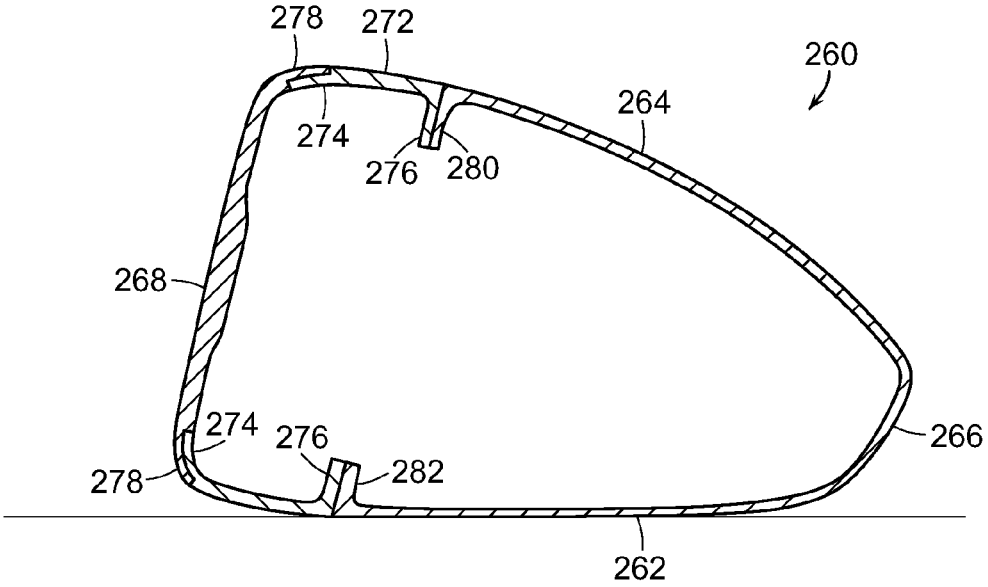
FIG. 24 is a cross-sectional view of an embodiment of a golf club head of the present invention.

In another embodiment, shown in FIG. 24, a flexure is coupled to a face member at the transition between the face and the rear portion of the golf club head. For example, a golf club head 260 generally has a hollow body construction that is defined by a sole 262, a crown 264, a skirt 266, a face 268, a hosel, and a flexure 272. Flexure 272 is included in a forward portion of golf club head 260 and is generally constructed as an annular member that is interposed between face 268, and sole 262, crown 264 and skirt 266.

Similar to previous embodiments, flexure 272 is tuned so impact imparts a frequency of vibration across the flexure that is about 2900 Hz to about 4000 Hz. Flexure 272 is located around the perimeter of face 268 and so that it extends across the transitional curvature from the face of golf club head 260 to the rear portion of the golf club head, e.g., sole 262, crown 264 and skirt 266. Flexure 272 terminates at flanges that provide examples of coupling features for mounting flexure 272 in golf club head 260. In particular, flexure 272 includes a face flange 274 and a rear flange 276. Face flange 274 is coupled to a perimeter flange 278 of face 268. Portions of rear flange 276 are coupled to portions of perimeter edges of sole 262, crown 264 and skirt 266, such as by being coupled to a crown flange 280 and a sole flange 282.

Flexure 272 is preferably constructed of a material that provides a lower Young's modulus than the adjacent portions of the golf club head. Preferably, flexure 272, face 268, and the rear portion of golf club head 260 are constructed from materials that can be easily coupled, such as by welding. For example, face 268 and the rear portion are preferably constructed from a first titanium alloy and flexure 272 is constructed from a beta-titanium alloy as described in greater detail below.

Figure 25:
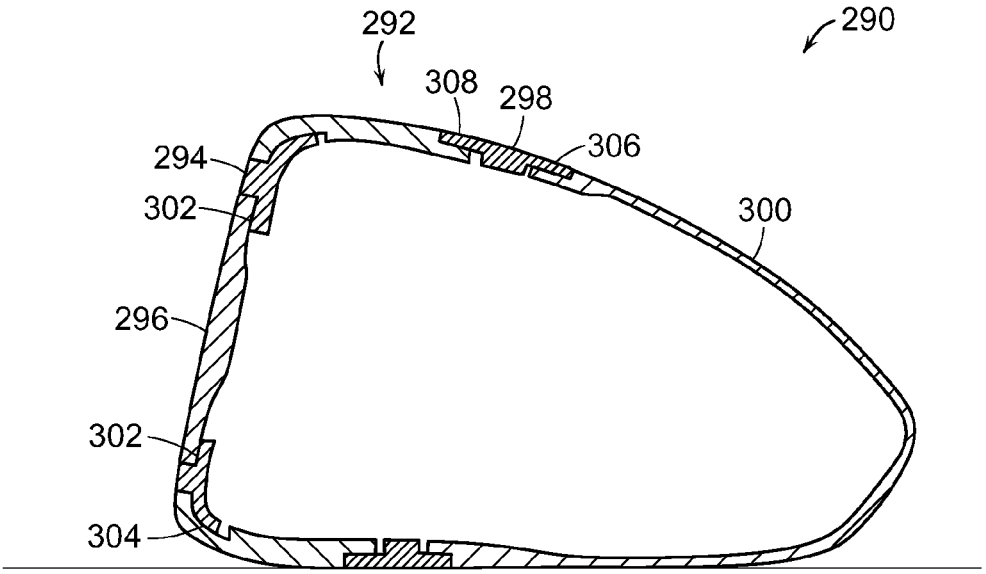
FIG. 25 is a cross-sectional view of an embodiment of a golf club head of the present invention.

In another embodiment, shown in FIG. 25, a golf club head 290 includes interface members that are included that are used to couple a flexure 292 to adjacent portions of golf club head 290. A front interface member 294 is interposed between flexure 292 and a face member 296. Similarly, an aft interface member 298 is interposed between flexure 292 and an aft body member 300.

In the present embodiment, front interface member 294 and aft interface member 298 are both constructed as annular members that are interposed between the adjacent components. Front interface member 294 includes a face flange 302 that is coupled to face member 296 with a lap joint, and a flexure flange 304 that is coupled to flexure 292 with a lap joint. A portion of front interface member 294 is exposed and forms a portion of the front surface of golf club head 290. Interface member 294 spaces a forward edge of flexure 292 from a perimeter edge of face member 296. Aft interface member 298 includes a rear body flange 306 that is coupled to aft body member 300 and a flexure flange 308 that is coupled to flexure 292. Aft interface member 298 space aft body member 300 and flexure 292.

Golf club head 290 has a multi-material construction. In an example, aft body member 300 and face member 296 are constructed of titanium alloys, and may be constructed of the same titanium alloy, such as Ti6-4. Front interface member 294 and aft interface member 298 are constructed of a material selected to be coupled to the materials of face member 296, flexure 292 and aft body member 300. In an example, the interface members are constructed of an aluminum alloy and flexure is constructed from a carbon fiber composite. It should further be appreciated, that the interface member 298 need not be constructed with a constant cross-sectional shape.

Figure 26:
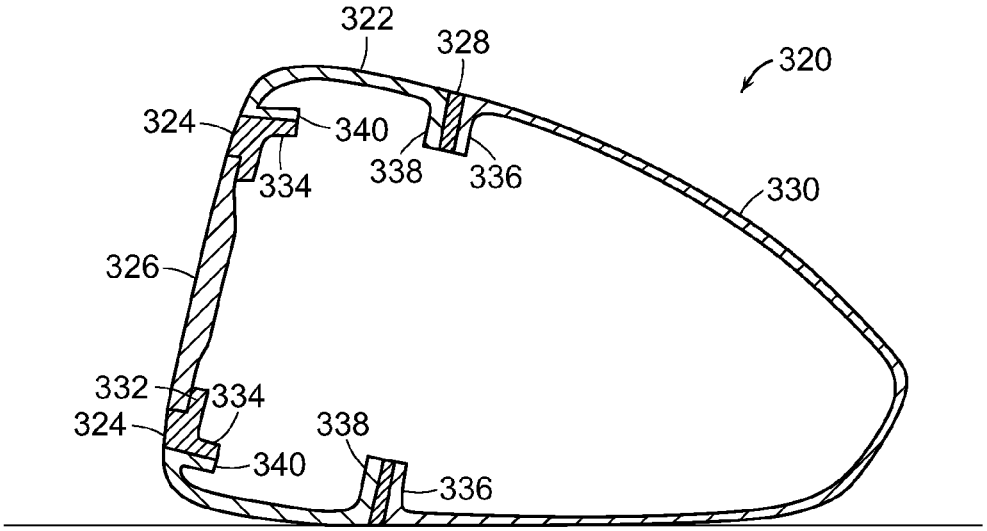
FIG. 26 is a cross-sectional view of an embodiment of a golf club head of the present invention.

A golf club head 320, shown in FIG. 26, includes interface members that are used to couple a flexure 322 to adjacent portions of golf club head 320. A front interface member 324 is interposed between flexure 322 and a face member 326. Similarly, an aft interface member 328 is interposed between flexure 322 and an aft body member 330.

Front interface member 324 and aft interface member 328 are both constructed as annular members that are interposed between the adjacent components. Front interface member 324 includes a face flange 332 that is coupled to face member 326 with a lap joint. Front interface member 324 also includes a flexure flange 334 that is coupled to a front flange 340 of flexure 322. A portion of front interface member 324 is exposed and forms a portion of the front surface of golf club head 320. Interface member 324 spaces a forward edge of flexure 322 from a perimeter edge of face member 326. Aft interface member 328 includes a rear body flange 336 that is coupled to aft body member 330 and a flexure flange 338 that is coupled to flexure 322. Aft interface member 328 spaces aft body member 330 and flexure 322.

Golf club head 320 has a multi-material construction. In an example, aft body member 330 and face member 326 are constructed of titanium alloys, and may be constructed of the same titanium alloy, such as Ti6-4. Front interface member 324 and aft interface member 328 are constructed of a material selected to be coupled to the materials of face member 326, flexure 322 and aft body member 330. In an example, the interface members are constructed of an aluminum alloy and flexure is constructed from a carbon fiber composite.

Figure 27:
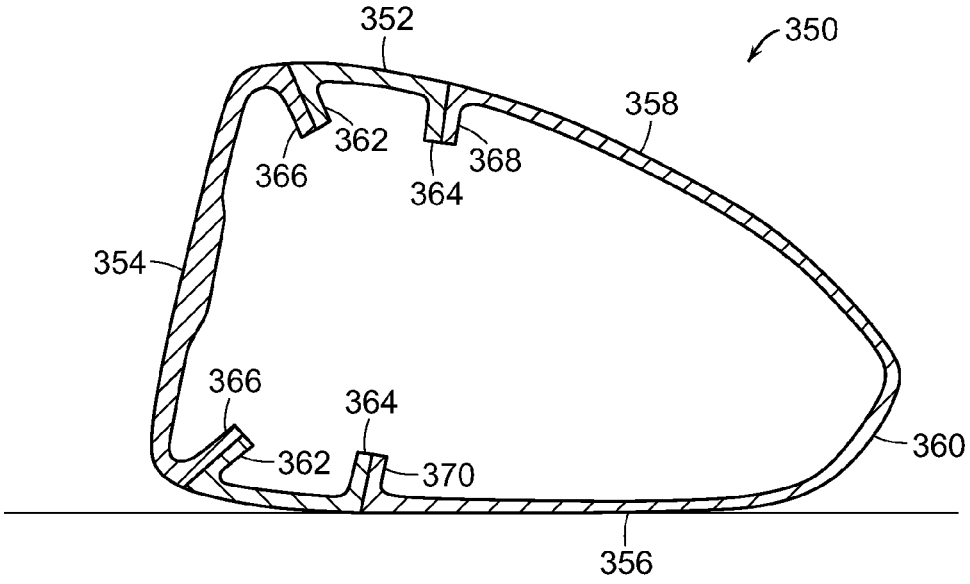
FIG. 27 is a cross-sectional view of an embodiment of a golf club head of the present invention.

Referring to FIG. 27, a golf club head 350 includes a flexure 352 that is spaced from the transition between the rear portion of the golf club and a face 354. Generally, golf club head 350 has a hollow body construction that is defined by a sole 356, a crown 358, a skirt 360, face 354, a hosel, and flexure 352.

Flexure 352 is interposed between face 354 and a rear portion of golf club head 350. Flexure 352 is generally an annular member that has a U-shaped cross-sectional shape so that it includes a forward flange 362 and an aft flange 364. Forward flange 362 is coupled to a face flange 366 of face 354, and aft flange 364 is coupled to a flange of the rear portion of the golf club that includes a crown flange 368 and a sole flange 370.

Figure 28:
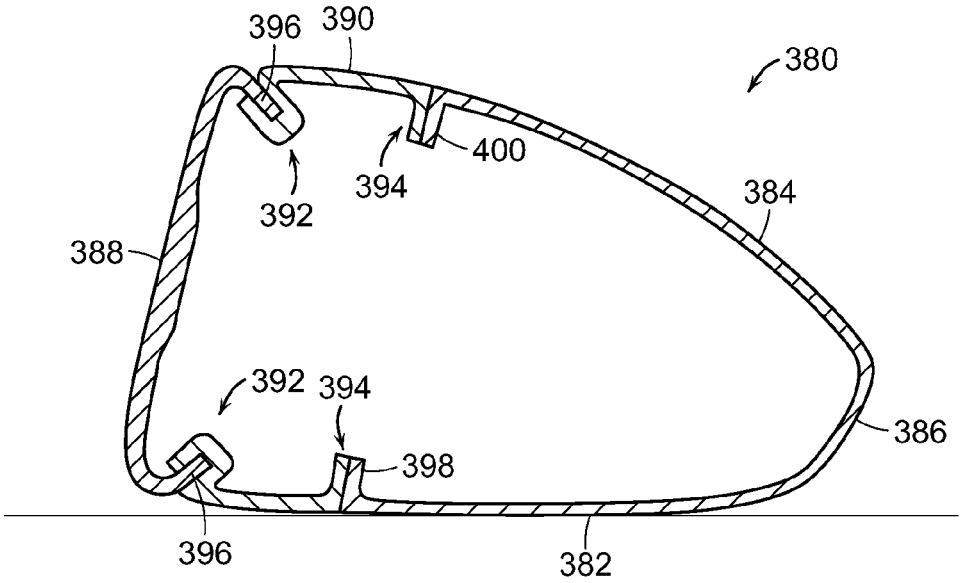
FIG. 28 is a cross-sectional view of an embodiment of a golf club head of the present invention.
Figure 29:
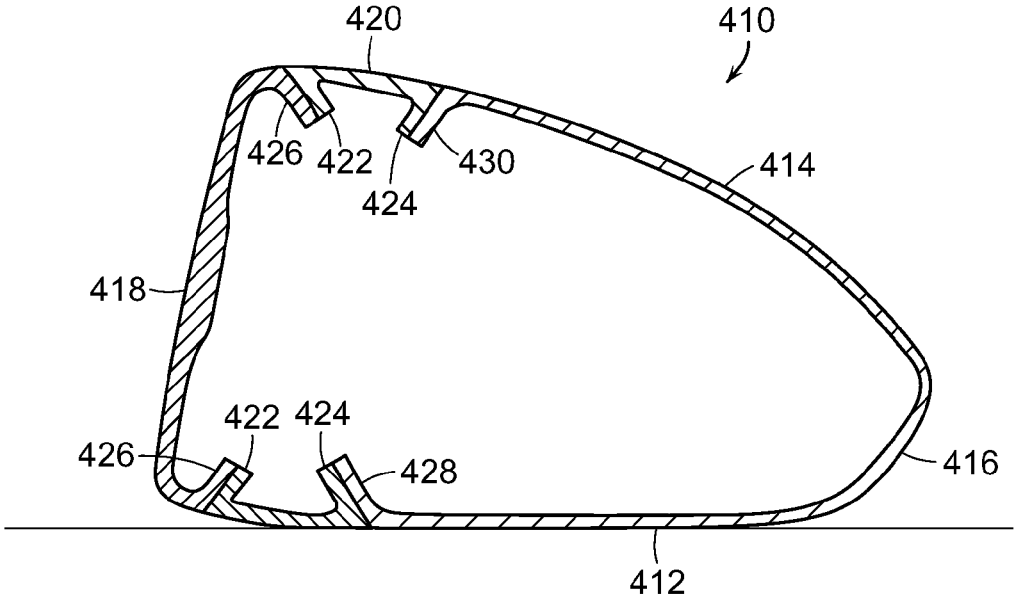
FIG. 29 is a cross-sectional view of an embodiment of a golf club head of the present invention.
Figure 30:
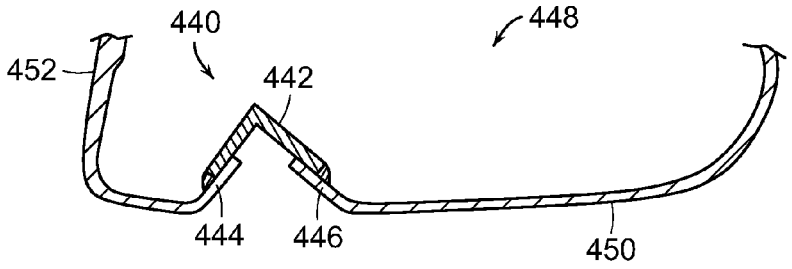
FIG. 30 is a cross-sectional view of a portion of an embodiment of a golf club head of the present invention.

Embodiments are illustrated in FIGS. 28 and 29 that are similar to that of FIG. 27, but include alternative flange configurations. As shown in FIG. 28, a golf club head 380 has a hollow body construction that is defined by a sole 382, a crown 384, a skirt 386, face 388, a hosel, and flexure 390. Flexure 390 is interposed between face 388 and the rear portion of the golf club head that includes sole 382 and crown 384. Flexure 390 is a generally annular member that includes a forward coupling portion 392 and an aft flange 394. Forward coupling portion 392 is a portion of flexure 390 that wraps around and is coupled to a face flange 396, so that it receives at least a portion of face flange 396. Portions of aft flange 394 abut and are coupled to a sole flange 398 and a crown flange 400.

As shown in FIG. 29, a golf club head 410 has a hollow body construction that is defined by a sole 412, a crown 414, a skirt 416, face 418, a hosel, and flexure 420. Flexure 420 is interposed between face 418 and the rear portion of the golf club head that includes sole 412 and crown 414. Flexure 420 is a generally annular member that includes a forward flange 422 and an aft flange 424. Forward flange 422 abuts, and is coupled to, a face flange 426. Portions of aft flange 424 abut and are coupled to a sole flange 428 and a crown flange 430.

The configuration of the flexure of each of the embodiments may be selected from many different alternatives to provide a tuned behavior during impact with a golf ball. FIGS. 30-34 illustrate various alternative multi-piece constructions of a flexure. In particular, the illustrated flexures include flexure components that have various alternative geometries. For example, a flexure 440 of FIG. 30, includes an angular cross-sectional shape that includes a flexure component 442 that is generally formed as an L-shaped member. Flexure component 442 is coupled to a forward flange 444 and an aft flange 446 of a golf club body 448. As shown, forward flange 444 and aft flange 446 are convergent flanges that are angled toward each other. Forward flange 444 and aft flange 446 are integrated into a sole 450 of golf club head body 448 generally in a location near a face 452 of the golf club head. As mentioned previously, flexure 440 is preferably located within about 20 mm of the ball-striking surface of face 452, and more preferably between about 5.0 mm and about 20.0 mm. Flexure component 442 may be coupled to forward flange 444 and aft flange 446 by any mechanical coupling process, such as welding, brazing, mechanical fasteners, diffusion bonding, liquid interface diffusion bonding, super plastic forming and diffusion bonding, and/or using an adhesive. A construction that allows for access to the internal cavity of the golf club head during manufacture, such as a crown pull construction or a face pull construction, so that the coupling process may be easily accomplished.

Figure 31:
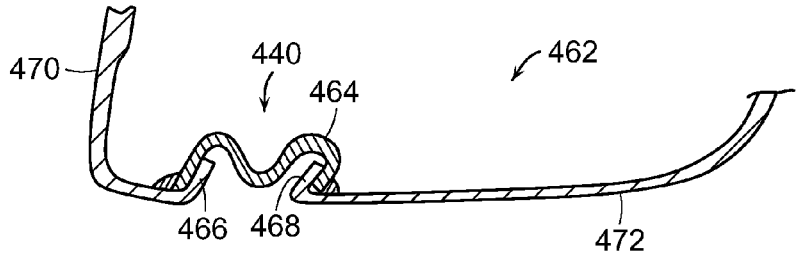
FIG. 31 is a cross-sectional view of a portion of an embodiment of a golf club head of the present invention.

In another embodiment, shown in FIG. 31, a flexure 460 that has a wavy, or corrugated, cross-sectional shape is included in a golf club head 462. Flexure 460 is constructed from a flexure component 464 that is coupled to a forward flange 466 and an aft flange 468 of golf club head 462. Forward flange 466 and aft flange 468 are integrated into a sole 472 of golf club head body 462 generally in a location near a face 470 of the golf club head. As mentioned previously, flexure 460 is preferably located within about 20 mm of the ball-striking surface of face 470, and more preferably between about 5.0 mm and about 20.0 mm. Flexure component 464 may be coupled to forward flange 466 and aft flange 468 by any mechanical coupling process, such as welding, brazing, mechanical fasteners and/or using an adhesive.

Figure 32:
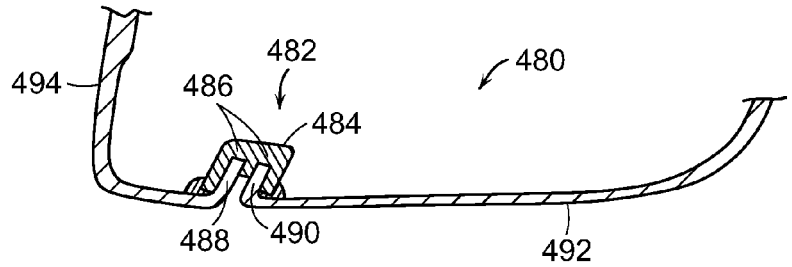
FIG. 32 is a cross-sectional view of a portion of an embodiment of a golf club head of the present invention.

In additional embodiments, a flexure is formed from flanges and a generally channel-shaped flexure component. Referring to FIG. 32, a golf club head 480 includes a flexure 482 that is formed by a flexure component 484 that is coupled to flanges of a sole 492 of golf club head 480, such as by welding, brazing and/or an adhesive. Flexure 482 is preferably located within about 20 mm of the ball-striking surface of a face 494, and more preferably between about 5.0 mm and about 20.0 mm. In particular, flexure component 484 is a generally channel-shaped member that includes recesses 486 that receive portions of a forward flange 488 and an aft flange 490. Recesses 486 are spaced by a portion of flexure component 484 that is selected to provide a desired spacing between forward flange 488 and aft flange 490.

Figure 33:
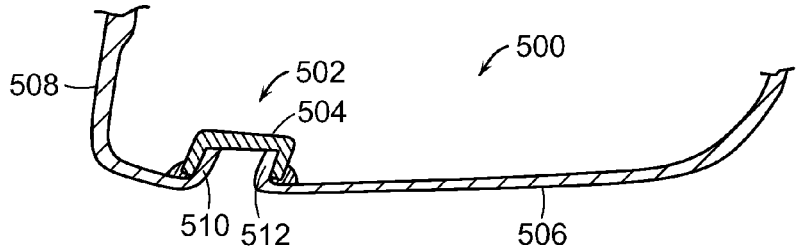
FIG. 33 is a cross-sectional view of a portion of an embodiment of a golf club head of the present invention.

In a similar embodiment, illustrated in FIG. 33, a golf club head 500 includes a flexure 502 that is formed by a flexure component 504 that has a channel-shaped cross section. Flexure component 504 is coupled to flanges formed on a sole 506 of golf club head 500, such as by welding, brazing and/or an adhesive. Flexure 502 is preferably located within about 20 mm of the ball-striking surface of a face 508, and more preferably between about 5.0 mm and about 20.0 mm. In particular, flexure component 504 is a generally channel-shaped member that defines a slot that receives portions of a forward flange 510 and an aft flange 512.

Figure 34:
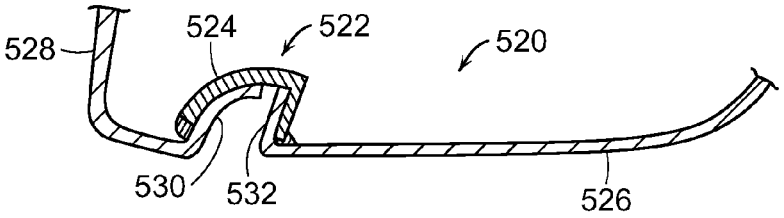
FIG. 34 is a cross-sectional view of a portion of an embodiment of a golf club head of the present invention.

In another embodiment, illustrated in FIG. 34, a golf club head 520 includes a flexure 522 that is formed by a flexure component 524 that has a channel-shaped cross section. Flexure component 524 is constructed having a generally sharktooth-shaped cross section, and in particular includes a first curved portion and a generally planar portion that meet at an apex. Flexure component 524 is coupled to flanges formed on a sole 526 of golf club head 520, such as by welding, brazing and/or an adhesive. Flexure 522 is preferably located within about 20 mm of the ball-striking surface of a face 528, and more preferably between about 5.0 mm and about 20.0 mm. In particular, flexure component 524 is a generally channel-shaped member that defines a slot that receives portions of a forward flange 530 and an aft flange 532.

Figure 35:
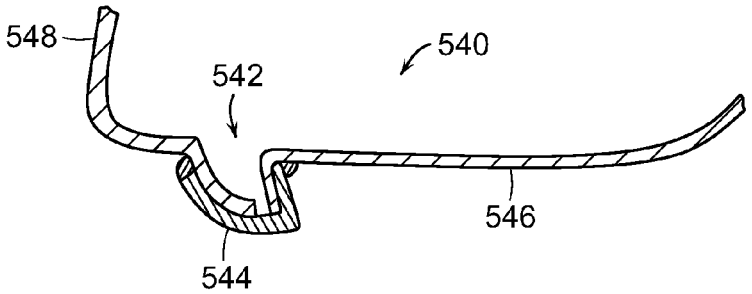
FIG. 35 is a cross-sectional view of a portion of an embodiment of a golf club head of the present invention.

Referring to FIG. 35, another embodiment of a golf club head 540 includes a flexure 542 that is similar in shape to the embodiment illustrated in FIG. 34, but flexure 542 extends outward from a sole 546 of the golf club head. Flexure 542 is formed by a flexure component 544 that has a cross section that forms a channel. Flexure component 544 is constructed having a generally sharktooth-shaped cross-sectional shape, and in particular includes a first curved portion and a generally planar portion that meet at an apex. Flexure component 544 is coupled to flanges formed on sole 546 of golf club head 540, such as by welding, brazing and/or an adhesive. Flexure 542 is preferably located within about 20.0 mm of the ball-striking surface of a face 548, and more preferably between about 5.0 mm and about 20.0 mm.

Figure 36:
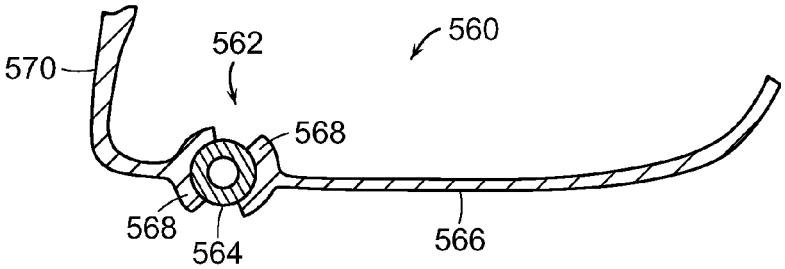
FIG. 36 is a cross-sectional view of a portion of an embodiment of a golf club head of the present invention.

In another embodiment, illustrated in FIG. 36, a golf club head 560 includes a flexure 562. Flexure 562 is formed by a flexure component 564 that has a generally tubular cross-section. Flexure component 564 is constructed having a generally tubular cross-sectional shape, and although it is illustrated as having an annular cross-sectional shape, it should be appreciated that it may have any cross-sectional shape. Flexure component 564 is coupled to flanges 568 formed on sole 566 of golf club head 560, such as by welding, brazing and/or an adhesive. Flexure component 564 has an exterior shape that complements flanges 568 and provides a coupling surface so that flexure component 564 may be coupled to flanges 568. Flexure 562 is preferably located within about 20.0 mm of the ball-striking surface of a face 570, and more preferably between about 5.0 mm and about 20.0 mm.

Figure 37:
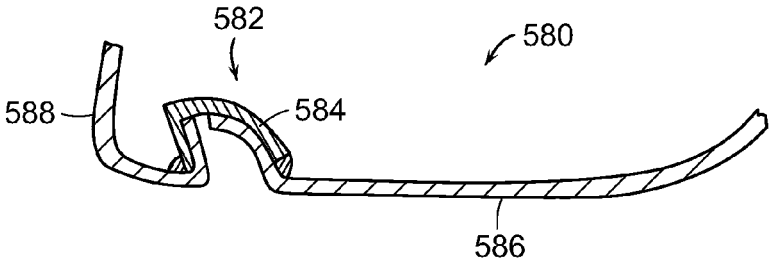
FIG. 37 is a cross-sectional view of a portion of another embodiment of a golf club head of the present invention.

Referring to FIG. 37, in an additional embodiment, a golf club head 580 includes a flexure 582. Flexure 582 is similar in shape to the embodiment illustrated in FIG. 34, but flexure 582 is oriented so that the generally sharktooth-shaped cross-section is reversed. In particular, the curved portion of flexure 582 is further rearward than in other illustrated embodiments. As shown, flexure 582 is formed by a flexure component 584 that has a cross section that forms a channel, but it should be appreciated that flexure 582 may be formed as a monolithic structure with a sole 586 of golf club head 580. By altering the orientation of the flexure relative to the remainder of the golf club head, the stress exerted on the flexure is applied in an alternative direction and the behavior of the flexure is different so that the flexure is effectively stiffer. As a result, the flexure may be tuned for the golf club head by altering the orientation. Flexure component 584 is coupled to flanges formed on sole 586 of golf club head 580, such as by welding, brazing and/or an adhesive. Flexure 582 is preferably located within about 20.0 mm of the ball-striking surface of a face 588, and more preferably between about 5.0 mm and about 20.0 mm, and has a thickness that is preferably between about 0.35 mm and 2.0 mm.

Figure 38:
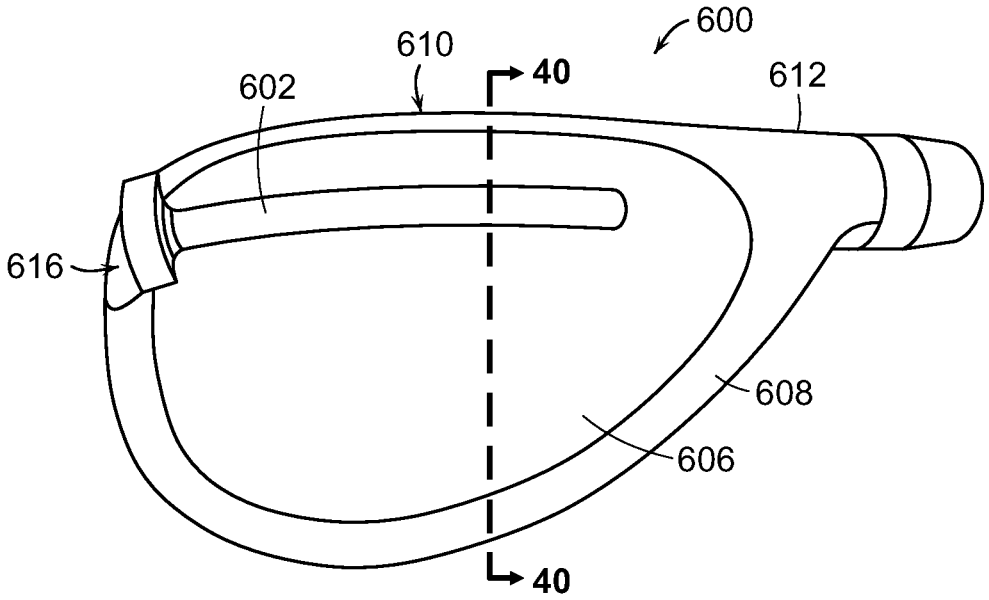
FIG. 38 is a bottom view of another embodiment of a golf club head of the present invention.
Figure 39:
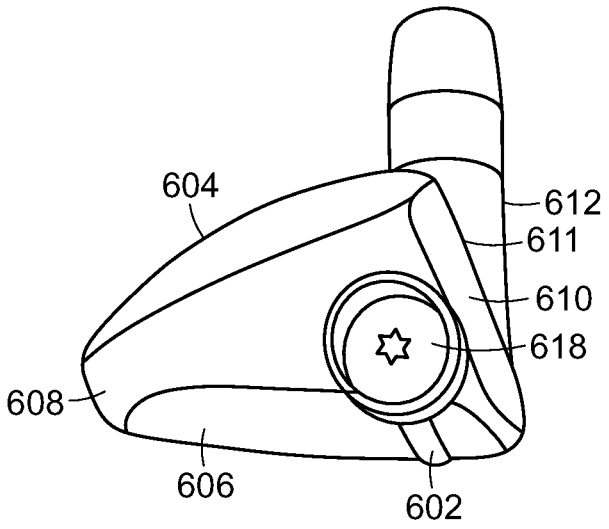
FIG. 39 is a side view of the golf club head of FIG. 38.
Figure 40:
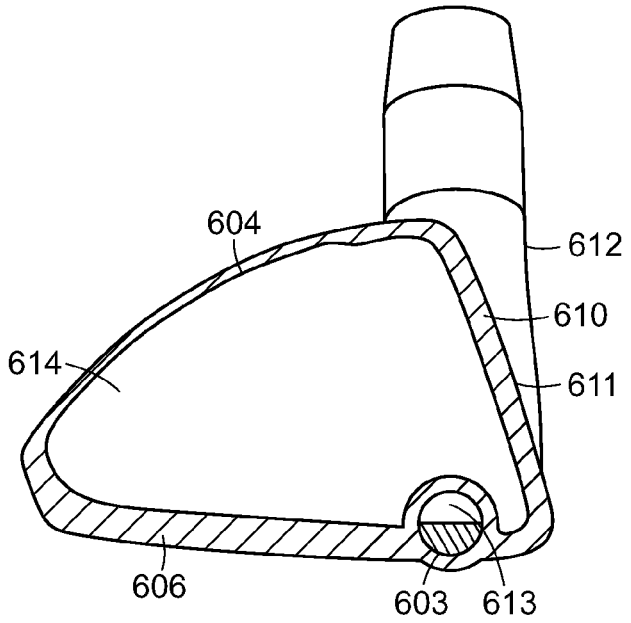
FIG. 40 is a cross-sectional view of the golf club head of FIG. 38, taken along line 40-40.

Referring to FIGS. 38-40, a golf club head 600 includes an elongate cavity that provides a flexure 602 that may be tuned to provide a desired compliance. For example, the golf club head includes a compliant tube that may be filled, or partially filled, with a compliant material, to adjust sound, feel and compliance, or left empty. Golf club head 600 includes a crown 604, a sole 606, a skirt 608, a face 610 that defines a ball-striking surface 611, and a hosel 612 that combine to form hollow-bodied golf club head construction that defines an interior cavity 614. Flexure 602 is an elongate tubular structure that extends generally in a heel-to-toe direction, and defines a flexure cavity 613. In an embodiment, flexure 602 extends across golf club head 600 so that it intersects a vertical, fore-aft plane extending through the geometric center of the face of golf club head 600 when the golf club head is in the address position.

An aperture 616 is included that provides access to the interior of flexure 602 and may be closed with a cover 618 that is preferably removeably coupled to flexure 602 in aperture 616. As an example, aperture 616 may be threaded and cover 618 is threaded into aperture 616 and includes a tool engagement feature that allows cover 618 to be installed and removed.

As a further alternative, flexure 602 may be completely or partially filled with an insert 603, such as a high density elastomeric insert. For example, an elastomeric material that is infused with a high density material, such as Tungsten, to create a high density flexible insert with is inserted into the tubular flexure, or into one of the other embodiments described herein including open slots, behind the face. The insert may be used to fill, or partially fill, the flexure to alter the acoustic behavior of the golf club head. A plurality of inserts constructed from materials with different densities and/or having different weight distributions may be provided to create inserts that fit into the flexure with different masses and weight distributions so that the final weight and mass distribution of the golf club head may be selected. Further, the flexure may include an opening that extends into the interior cavity and the insert may be used to plug the opening so that the interior cavity is not exposed to the environment so debris and water are not able to enter the interior cavity. Exemplary suitable materials include polyurethane, rubber, thermoset polymers, thermoplastic polymers, epoxy, foam, and neoprene. The selected material has a hardness that is selected to combine with the flexure to provide a combined flexibility. Preferably, the selected material has a hardness generally in a Durometer A range of 30-95 or a Durometer D range of 45-85.

Figure 41:
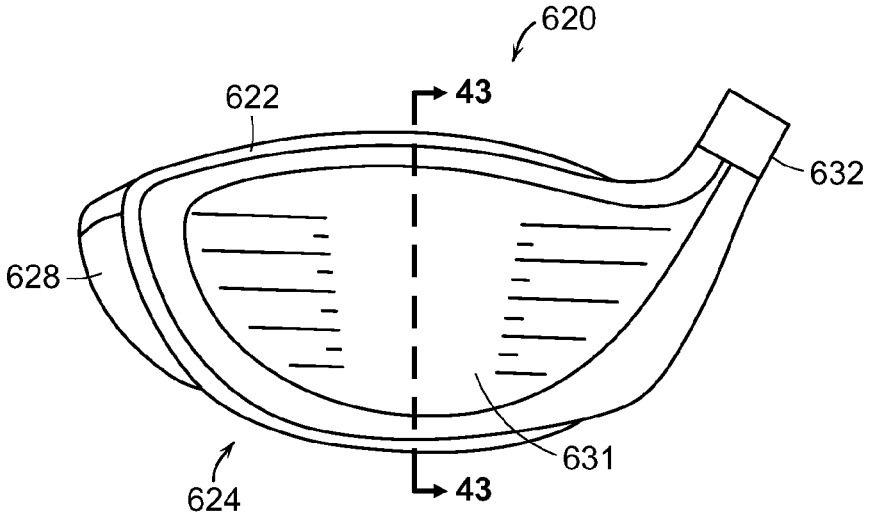
FIG. 41 is a front view of an embodiment of a golf club head of the present invention.
Figure 42:
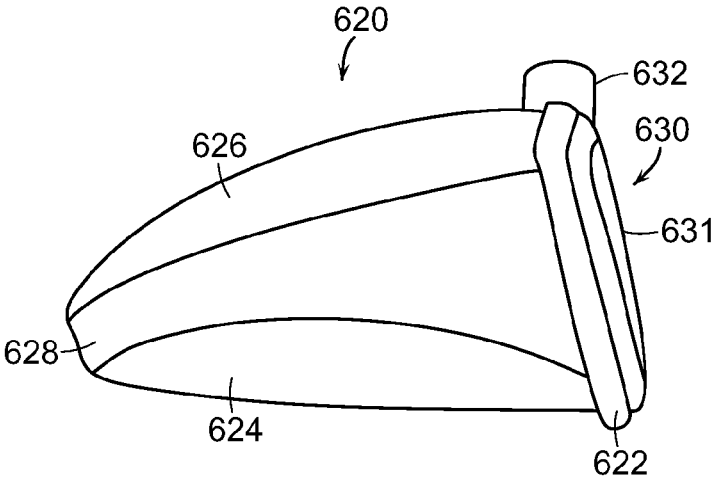
FIG. 42 is a side view of the golf club head of FIG. 41.
Figure 43:
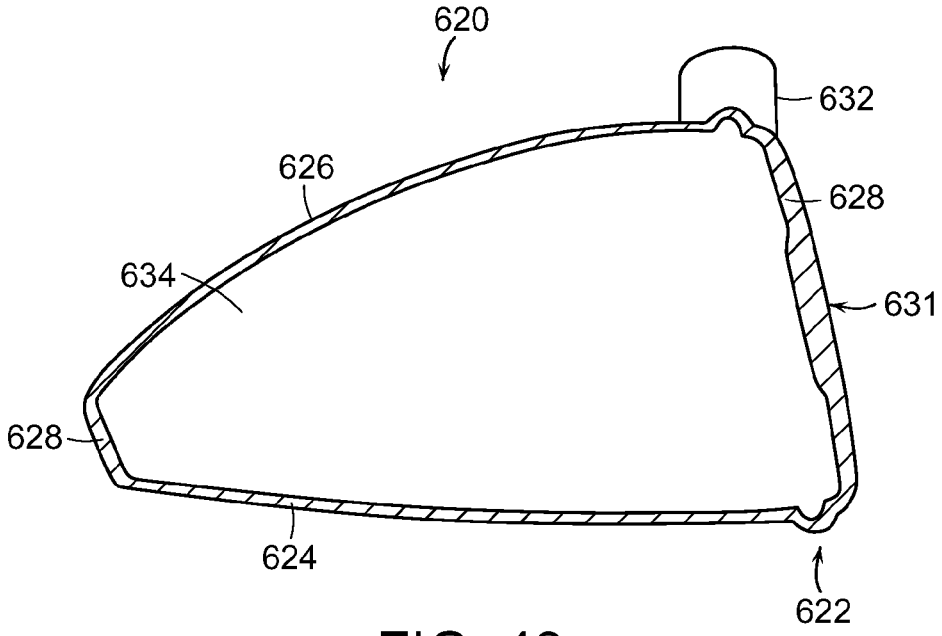
FIG. 43 is a cross-sectional view of the golf club head of FIG. 41, taken along line 41-41.

Referring to FIGS. 41-43, another embodiment of a golf club head 620 including a flexure 622 that extends outward from a sole 624 of the golf club head will be described. Golf club head 620 is constructed with a crown 626, sole 624, a skirt 628, a face 630 that defines a ball-striking surface 631, and a hosel 632 that combine to form a hollow-body construction and to define an interior cavity 634. In the present embodiment, flexure 622 extends across sole 624, across skirt 628, and across crown 626 continuously so that it wraps over the toe portion of skirt 628 of golf club head 620.

Figure 44:
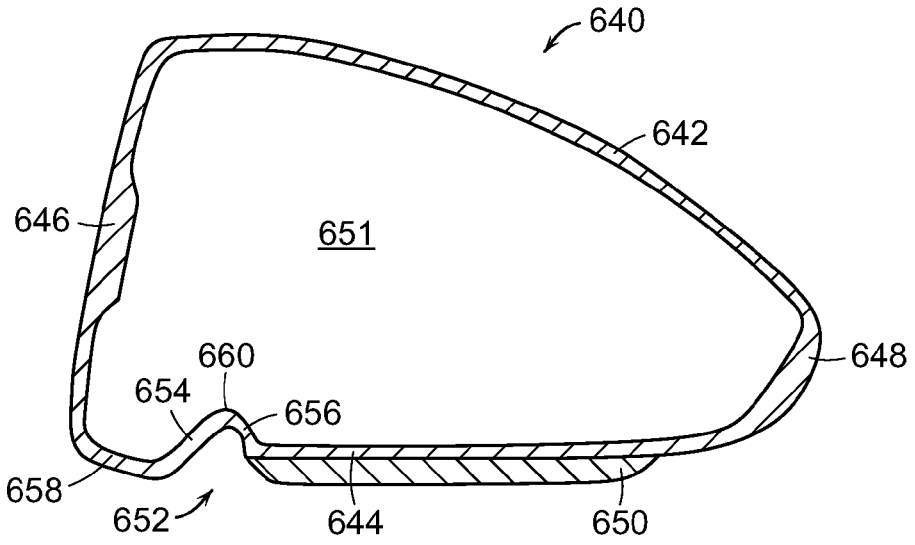
FIG. 44 is a cross-sectional view of a portion of an embodiment of a golf club head of the present invention.

In additional embodiments, a sole plate is integrated into the golf club head and is at least partially integrated into a flexure. As illustrated in FIG. 44, a golf club head 640 includes a crown 642, a sole 644, a face 646, a skirt 648 and a sole plate 650 that combine to form a hollow body defining an inner cavity 651. Sole 644 and sole plate 650 combine to form a flexure 652. Flexure 652 is a channel-shaped feature that extends in a generally heel-to-toe direction and is formed from a first member 654, a second member 656, and sole plate 650. First member 654 is coupled to a rearward edge of a forward transmittal portion 658 of sole 644 and curves into inner cavity 651 from sole 644. Second member 656 is coupled to a forward edge of a rearward portion of sole 644 and also curves into inner cavity 651 from sole 644. The ends of first member 654 and second member 656 that are spaced away from sole 644 are coupled to each other at an apex 660. A second, lower, end of second member 656 is joined with a forward portion of sole plate 650 to complete the rear portion of flexure 652 that extends from apex 660 to a lower, outer sole surface of golf club head 640, so that the depth of flexure 652 is greater than the thickness of sole plate 650.

In fairway wood or hybrid embodiments, which are generally constructed to provide a ground-contacting surface, sole 644 has a generally stepped configuration so that only the forward transmittal portion 658 of sole 644 provides a ground surface contacting surface, and the remainder of the ground contacting surface is provided by a lower surface of sole plate 650. Preferably, the flexure is elongate and extends in a generally heel to toe direction.

Additionally, in this embodiment and following examples, the material of the sole plate is selected to provide a desired mass distribution in the golf club head, and the material may have a higher or lower density than the remainder of the body material. For example, because the sole plate is generally integral with a flexure that is relatively close to the face of the golf club head, it may be beneficial to utilize a high density material for fairway and hybrid embodiments to maintain the center of gravity of the golf club head low, while a lower density material may be beneficial in driver embodiments so that material mass that would otherwise be dedicated to the sole structure may be distributed to the perimeter of the golf club head. The sole plate material is preferably selected from aluminum, titanium, magnesium, zirconium, steel, tungsten, and the sole plate may be coupled to the golf club head body by fasteners, brazing, welding, adhesives or any other suitable attachment method. In an example, a fairway wood may be constructed using titanium for the majority of the body while a steel or tungsten sole plate is brazed to the titanium body.

Figure 45:
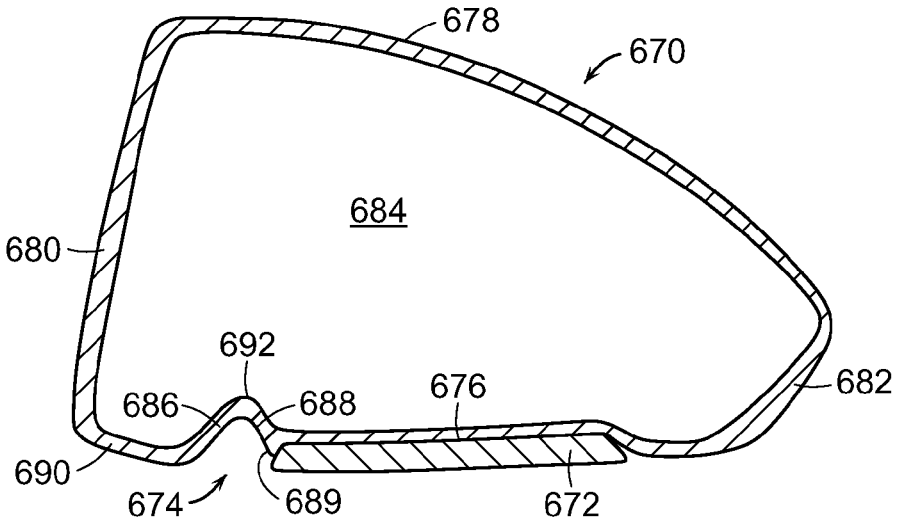
FIG. 45 is a cross-sectional view of a portion of an embodiment of a golf club head of the present invention.

In another embodiment, shown in FIG. 45, a golf club head 670 is constructed similar to that of FIG. 44 so that it includes a sole plate 672 that forms a portion of a flexure 674, but in the present embodiment, sole plate 672 is received in a recessed portion of a sole 676 of golf club head 670. Golf club head 670 is generally hollow and is constructed from a crown 678, sole 676, a face 680, a skirt 682 and sole plate 672 that combine to form a hollow body defining an inner cavity 684.

Flexure 674 is generally formed from a first member 686, a second member 688, and sole plate 672. First member 686 is coupled to a rearward edge of a forward transmittal portion 690 of sole 676 and curves into inner cavity 684 from sole 676. Second member 688 is coupled to a forward edge of a rearward portion of sole 676 and also curves into inner cavity 684 from sole 676. The ends of first member 686 and second member 688 that are spaced away from sole 676 are coupled to each other at an apex 692. A second, lower, end of second member 688 is joined with a forward portion of sole plate 672 to complete the rear portion of flexure 674 that extends from apex 692 to a lower, outer sole surface of golf club head 670.

Sole 676 and second member 688 combine to form a recess in the lower wall of golf club head 670 that receives sole plate 672. In particular the lower end of second member 688 extends below the junction between second member 688 and sole 676 to form a shoulder, such as tab 689, which extends below the adjacent lower surface of sole 676. As a result, in fairway wood and hybrid embodiments that utilize the lower surface for ground contact, the forward transmittal portion 658, sole plate 650, and a rear portion of sole 676 provide the ground-contacting lower surface of golf club head 670.

Figure 46:
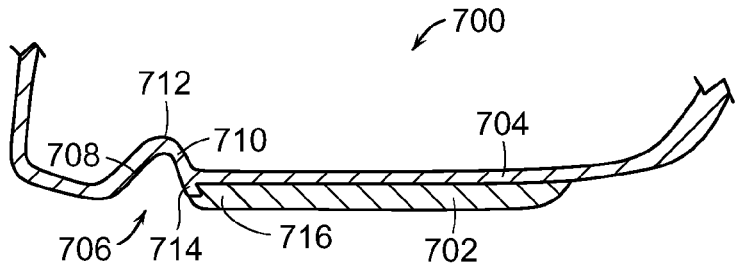
FIG. 46 is a cross-sectional view of a portion of an embodiment of a golf club head of the present invention.

Referring to FIG. 46, another embodiment of a golf club head is illustrated that includes a sole plate. Golf club head 700 includes a sole plate 702 that is coupled to a sole 704 and that forms a portion of a flexure 706. Flexure 706 is constructed from a first member 708, a second member 710 and a portion of sole plate 702. First member 708 and second member 710 extend into an interior cavity of golf club head 700 and meet at an apex 712. The lower end of second member 710 extends below the junction between second member 710 and sole 704 to form a shoulder, or tab 714, that complements and engages a shoulder 716 of sole plate 702. Sole 704 has a stepped configuration so that sole plate 702 provides the lowest surface of golf club head 700.

Figure 47:
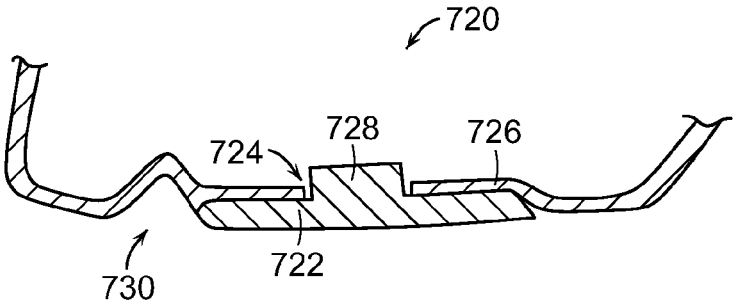
FIG. 47 is a cross-sectional view of a portion of an embodiment of a golf club head of the present invention.

In another embodiment, shown in FIG. 47, a golf club head 720 includes a sole plate 722 that covers an aperture 724 included in a sole 726 of golf club head 720 and forms a portion of a flexure 730. Aperture 724 may be used to provide access to an interior cavity of the golf club head, to locate sole plate 722, and/or to allow for greater adjustment in the mass of sole plate 722 while maintaining the overall outer shape of golf club head 720. For example, sole plate 722 may include a projection 728 that increases the mass of sole plate 722 and that extends into aperture 724 and/or into the interior cavity.

Figure 48:
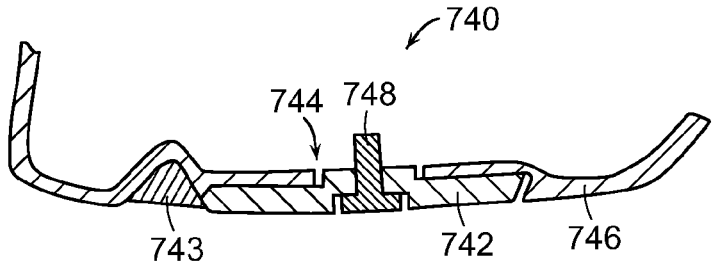
FIG. 48 is a cross-sectional view of a portion of an embodiment of a golf club head of the present invention.

In another embodiment, illustrated in FIG. 48, a golf club head 740 includes a sole plate 742 that covers an aperture 744 included in a sole 746 of golf club head 740 and provides a weight port for coupling a weight member 748 to the golf club head. Preferably, the weigh port is located so that changing, or removing, weight member 748 does not alter the location of the center of gravity of the combined sole plate 742 and weight member 748 to provide a more effective mechanism to alter the swingweight of a golf club including golf club head 740. In particular, sole plate 742 includes a mounting feature, such as a threaded bore, that is coupled to a removable weight member 748.

As a further alternative, any of the open flexures described herein may be completely or partially filled with an insert, such as insert 743, which may be a high density elastomeric insert. For example, an elastomeric material that is infused with a high density material, such as Tungsten, to create a high density flexible insert with is inserted into the tubular flexure, or into one of the other embodiments described herein including open slots, behind the face. The insert may be used to fill, or partially fill, the flexure to alter the acoustic behavior of the golf club head. A plurality of inserts constructed from materials with different densities and/or having different weight distributions may be provided to create inserts that fit into the flexure with different masses and weight distributions so that the final weight and mass distribution of the golf club head may be selected. Further, the flexure may include an opening that extends into the interior cavity and the insert may be used to plug the opening so that the interior cavity is not exposed to the environment so debris and water are not able to enter the interior cavity. Exemplary suitable materials include polyurethane, rubber, thermoset polymers, thermoplastic polymers, epoxy, foam, and neoprene. The selected material has a hardness that is selected to combine with the flexure to provide a combined flexibility. Preferably, the selected material has a hardness generally in a Durometer A range of 30-95 or a Durometer D range of 45-85.

Figure 49:
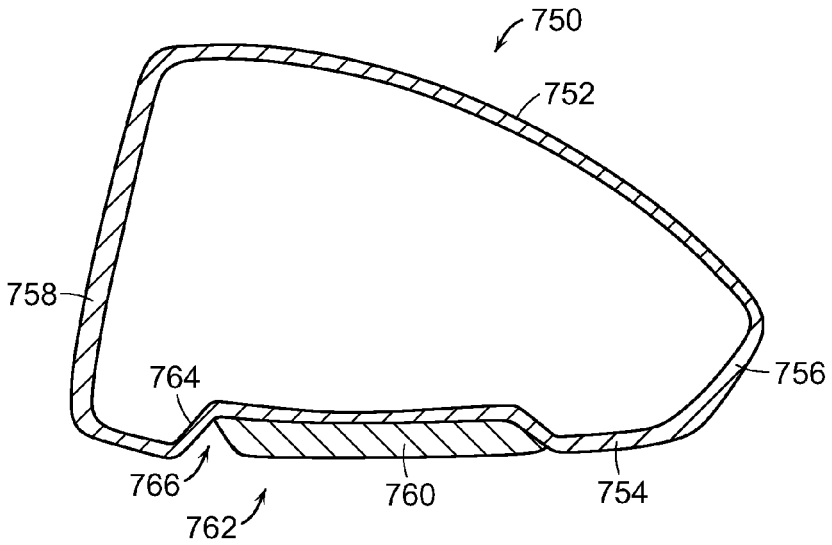
FIG. 49 is a cross-sectional view of an embodiment of a golf club head of the present invention.

Referring to FIG. 49, an embodiment of a golf club head including a sole plate and a flexure will be described. Golf club head 750 includes a crown 752, a sole 754, a skirt 756, a face 758, and a sole plate 760. A recess 762 is included in sole 754 that receives sole plate 760, but is shaped so that a gap is formed between a forward wall 764 of recess 760 and a forward end of sole plate 760, when sole plate 760 is installed. As a result, the gap forms a flexure 766 in the lower portion of the golf club head close to face 758.

Figure 50:
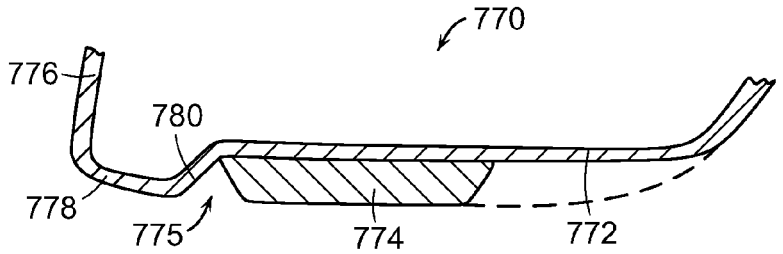
FIG. 50 is a cross-sectional view of a portion of an embodiment of a golf club head of the present invention.

In another embodiment, shown in FIG. 50, a golf club head 770 includes a stepped sole 772 and a sole plate 774 that combine to form a flexure 775. Sole 772 includes a front transmittal portion 778 that extends from a face 776 rearward toward a transition wall 780 of sole 772 that forms a forward wall of flexure 775. Sole plate 774 is coupled to sole 772 so that it is spaced from transition wall 780 to form flexure 775. Sole plate 774 extends rearward from transition wall 780 and desired distance as indicated by the dashed line.

Figure 51:
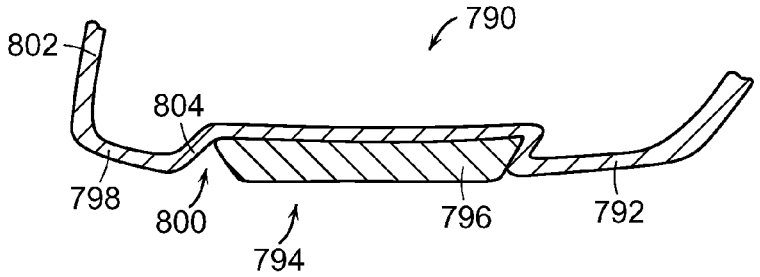
FIG. 51 is a cross-sectional view of a portion of an embodiment of a golf club head of the present invention.

Another embodiment of a golf club head includes a recessed sole and a sole plate that combine to form a flexure, and a portion of the golf club is shown in FIG. 51. Golf club head 790 includes a sole 792 that defines a recess 794 that receives a sole plate 796 and the sole and the sole plate combine to define a flexure 800. In particular, sole 792 includes a forward transmittal portion 798 that extends between a face 802 of the golf club head and a transition wall 804 that extends inward from the forward transmittal portion 798 and forms a portion of recess 794. Sole plate 796 is received in recess 794 and coupled to sole 792 so that the forward portion of sole plate 796 is spaced from transmittal portion 798 so that a generally V-shaped gap is formed at flexure 800.

Figure 52:
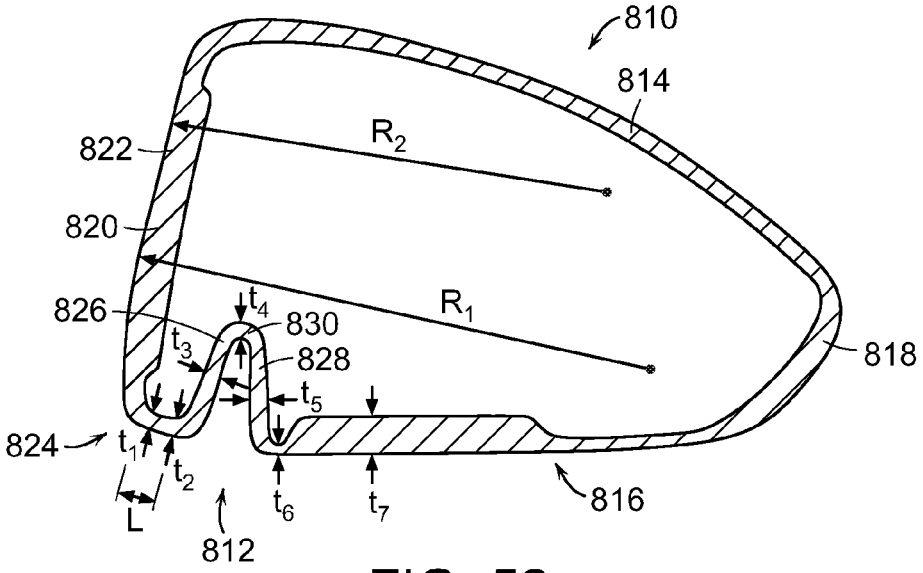
FIG. 52 is a cross-sectional view of a portion of an embodiment of a golf club head of the present invention.

Referring to FIG. 52, an embodiment of a golf club head 810 that includes a flexure 812 and flexure tuning features. Golf club head 810 includes a crown 814, a sole 816, a skirt 818, and a face 820 that defines a ball-striking surface 822. Sole 816 includes a front transmittal portion 824 that extends rearward from face 820 toward a front wall 826 of flexure 812. Front wall 826 is coupled to a rear wall 828 at an apex 830 to form flexure 812. A rear portion of sole 816 extends rearward from rear wall 828 and forms the remainder of sole 816. As illustrated, the rear portion of sole 816 may have a thickness that varies, such as by including a thickened region 832 spaced rearward from flexure 812 by an isolation portion 834.

Flexure 812 is elongate and extends in a heel-to-toe direction and forms an exterior channel in sole 816. The thickness of transmittal portion 824, front wall 826, apex 830, rear wall 828, and isolation portion 834 are selected to tune the flexure 812 to a desired frequency of vibration during impact with a golf ball. Thicknesses t1-t7 are defined having a specific relationship so that transmittal portion 824 transitions from a first thickness t1 adjacent the face to a second thickness t2 adjacent front wall 826. Front wall 826 varies in thickness from approximately t2 where it is coupled to transmittal portion 824 to a central thickness t3 and to a thickness approximately equal to a thickness t4 of apex 830. Similarly, rear wall 828 varies in thickness from approximately t4 where it joins apex 830 to a central thickness t5 and to a thickness approximately equal to a thickness t6 of isolation portion 834. Rearward of isolation portion 834, the thickness of sole 816 varies from thickness t6 of isolation portion to thickness t7.

As described above, the flexibility added to golf club heads of the present invention having flexures located in the sole reduces the backspin for ball impacts located below the ideal impact location. Because of that reduction in backspin, the curvature of the ball-striking surface of the golf club head is different above and below the ideal impact location so that the launch of the golf ball may be tuned to the amount of backspin reduction. The curvature of the ball-striking surface of a golf club between the top edge of the face and the leading edge of the golf club is defined as the "roll" of the face. The golf club heads of the present invention preferably have a roll radius above the ideal impact location that is different than the roll radius below the ideal impact location. Alternatively, the roll radius above the geometric face center of the golf club face is different than the roll radius below the geometric face center of the golf club face. As a further alternative, the upper ⅔ of the face of the golf club head has a roll radius that is different than the lower ⅓ of the face. Preferably, the roll radius of the portion of the ball-striking surface closer to the flexure is greater than the portion of the face further from the flexure so that the portion of the ball-striking surface closer to the flexure is flatter than the other portion. For example, in golf club head 810, flexure 812 is located in the lower surface of the golf club head and a portion of the ball-striking surface below the ideal impact location has a roll radius R1 that is greater than the roll radius R2 of the portion of the ball-striking surface above the ideal impact location. Preferably the portion of the ball-striking surface closest to the flexure has a roll radius that is greater than about 12.0 inches, and more preferably greater than 12.5 inches.

Similarly, the curvature of the ball-striking surface of a golf club between the heel and toe of the face is defined as the "bulge" of the face. Golf club heads of the present invention that include a flexure that extends to the skirt of the golf club head provide a similar reduction in sidespin of a struck golf ball for off-center impacts and therefore have a bulge radius that is greater than a golf club head without a flexure on the skirt. Increasing the bulge radius creates a flatter face increases the hot spot area of the golf club face by reducing the obliqueness of impact for off-center hits to provide a more efficient transfer of energy between the golf club head and the ball. Preferably, the portion of the ball striking surface closest to a flexure in the skirt of the golf club head has a bulge radius that is greater than about 12.0 inches, and more preferably greater than 12.5 inches.

Figure 53:
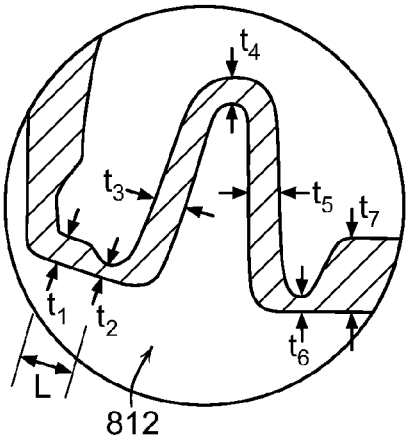
FIG. 53 is a cross-sectional view of a portion of an embodiment of a golf club head of the present invention.
Figure 54:
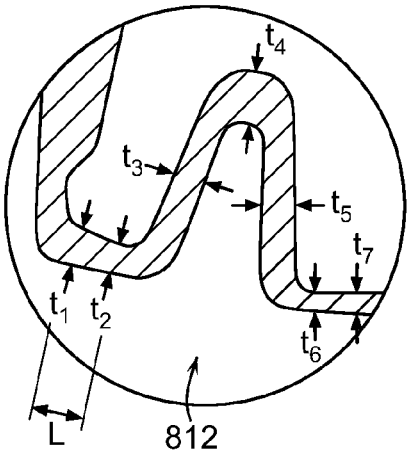
FIG. 54 is a cross-sectional view of a portion of another embodiment of a golf club head of the present invention.

Alternative embodiments of the thickness transitions are illustrated in FIGS. 52-54. The thickness relationships used herein are utilized to provide a desired distribution of flexing throughout the flexure and the portions of the golf club head adjacent the flexure. In an embodiment shown in FIG. 52, the thickness in the transmittal portion t1 and t2 are at least 50% of the minimum face thickness, and more preferably at least 60% of the minimum face thickness, and preferably thickness t1 is greater than t2 (t1>t2). Additionally, the thickness of the front wall t3 and the thickness of the rear wall t5 of the flexure are different by less than 40%, more preferably by less than 30%, and even more preferably by less than 20%. Furthermore, the thicknesses of the front wall t3 and rear wall t5 of the flexure are preferably less than 90% of the minimum thickness of the face, and the thicknesses of the walls of the flexure are preferably less than or equal to the thickness of the transmittal portion t1, t2. The apex of the flexure preferably has a thickness that is preferably greater than or equal to the minimum thickness of the front wall t3 and the thickness of the rear wall t5 of flexure. Additionally, the thickness of the apex t4 is preferably within 30% of the larger of the thickness of front wall t3 and the thickness of the rear wall t5, and more preferably within 15% of the larger of those thicknesses.

The thickness of the sole adjacent the rear wall of the flexure is preferably reduced if a portion of the sole within about 30.0 mm of the rear wall of the flexure has a thickness that is greater than the thickness of the transmittal portion forward of the front wall of the flexure. For example, if sole thickness t7 is greater than the minimum thickness of the transmittal portion within 30.0 mm of the rear wall of the flexure, then thickness t6 of the portion of the sole immediately rearward of the flexure is preferably less than the minimum thickness of the transmittal portion and less than the minimum face thickness. Preferably, thickness t6 is less than 70% of the minimum thickness of the transmittal portion, and more preferably less than 60% of the minimum thickness of the transmittal portion. Additionally, thickness t6 is less than 60% of the minimum face thickness, and more preferably less than 50% of the minimum face thickness.

In another embodiment, shown in FIG. 53, the transmittal portion is modified to include a thickness that changes over the length L of the transmittal portion. The thickness relationships for the other portions of the flexure and sole described above are the same as the previous embodiment and will not be repeated. In the transmittal portion the thickness of the transmittal is about constant over at least 60% of the length L of the transmittal portion, and more preferably over at least 70% of the length L of the transmittal portion. Additionally, the maximum thickness of the transmittal portion is closer to the face of the golf club head than the front wall of the flexure. The maximum thickness is generally located at thickness t1 and the minimum thickness of the transmittal portion is generally located at thickness t2, shown in FIG. 53. Preferably, the minimum thickness of the transmittal portion is greater than or equal to the minimum thickness of the sole of the golf club head. The minimum thickness of the transmittal portion is preferably less than 70% of the maximum thickness of the transmittal portion, and more preferably less than 60% of the maximum thickness of the transmittal portion.

In another embodiment, shown in FIG. 54, the transmittal portion is modified to include a thickness that changes over the length L of the transmittal portion, the apex thickness is illustrated greater than the minimum thickness of the front wall t3 and the thickness of the rear wall t5 of flexure, and the thicknesses of the sole rearward of the flexure are illustrated as about constant and generally less than the maximum thickness of the transmittal portion. In this embodiment, the thickness of the transmittal portion has a generally linear taper from adjacent the face to the front wall of the flexure. The linear taper, or linear reduction in thickness, is preferably greater than about 4% (i.e., 0.4 mm reduction in thickness over 10.0 mm length), and more preferably greater than about 5%, from the adjacent the face to the flexure. In the present embodiment, the thickness of the portion of the sole adjacent the rear wall of the flexure t6 and the sole thickness t7 further rearward from the flexure are about equal and are less than the maximum thickness of the transmittal portion.

In embodiments of golf clubs according to the present invention having loft angle in a range of about 13°-30°, such as in fairway wood and hybrid type golf club heads, the thicknesses are generally in the following ranges: t1) 1.4-2.0 mm; t2) 1.2-1.6 mm; t3) 1.2-1.7 mm; t4) 1.2-2.0 mm; t5) 1.2-1.7 mm; t6) 0.6-1.2 mm; and t7) 0.6-4.0 mm. Similarly, in embodiments of golf clubs according to the present invention having loft angle in a range of about 6°-12°, such as in driver type golf club heads, the thicknesses are generally in the following ranges: t1) 1.4-2.0 mm; t2) 0.6-1.6 mm; t3) 0.5-1.7 mm; t4) 0.5-2.0 mm; t5) 0.5-1.7 mm; t6) 0.5-1.2 mm; and t7) 0.5-3.0 mm.

Figure 55:
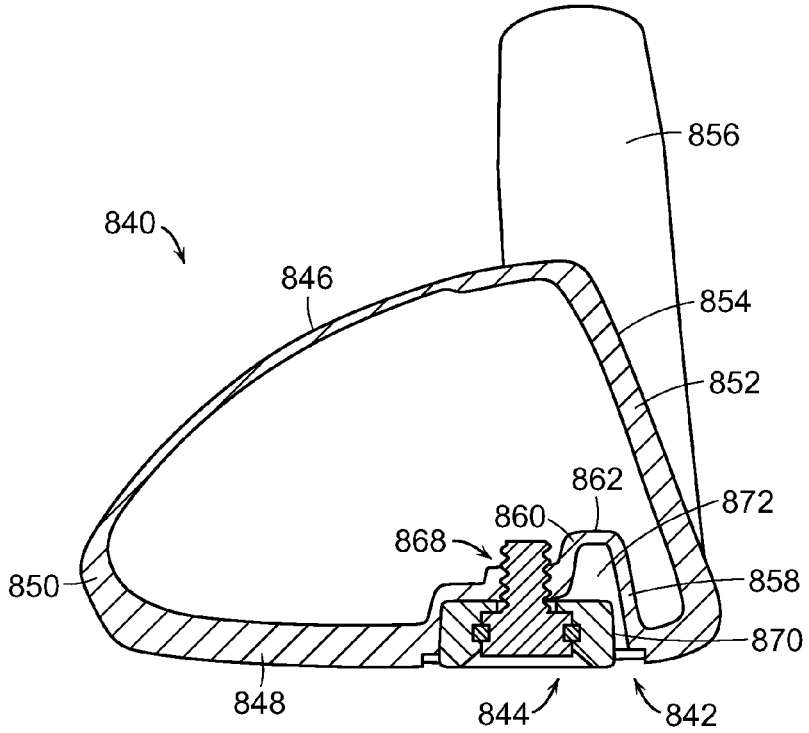
FIG. 55 is a cross-sectional view of an embodiment of a golf club head of the present invention.
Figure 56:
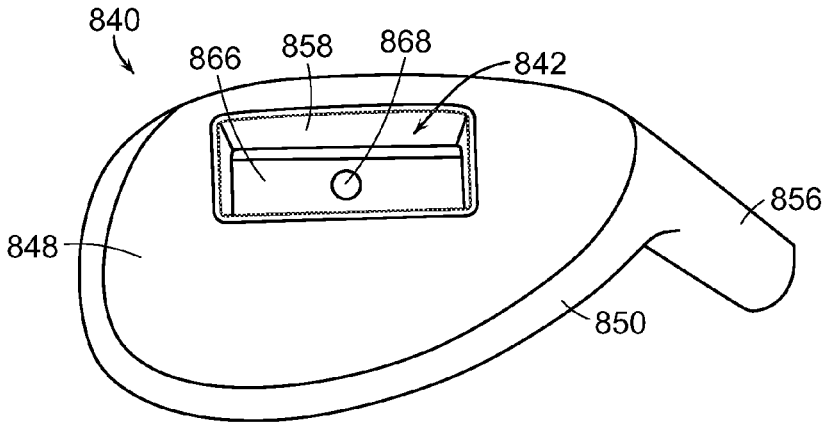
FIG. 56 is a bottom view of the golf club head of FIG. 55.

Referring now to FIGS. 55 and 56, a golf club head 840 includes a flexure 842 that is at least partially covered by a removable member 844. Golf club head 840 includes a crown 846, a sole 848, a skirt 850, a face 852 that defines a ball-striking surface 854, and a hosel 856 that is attached to an elongate golf club shaft and grip in an assembled golf club.

Flexure 842 is located in a forward portion of sole 848, generally adjacent to face 852, and includes a mounting portion for removable member 844. Flexure 842 includes a front wall 858 that is joined with a rear wall 860 at an apex 862. Rear wall 860 extends between apex 862 and the mount 864 for removable member 844. Mount 864 includes a recessed support portion 866 that receives removable member 864 and positions it so that, when it is mounted, the lower surface of removable member 844 is flush or recessed relative to the adjacent exterior surface of sole 848. A coupling feature 868 is included so that removable member 864 may be removably attached to golf club head 840. For example, coupling feature 868 may be a threaded bore and removable member 844 may be a weighted sole plate that is coupled to the threaded bore using a threaded fastener.

Removable member 844 is sized to fit within the recessed mount 864 so that it is spaced from front wall 858 of flexure 842 to form a gap 870. Gap 870 provides an opening into flexure 842 and the opening provides a pathway into a cavity 872 defined by removable member 844 and flexure 842. Gap 870 provides a space so that during a golf ball impact, flexure 842 is able to flex and gap 870 allows front wall 858 to move relative to removable member 844 in a fore-aft direction.

Figure 57:
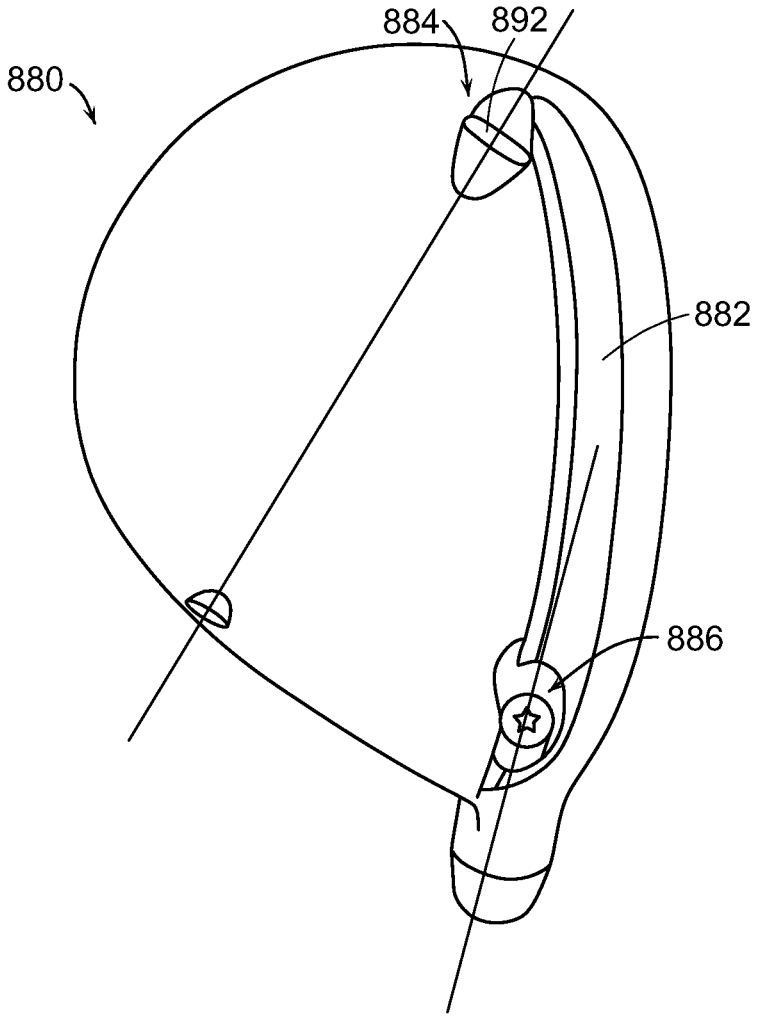
FIG. 57 is a bottom view of another embodiment of a golf club head of the present invention.

Referring to FIG. 57, a golf club head 880 includes a flexure 882 that intersects a removable member 884 mount and an interchangeable shaft system 886. In the present embodiment, golf club head 880 includes a hollow-body construction that is formed by a crown, a sole 888, a skirt, and a hosel 890. Golf club head 880 includes a removable member 884, such as a weight member and a portion of sole 888 includes a mounting feature for the weight member. In the present embodiment the mounting feature includes a generally cylindrical receiver 892 that extends from an outer surface of sole to the interior of golf club head 880.

Golf club head 880 also includes flexure 882 extending in a generally heel to toe direction across a forward portion of sole 888. Flexure 882 may have any of the specific constructions described with regard to the other embodiments described herein.

Golf club head 880 includes an interchangeable shaft system that includes a fastener 894 that is engaged with the head from the sole side. An access bore 896 is included that receives fastener 894 and extends toward hosel 890 from sole 888.

The sole structures of receiver 892, flexure 882 and access bore 896 intersect so that the structures are created by common portions. In particular, a side wall of receiver 892 intersects a side wall of flexure 882 so that the structures are combined in a toe portion of golf club head 880. Similarly, a side wall of access bore 896 intersects a side wall of flexure 882 so that the structures are combined in a heel portion of golf club head 880. The intersection of the structures of receiver 892, flexure 882 and access bore 896, reduces the amount of mass that is dedicated to the extra structures by combining the structures.

Figure 58:
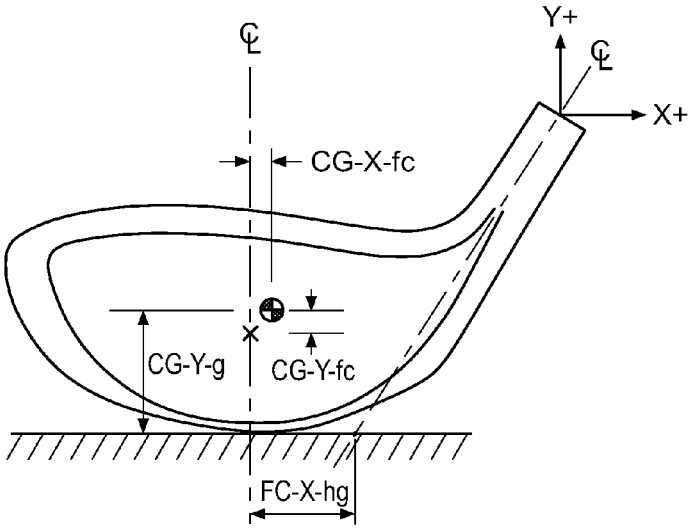
FIG. 58 is a front view of a golf club head illustrating dimensional characteristics and a coordinate system used herein.
Figure 59:
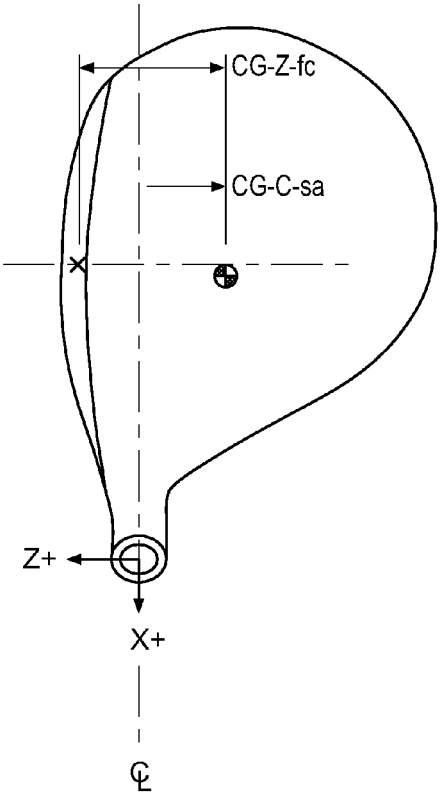
FIG. 59 is a top view of the golf club of FIG. 58.
Figure 60:
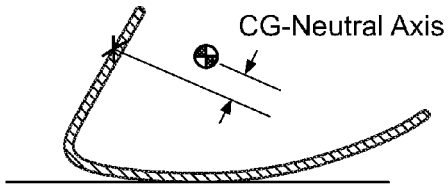
FIG. 60 is a cross-sectional view of a portion of the golf club head of FIG. 58.

The physical attributes of golf club heads are generally controlled to provide desired behavior during an impact with a golf club head. In metalwood golf club heads, the mass distribution is controlled to provide a desired location of the center of gravity and a desired moment of inertia. As illustrated in FIGS. 58-60, the center of gravity of a golf club head may be dimensionally related to any number of features on the golf club head. Desired dimensional ranges for golf clubs of the present invention are presented in the table below, with negative values denoted by parenthesis to indicate the direction relative to the reference feature (e.g., fc-face center; g-ground).

| Golf Club Type | CG-C-sa [mm] | CG-X-fc [mm] | CG-Y-fc [mm] | CG-Z-fc [mm] | CG-Y-g [mm] | CG-Neutral Axis [mm] |
|---|---|---|---|---|---|---|
| Driver | 13.5-28.0 | (1.6)-7.8 | (7.8)-1.2 | (43.0)-(29.0) | 26.3-32.7 | (5.3)-7.0 |
| Preferred Driver | 18-22 | (1.3)-3.5 | (5.4)-0.0 | (38.0)-(30.0) | 26.9-29.0 | (1.0)-6.3 |
| Fairway | 5.8-21.9 | (0.9)-5.3 | (4.8)-0.9 | (33.3)-(18.2) | 13.8-18.9 | (2.8)-7.8 |
| Preferred Fairway | 8.0-15.9 | 0.3-2.5 | (4.8)-(0.6) | (29.5)-(22.0) | 14.1-18.8 | (2.5)-6.8 |

The flexures of the present invention are also sized relative to the location of the center of gravity of the golf club head to provide desired behavior. It should also be appreciated that the width W, height H and distance to ball-striking surface D may be measured on all of the embodiments described herein as illustrated in FIGS. 1 and 4. Preferably the distance D from the ball-striking surface to the flexure is less than or equal to 30.0 mm, more preferably less than or equal to 20.0 mm, and more preferably between 5.0 mm and 20.0 mm. Additionally, the distance D is preferably between 20% and 50% of the CG-Z-fc distance, and more preferably between 25% and 45% of the CG-Z-fc distance. Additionally, the sum of the height and width of the flexure is preferably within +/−30% of the CG-Y-g distance, and more preferably within +/−20% of the CG-Y-g distance.

The reduction in backspin provided by the flexure of the present invention also more flexibility in mass distribution to increase the moment-of-inertia of a golf club head. In particular, the incorporation of a flexure of the present invention into the sole of a golf club head provides ball impacts that emulate launch conditions of a golf club head without a flexure that has a low center of gravity. Analysis has shown that the incorporation of a flexure of the present invention provides the same effect as lowering the center of gravity of a golf club without the flexure by as much as 3.0 mm. However, lowering the center of gravity of requires that mass is placed lower in the golf club head and because of the shape of the golf club head it limits the amount of mass that can be placed at the perimeter to increase moment-of-inertia. Therefore, the flexure of the present invention may be used to provide the behavior of a golf club head with a lower center-of-gravity while additional mass is placed at the perimeter of the golf club head to increase moment-of-inertia and moving the center-of-gravity rearward.

The dimensional characteristics of the face and the flexure of the golf club heads of the present invention must be selected so that the head is able to withstand the stresses imparted during an impact, while balancing and maximizing the combined compliance provided by the flexure and the face. It is generally desired to maximize the sweet spot of a golf club head, i.e., a portion of the face that provides ball speed after impact that is within a range close to the maximum ball speed. In golf club heads that are intended to conform to the Rules of Golf established by both the U.S. Golf Association and the Royal & Ancient Golf Club, the compliance of a portion of the face near the location that provides maximum coefficient of restitution (COR) is often reduced so that the maximum COR is maintained within the limits established by the Rules. Oftentimes, that compliance is reduced using a variable face thickness, but that variable face thickness can introduce stress gradients because of the geometry. Additionally, because the central portion of the face is generally thickened relative to a perimeter portion of the face, additional mass is added to the face, which can compound the detrimental mass distribution that is presented with a flexure, i.e., adding mass forward and high in a wood-type golf club head.

The face construction may also be used to allow greater control over the stress distribution and durability of the golf club head and particularly of the face and flexure. Manufacturing variances can lead to porosity, material variation and alpha case, which require greater design margins to assure durability. For example, those variations may require that the flexure be thickened, which reduces the flexibility, and requires that the face flexibility be tuned to complement the flexure compliance such as by reducing the face thickness. However, increasing the flexibility can also result in the maximum COR increasing so that the golf club head becomes non-conforming.

Figure 61:
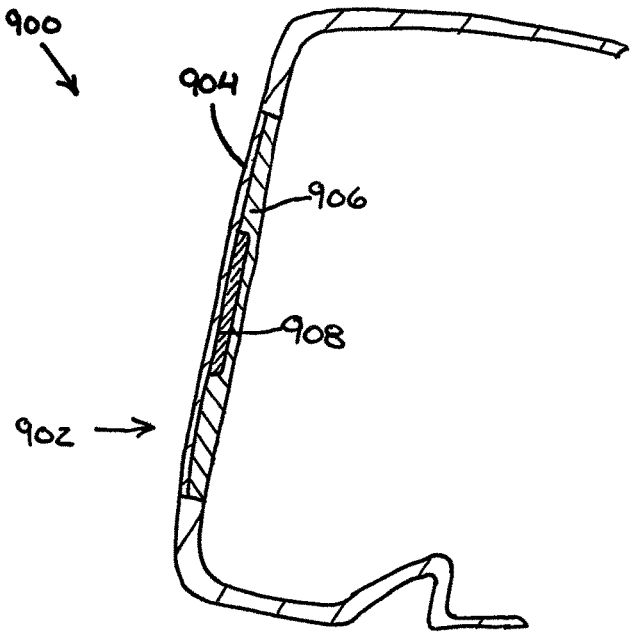
FIG. 61 is a cross-sectional view of an embodiment of a golf club head of the present invention.
Figure 62:
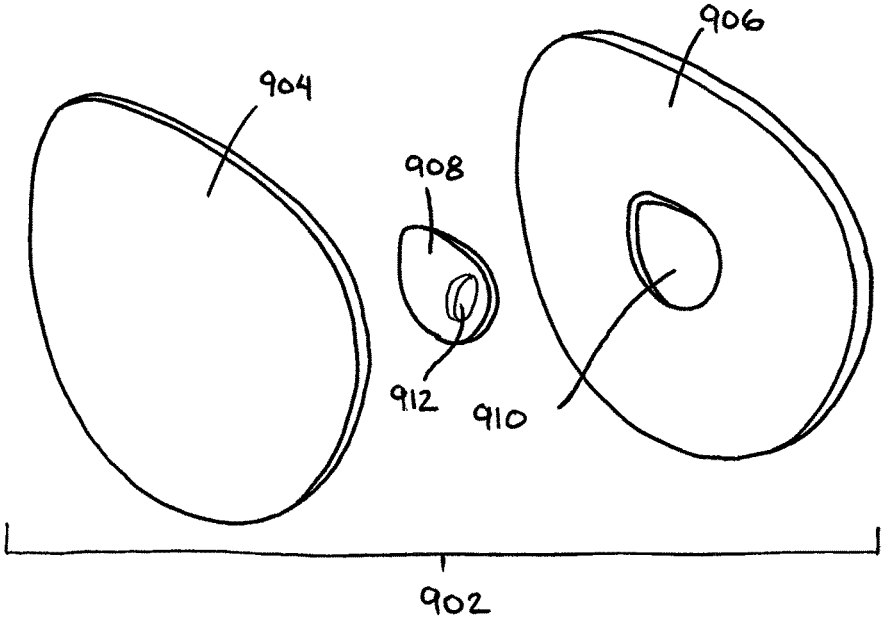
FIG. 62 is an exploded view of a face insert of the golf club head of FIG. 61.

A multi-material face construction may be utilized to tune the flexibility and durability of the face. Referring to FIGS. 61 and 62, a golf club head 900 that includes a striking face member 902, such as a face insert or face cup, having a multi-material construction will be described. Face member 902 includes an outer layer 904, a backing layer 906, and a chip insert 908. Outer layer 904 is generally a thin layer formed of a first material, which is preferably a ferrous alloy or a titanium alloy, and provides at least a portion of a ball-striking surface of golf club head 900. Outer layer 904 may be constructed from a sheet material or it may be a coating layer, or the face member may be constructed as a co-forging. For example, in a driver-type golf club it is preferable to employ a titanium alloy having a Young's modulus of between about 80 GPa to about 130 GPa, more preferably between about 90 GPa to about 120 GPa, and most preferably between about 95 GPa to about 115 GPa. However, the first material need not be made out of a steel or titanium alloy, and could be made out of any material that is sufficiently durable to endure the impact forces with a golf ball without departing from the scope and content of the present invention.

Outer layer 904, although shown in FIG. 62 to be a thin sheet of titanium, can also be created using a sprayed coating type of titanium without departing from the scope and content of the present invention. Because it is generally desirable to keep the thickness of outer layer 904 as thin as possible to minimize its size and weight, the present construction can be achieved by spray coating the front surface of the face member 902 to significantly reduce the thickness of the outer layer 904, and to meet the USGA requirement that indicates the frontal face portion has to be all made of the same material.

Backing layer 906 forms a rear portion of face member 902 and includes a recess 910 that is shaped and sized to receive chip insert 908. In the present embodiment, recess 910 has a shape that complements the shape of chip insert 908 and a size that receives chip insert 908 so that a forward surface of chip insert 908 is flush with a forward surface of backing layer 906 when chip insert 908 is received in recess 910. The backing layer 906, as shown in this current exemplary embodiment of the present invention, may generally be formed out of a similar first material used to form the outer layer 904. Similar material, as referred to in this particular reference may be other types of titanium such as Ti-811, SP-700, 15-3-32, or any α alloy, any β alloy, or an α-β alloys.

Recess 910, as shown in the current exemplary embodiment of the present invention, may generally have a geometric shape that is identical to the geometric shape of the chip insert 908 to ensure proper bonding of all the components. However, recess 910 need not have a geometry that closely complements chip insert 908, in fact it can take on other geometric shapes without departing from the scope and content of the present invention so long as it has enough interface with the chip insert 908 to ensure a secure bond between the outer layer 904, backing layer 906, and chip insert 908. Furthermore, chip insert 908 may also include one or more recesses or apertures, such as aperture 912, that create voids in the final construction of face insert.

Chip insert 908, is generally formed of a material that has a greater Young's modulus than at least one of the materials of outer layer 904 and backing layer 906, and more preferably greater than the materials of both the outer layer and the backing layer. The greater Young's modulus of the material of chip insert 908, compared to the material of the other members, results in the portion of the face with chip insert 908 move as a single unitary entity with less bending than adjacent portions of the face. Even more specifically, the chip material generally has a Young's modulus of greater than about 130 GPa, more preferably greater than about 150 GPa, and most preferably greater than about 170 GPa. In addition to having a high modulus of elasticity, the chip material generally has a yield strength of greater than about 500 MPa, more preferably greater than about 600 MPa, and most preferably greater than about 700 MPa. Finally, the chip material generally has an ultimate tensile strength of greater than about 750 MPa, more preferably greater than about 850 MPa, and most preferably greater than about 950 MPa.

With the material properties of the chip insert 908 disclosed above, it can be seen that there are numerous materials that fit those characteristics. In a preferred embodiment, chip insert 908 is constructed of steel and outer layer 904 and backing layer 906 are constructed from titanium alloys. Materials suitable for chip insert 908 include carbon steel, stainless steel, ceramic, tungsten, plastic, carbide, boron carbide, metal injection molding materials, but any other material that fits the description above may all be used without departing from the scope and content of the present invention so long as it meets the material properties above.

Outer layer 904 and backing layer 906 combine with one another to form an enclosed cavity, preferably at a location overlapping a geometric center of the face of golf club head 900 that encloses chip insert 908. The components are coupled using methods that form a bond over the abutting surface areas of the components. For example, coupling methods such as diffusion bonding, liquid interface diffusion bonding, friction welding, diffusion brazing and super plastic forming are methods that may be used to bond the components.

Figure 63:
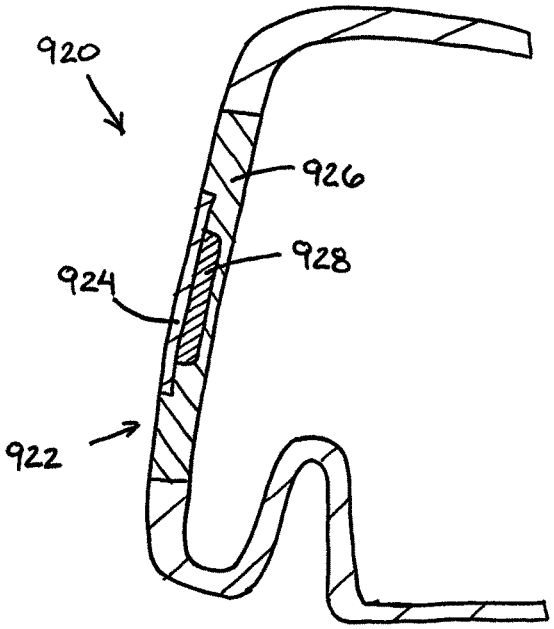
FIG. 63 is a cross-sectional view of an embodiment of a golf club head of the present invention.
Figure 64:
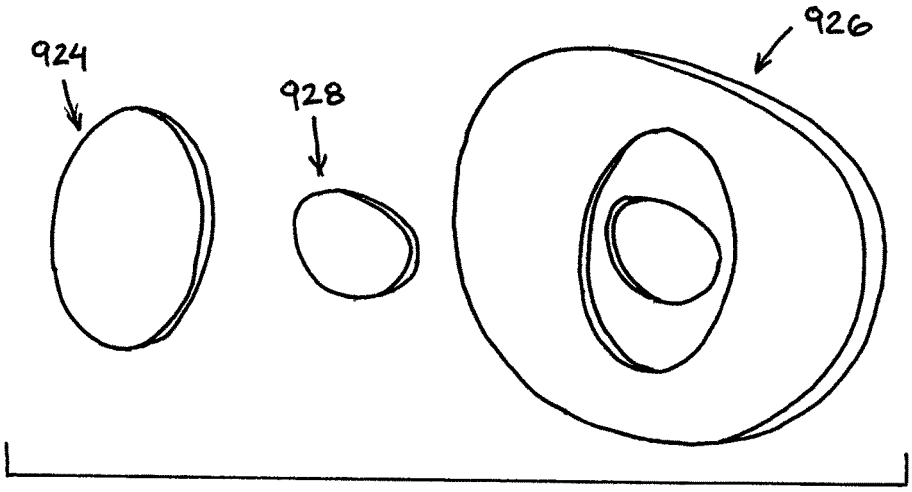
FIG. 64 is an exploded view of a face insert of the golf club head of FIG. 63.

In another embodiment, illustrated in FIGS. 63 and 64, golf club head 920 includes a face member 922, such as a face insert or face cup, having a multi-material construction. Face insert generally includes an outer layer 924, a backing layer 926, and a chip insert 928. In the present embodiment, outer layer 924 covers only a portion of the front ball-striking surface of face member 922 so that both outer layer 924 and backing layer 926 form portions of the ball-striking surface. Outer layer 924 is generally a thin layer formed of a first material and provides at least a portion of a ball-striking surface of golf club head 920. The layer may be constructed from a sheet material or it may be coating layer, or the face member may be constructed as a co-forging. An advantage of utilizing such a construction is that the bonding surface area is reduced, which reduces the amount of surface area that must be prepared prior to a bonding process. For example, some bonding processes require significant surface preparation to create adequate surface conditions to create a strong bond, such as diffusion bonding and liquid interface bonding, and the reduced bonding surface area requires less preparation.

The size and shape of outer layer 924 are selected to provide sufficient bonded area so that the completed face member is durable during use and to simplify machinability of the components. Outer layer 924 may have a circular, oval, freeform, polygonal or any other desired shape.

Alternatively, the chip insert need not be completely enclosed. For example, a surface of the chip insert may form a portion of the front ball-striking insert of a face insert, or a portion of a rear surface of a face insert. Furthermore, the chip insert need not entirely fill a cavity created between an outer layer and a backing layer.

The material properties of the outer layer, the backing layer and the chip insert in the above embodiments are selected to alter the stiffness of the portions of the face member, rather than relying entirely on the thickness of different portions of a single material face member, which results in a lower thickness gradient radially from the geometric face center of the face to the outer perimeter of the face member. In some embodiments, the multi-material construction allows the face member to be constructed with a generally constant face thickness. In other embodiments, the face member may have a variable thickness with a smaller thickness gradient, and in particular, the difference in thickness between the face member at a geometric face center of the face and the perimeter of the face member is preferably less than about 1.5 mm, and more preferably less than 1.0 mm. As a result, the geometry of the face member has less impact on the stress distribution across the face. Further, the specific gravities of the materials may be selected to reduce the amount of mass added to the face to provide the desired stiffness.

In any of the embodiments incorporating a multi-material face, the chip insert preferably has a forward surface that has a surface area that is less than about 400 $mm^2$, and more preferably less than about 300 $mm^2$.

Figure 65:
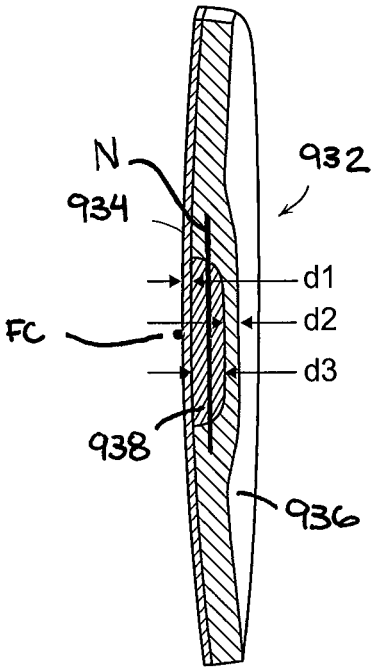
FIG. 65 is a cross-sectional view of an embodiment of a golf club of the present invention.

FIG. 65 illustrates a portion of a face insert having a similar construction to the face member illustrated in FIGS. 61 and 62, and defines dimensional attributes that apply equally to all of the faces described herein. Face insert 932 includes an outer layer 934 having a first thickness d1, a backing layer 936 having a second thickness d2 at a location rearward of the chip insert, and a chip insert 938 having a third thickness d3. As described herein, the measurement of the relative thicknesses d1, d2, and d3 are generally taken near the geometric center of the face, despite the fact that FIG. 65 illustrates the thicknesses at locations that are offset from the center for ease of illustration.

First thickness d1, as shown in the figures of this current exemplary embodiment may be kept relatively thin to save weight as the front of the face is in compression during impact. The internal stress caused by the compression forces experienced by the outer layer 934 are generally smaller than the internal stress caused by the tension forces experienced by the rear of the face. Preferably, the chip insert is located in the face insert so that a neutral axis N of the face insert extends across the chip insert. Additionally, it is preferable that the chip insert is located so that it is closer to a forward surface than a rear surface of the face insert. More specifically, first thickness d1 is preferably less than about 0.7 mm, more preferably less than about 0.6 mm, and most preferably less than about 0.5 mm. Backing layer 936 has a second thickness d2, and is the part of the face that is subjected to the highest internal stress as it comes in tension due to impact with a golf ball. Therefore, the second thickness d2 is preferably thicker than the first thickness d1. More specifically, second thickness d2 is preferably greater than about 0.8 mm, more preferably thicker than 0.9 mm, and most preferably thicker than 1.0 mm. Finally, third thickness d3 of the chip insert 938 is preferably between about 0.5 mm and about 2.2 mm, more preferably between about 0.8 mm to about 1.9 mm, most preferably about 1.2 mm.

Although the thicknesses of the various components of the face insert have all been disclosed above, it is also useful to consider the relative thicknesses of the components. More specifically, because the backing layer 936 is subjected to tension stresses that are significantly higher than the compressive stresses at the outer layer 934, the thickness d2 of the backing layer 936 is preferably greater than the thickness of the outer layer 934. In order to properly capture the thickness relationships of the various portions of the various components to provide sufficient durability, a "Face Thickness Ratio" is calculated as shown below in Equation (1).

$$\text{Face Thickness Ratio} = \frac{\text{Thickness } d1}{\text{Thickness } d2} \qquad \text{Eq. 1}$$

The face insert preferably has a "Face Thickness Ratio" of less than about 0.875, more preferably less than about 0.66, and most preferably less than about 0.50.

Chip insert 938 may generally be substantially circular or oval in shape with a major axis length of about 21.8 mm and a minor axis length of about 11.6 mm. Combined with an approximate thickness of about 1.2 mm described above, the chip insert 938 generally has a volume of about 370 $mm^3$. More specifically, chip insert 938 preferably has a volume of between about 250 $mm^3$ and about 450 $mm^3$, and more preferably a volume of between about 300 $mm^3$ and about 400 $mm^3$, all without departing from the scope and content of the present invention. Finally, because it may generally be undesirable to add excessive weight to the face portion of the golf club head, it is generally desirable to keep the weight of the chip insert 938 as minimal as possible. Hence, given some of the material properties discussed above and the volume ranges above, the chip insert generally has a mass of less than 3.0 grams, more preferably less than 2.95 grams, and most preferably less than 2.90 grams.

Chip insert 938 may take on a dome like shape, with the flat side facing outer layer 934 and the rounded side facing the backing layer 936. This specific construction eliminates sharp corners at the rear of the backing layer 936, which could be points of elevated stress when subjected to impact forces. Because the tension stress at backing layer 936 is significantly higher than the compressive stresses at the outer layer 934, it is important to keep the rounded side of the cavity on the backing layer 936. The flat side of the dome interacts with outer layer 934 because the compressive stresses are not as significant, and because this type of dome cavity construction is easier to create using traditional machining methods.

Figure 75:
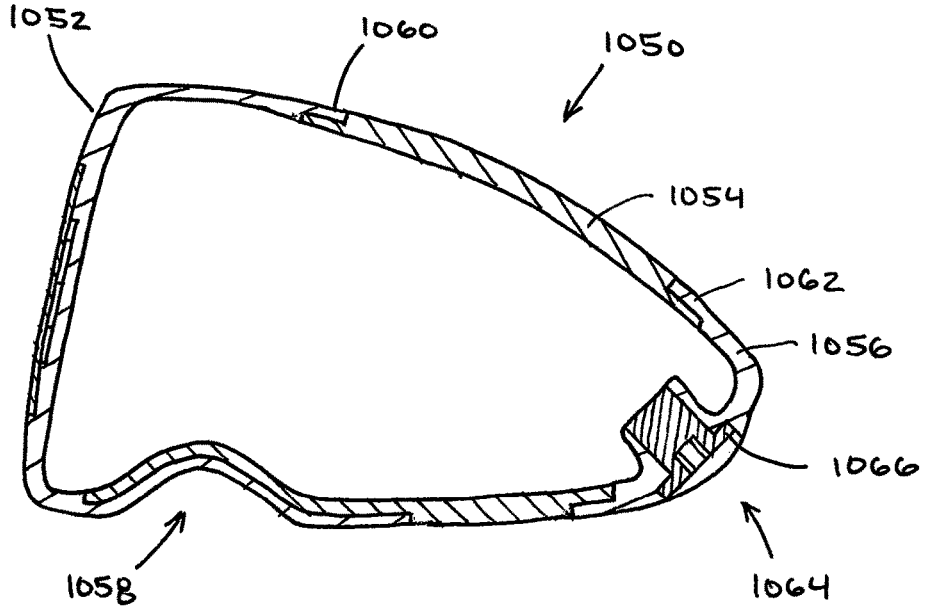
FIG. 75 is a cross-sectional view of an alternative construction of the golf club head of FIG. 72, generally corresponding to line 73-73, shown in FIG. 72.

It should be appreciated that the multi-material constructions described herein applies equally to face members having a face insert or a face cup construction. In particular, the multi-material construction may be utilized in face cup or partial face-cup constructions, as illustrated in the embodiment of FIG. 75, or face insert constructions.

Figure 66:
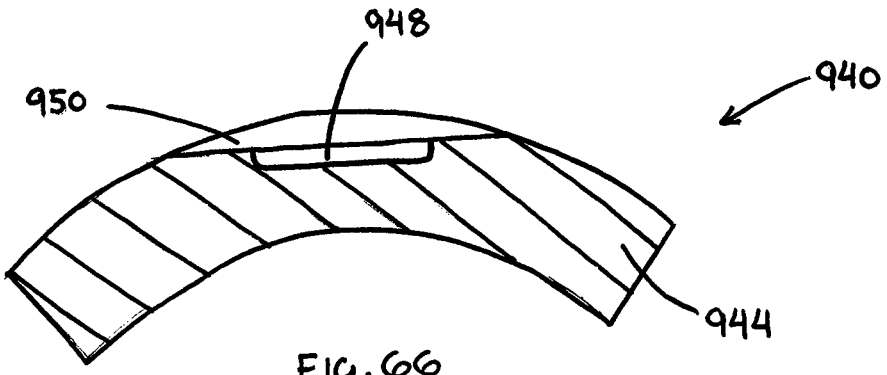
FIG. 66 is a cross-sectional view of a portion of face member of a golf club of the present invention.
Figure 67:
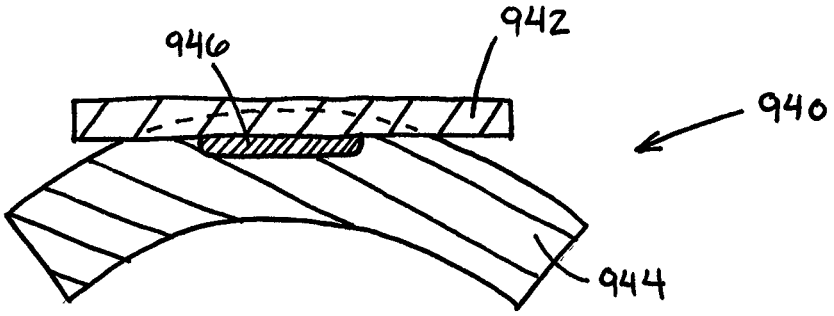
FIG. 67 is another cross-sectional view of the portion of face member of FIG. 66.
Figure 68:
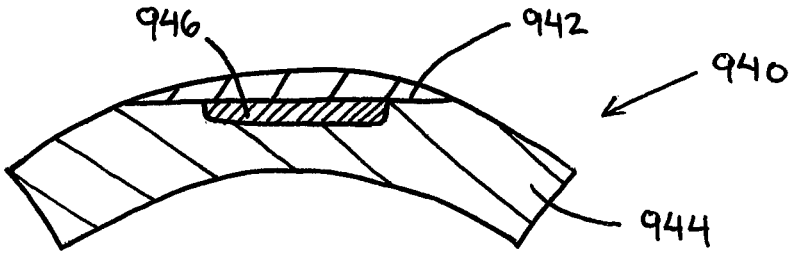
FIG. 68 is another cross-sectional view of the portion of face member of FIG. 66.

Another method of incorporating a chip insert into a face member will be described with respect to FIGS. 66-68. A portion of a face member 940 is illustrated and in the final construction face member 940 includes an outer layer 942, a backing layer 944 and a chip insert 946. In a method of forming face member 940, backing layer 944 is formed so that it has a bulge and/or roll radius prior to machining a chip insert pocket 948 that is configured to receive chip insert 946, and an outer layer recess 950 that is configured to receive outer layer 942. Preferably, outer layer recess 950 is shaped so that an interface between outer layer 942 and chip insert 946 and between outer layer 942 and backing layer 944 is planar to simplify the machining and bonding of the components. In particular, backing layer 944 is formed with curvature, then recess 950 and pocket 948 are machined into the backing layer. Next, chip insert 946 is inserted into pocket 948 and outer layer 942 is inserted into recess 950 and the three components are bonded together. Finally, outer layer 942 is machined to provide a desired curvature. Preferably, outer layer 942 is machined so that the contour of outer layer 942 matches the contour of backing layer 944. As an alternative, the chip insert 946 may be bonded to backing layer 944 and then the outer layer 942 may be bonded to the combined backing layer 944 and chip insert 946.

Figure 69:
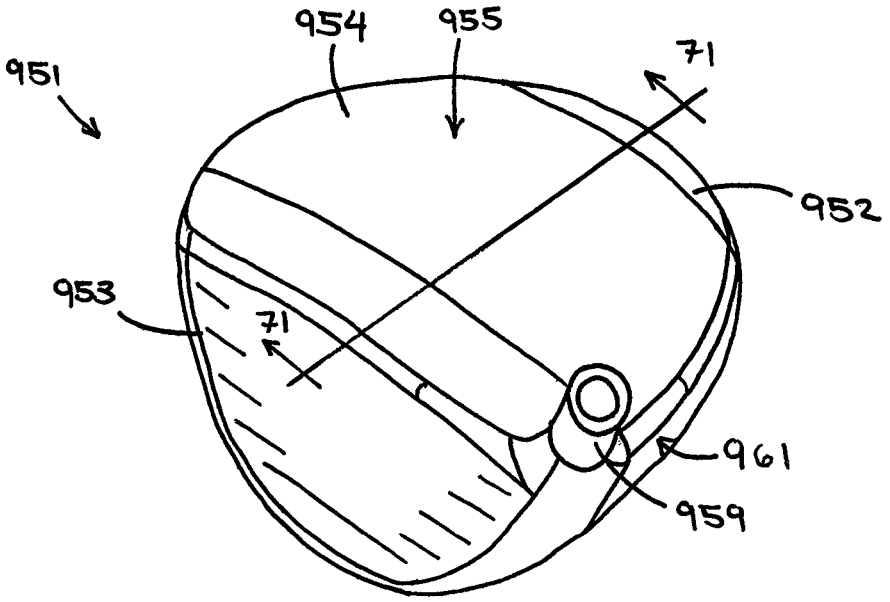
FIG. 69 is a perspective view of an embodiment of a golf club head of the present invention having a multi-material construction.
Figure 70:
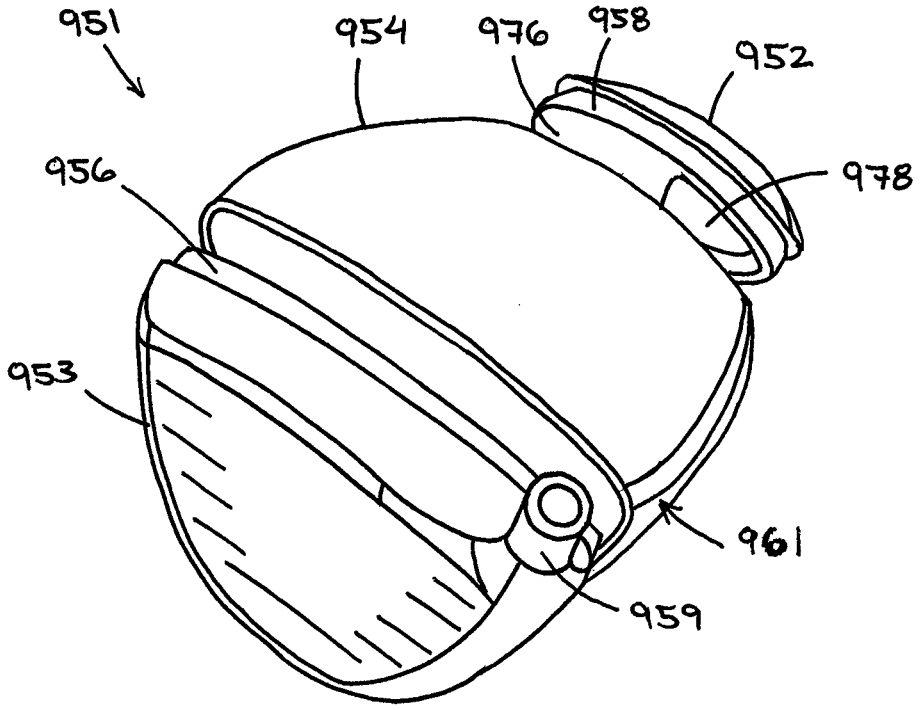
FIG. 70 is an exploded view of the golf club head of FIG. 69.
Figure 71:
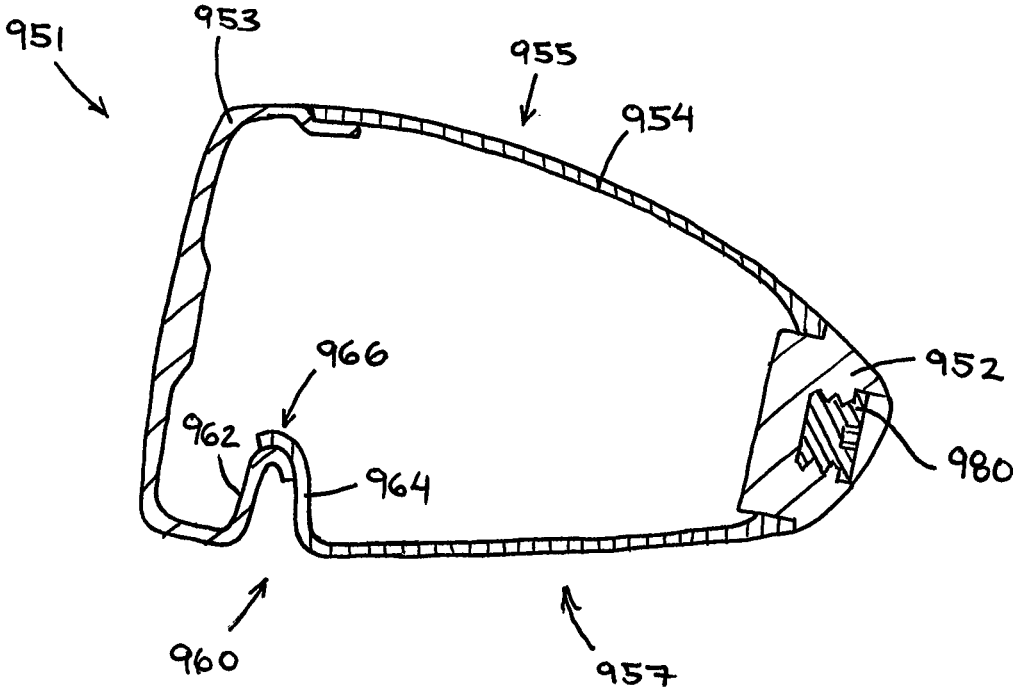
FIG. 71 is a cross-sectional view of the golf club head of FIG. 69, taken along line 71-71, shown in FIG. 69.

The golf club head of the present invention may incorporate a geometric flexure in addition to a multi-material body construction. Referring to FIGS. 69-71, a golf club head 951 includes a front hitting cup 953, a crown 955, a sole 957, a skirt 961 that couples the crown 955 and the sole 957, and a hosel 959. Club head 951 also includes an aft cup 952 that is spaced apart from hitting cup 953 by a midsection 954. Midsection 954 is attached to hitting cup 953 at a front ledge 956 and is attached to aft cup 952 at a back ledge 958. The surfaces of ledges 956, 958, are may be recessed from outer surfaces of hitting cup 953 and aft cup 952 so that when midsection 954 is attached to hitting cup 953 and aft cap 952, crown 955 of club head 951 includes a generally smooth surface. The ledges 956, 958 can be made from the same materials as hitting cup 953 and aft cup, respectively, and integral therewith, or they can be made from another material, that is preferably lightweight.

Golf club head 951 includes a flexure 960 that combines geometric features with material properties to provide selected compliance. In particular, flexure 960 includes a front wall 962 and a rear wall 964 that are coupled at an apex 966. In the present embodiment, front wall 962 is integrated into the construction of front hitting cup 953 and rear wall 964 is integrated into the construction of midsection 954. The walls are coupled, such as by an adhesive joint, substantially at apex 966.

Hitting cup 953 includes a face 968 and a flange 970. Face 968 defines a ball-striking surface 972 and a rear surface 974 and, in the present embodiment, the thickness of face 968 between ball-striking surface 972 and rear surface 974 varies across the face with the portion of the face overlapping a geometric face center of the ball-striking surface having the greatest thickness. Preferably, the thickness of face 968 generally varies from about 0.5 mm to about 4.5 mm.

Midsection 954 is a generally tubular member that extends between, and separates, hitting cup 953 and aft cup 952. A forward edge of midsection 954 overlaps a rear edge of hitting cup, including front ledge 956. A portion of the forward edge of midsection 954 is integrally formed with rear wall 964 of flexure 960 and is mounted to hitting cup 953 to form flexure 960.

Aft cup 952 forms the aftmost portion of golf club head 951. Aft cup 952, generally speaking, provides a location where discretionary mass may be concentrated, while advantageously moving the center-of-gravity and altering the moment-of-inertia of the golf club head. Aft cup 952 may be constructed to concentrate mass in a pre-selected location within aft cup 952. For example, aft cup 952 includes an integrated concentrated mass portion 976 that is located on a toe side of aft cup 952 and a recess 978 that reduces the mass of aft cup 952 at a heel side of aft cup 952. Additionally, aft cup 952 may include a removable weight member 980 that may be used to adjust the mass of golf club head 951 after assembly, such as to alter the swingweight of a golf club incorporating golf club head 951.

Front hitting cup 953 and aft cup 952 are preferably made by casting or forging with titanium, stainless steel, aluminum or a combination thereof. The midsection is generally constructed from a material that has a lower specific gravity than the materials of the front hitting cup and the aft cup, and may be constructed from metallic and/or non-metallic materials, such as magnesium, aluminum, and/or carbon reinforced composite. In a preferred embodiment, midsection 954 is made from a lightweight carbon fiber reinforced tube. In an embodiment, midsection 954 is attached to front hitting cup 942 and aft cup 952 by adhesives, such as DP420NS or DP460NS, which are two-part epoxies available from 3M, among other known adhesives. Alternatively, the midsection may be coupled to the front hitting cup and aft cup by any method compatible with the chosen materials, such as by brazing, welding, etc. for metallic components.

Figure 72:
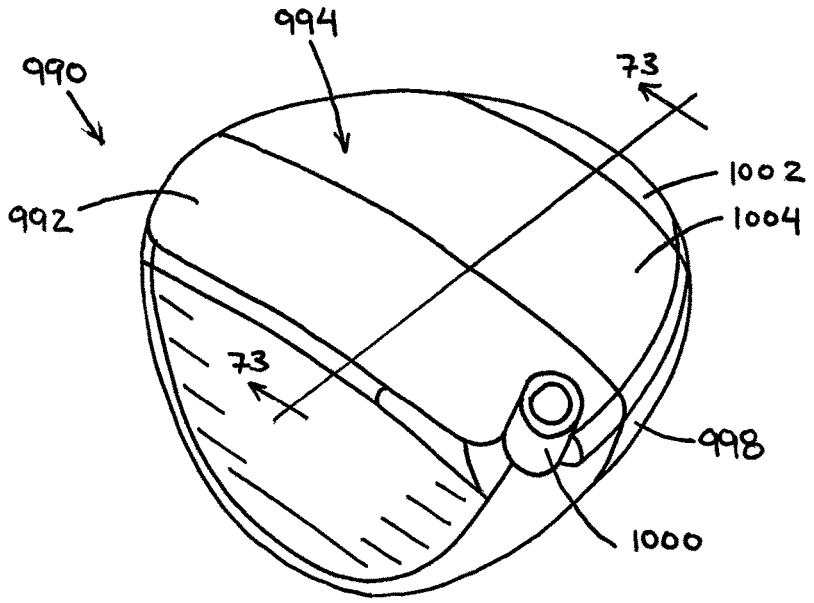
FIG. 72 is a perspective view of an embodiment of a golf club head of the present invention having a multi-material construction.
Figure 73:
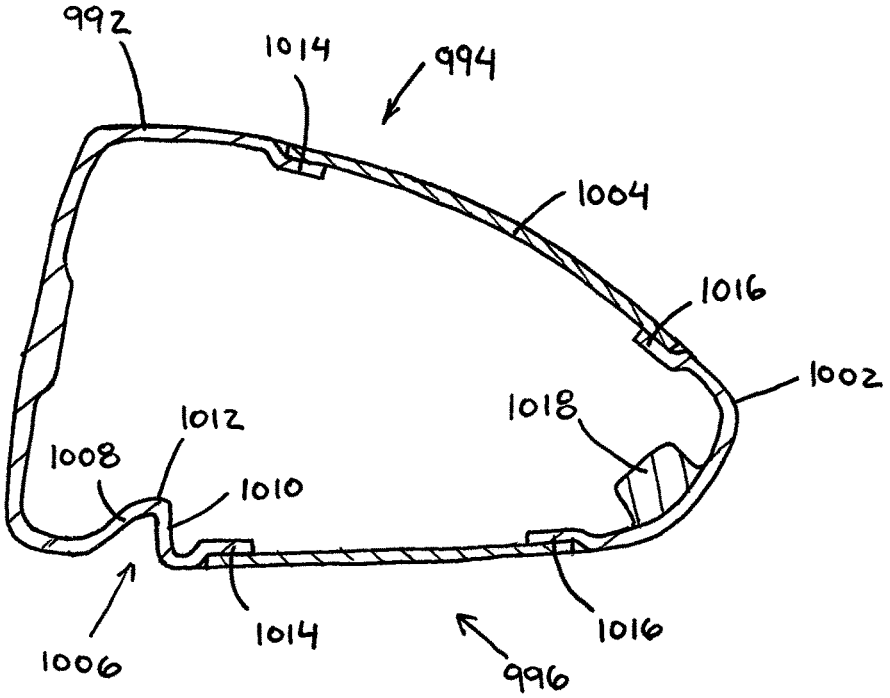
FIG. 73 is a cross-sectional view of a construction of the golf club head of FIG. 72, taken along line 73-73, shown in FIG. 72.

Referring now to FIGS. 72 and 73, a golf club head 990 is another embodiment that incorporates a geometric flexure in addition to a multi-material body construction. Golf club head 990 includes a front hitting cup 992, a crown 994, a sole 996, a skirt 998 that couples the crown 994 and the sole 996, and a hosel 1000. Club head 990 also includes an aft cup 1002 that is spaced apart from hitting cup 992 by a midsection 1004. Hitting cup 992, midsection 1004 and aft cup 1002 combine to form crown 994, sole 996 and skirt 998.

Golf club head 990 includes a flexure 1006 that combines geometric features with material properties to provide selected compliance. In particular, flexure 1006 includes a front wall 1008 and a rear wall 1010 that are coupled at an apex 1012. In the present embodiment, the entire flexure 1006, including front wall 1008 and rear wall 1010, is integrated into the construction of front hitting cup 992.

Front hitting cup 992 includes a ledge 1014 at an aft edge that is coupled to a forward edge of midsection 1004. Preferably, ledge 1014 extends along the entire perimeter of front hitting cup 992 so that it is coupled to midsection 1004 along the entire perimeter. The outer surface of ledge 1014 may be inset from the outer surface of the adjacent portion of hitting cup 992 by an amount that is approximately equal to the thickness of the forward edge of midsection so that, after bonding, golf club head 990 has a smooth continuous outer surface across the bond line.

Similarly, aft cup 1002 includes a ledge 1016 at a forward edge that is coupled to an aft edge of midsection 1004. Preferably, ledge 1016 extends along the entire perimeter of aft cup 1002 so that it is coupled to midsection 1004 along the entire perimeter. The outer surface of ledge 1016 may be inset from the outer surface of the adjacent portion of aft cup 1002 by an amount that is approximately equal to the thickness of the aft edge of midsection so that, after bonding, golf club head 990 has a smooth continuous outer surface across the bond line.

Additionally, aft cup 1002 is preferably weighted to bring the overall weight of the golf club head into a desire range, generally between about 185 g and 215 g for all driver-type golf club heads of the present invention. As illustrated aft cup 1002 may include a concentrated weight portion 1018 that is disposed on the interior of aft cup 1002. Weight portion 1018 may be the same material as the remainder of aft cup 1002 or it may be a different material. For example, aft cup 1002 may include a titanium portion and a weight portion formed of a material having a higher specific gravity, for example, tungsten, steel, and/or zirconium.

Figure 74:
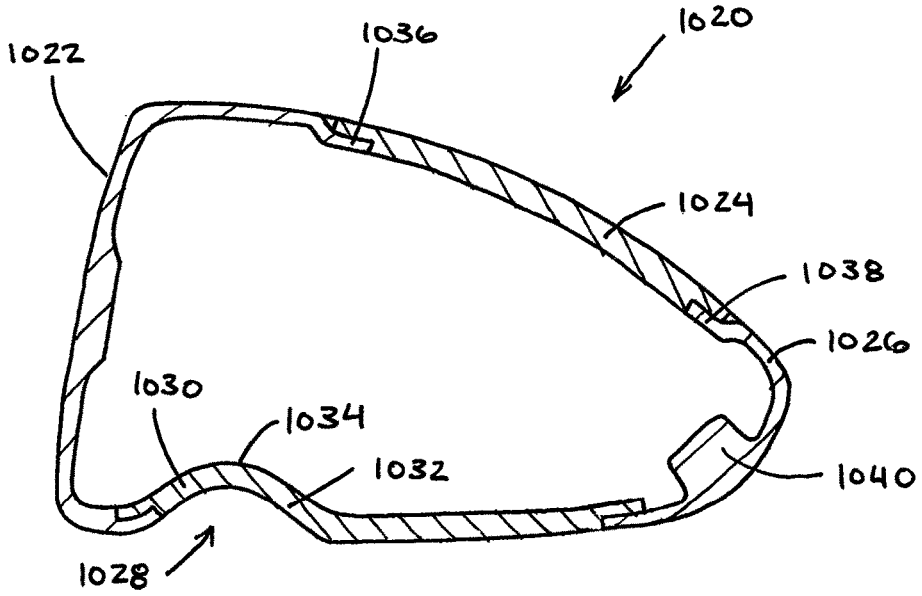
FIG. 74 is a cross-sectional view of an alternative construction of the golf club head of FIG. 72, generally corresponding to line 73-73, shown in FIG. 72.

Referring to FIG. 74, an alternative cross-section of a golf club head, having similar appearance in perspective view to the golf club head of FIG. 72 will be described. In this alternative embodiment, golf club head 1020 includes a front hitting cup 1022, a midsection 1024 and an aft cup 1026, and a flexure 1028 that is integrated into the construction of midsection 1024.

Flexure 1028 that combines geometric features with material properties to provide selected compliance. In particular, flexure 1028 includes a front wall 1030 and a rear wall 1032 that are coupled at an apex 1034. In the present embodiment, the entire flexure 1028, including front wall 1030 and rear wall 1032 are formed by a forward portion of midsection 1024. Flexure 1028 is illustrated having the shape of a smooth corrugation, or channel, but it should be appreciated that the flexure may be shaped similar to any of the embodiments described herein.

Similar to previous embodiments, midsection 1024 is coupled to front hitting cup 1022 and aft cup 1026, such as by adhesive bonds, brazing, welding etc. In particular, hitting cup 1022 includes a ledge 1036 and aft cup 1026 includes a ledge 1038, and the ledges are coupled to corresponding forward and aft ledges of midsection 1024, respectively. Preferably, each of the ledges extends along the entire perimeter of the associated component so that the entire perimeter of the midsection is coupled to the adjacent part. Generally, the ledges are configured so that the outer surface of golf club head is generally a smooth continuous surface.

Aft cup 1026 is preferably weighted to bring the overall weight of the golf club head into a desired range, generally between about 185 g and 215 g for all driver-type golf club heads of the present invention. As illustrated, aft cup 1026 may include a concentrated weight portion 1040 that is disposed on the interior of aft cup 1026, but it should be appreciated that in any of the embodiments, a concentrated weight portion may alternatively be disposed on the exterior of the aft cup. Weight portion 1040 may be the same material as the remainder of aft cup 1026, as shown, or it may be a different material.

Referring to FIG. 75, a further alternative cross-section of a golf club head, having similar appearance in perspective view to the golf club head of FIG. 72 will be described. In this alternative embodiment, golf club head 1050 includes a front hitting cup 1052, a midsection 1054, an aft cup 1056, and a flexure 1058. This alternative embodiment illustrates that the configurations of the ledges may be reversed, for example the ledge of the hitting cup may form the internal or external ledge, and the same applies to each of the other components.

Flexure 1058 that combines geometric features with material properties to provide selected compliance. In particular, flexure 1058 includes a multi-material layered construction. Flexure 1058 may be shaped similar to any of the flexures described herein, such as a smooth corrugation as illustrated. In the present embodiment, each of the front hitting cup 1052 and midsection 1054 includes a portion that extends through the entire geometry of flexure 1058 and that forms a layer of the wall thickness. For example, midsection 1054 may provide an inner layer while hitting cup 1052 forms an outer layer of the flexure wall.

Midsection 1054 is coupled to front hitting cup 1052 and aft cup 1056, such as by adhesive bonds, brazing, welding, etc. as appropriate for the selected materials. In particular, hitting cup 1052 includes a ledge 1060 and aft cup 1056 includes a ledge 1062, and the ledges are coupled to corresponding forward and aft ledges of midsection 1054, respectively. Preferably, each of the ledges extends along the entire perimeter of the associated component so that the entire perimeter of the midsection is coupled to the adjacent part. Generally, the ledges are configured so that the outer surface of golf club head 1050 is generally a smooth continuous surface.

Aft cup 1056 is preferably weighted to bring the overall weight of the golf club head into a desired range, generally between about 185 g and 215 g for all driver-type golf club heads of the present invention. As illustrated, aft cup 1056 may include a concentrated weight portion 1064 that is disposed on the interior of aft cup 1056. Weight portion 1064 may include a separate weight member 1066, such as a removable weight that screws into a receptacle 1068 included in aft cup 1056.

Figure 76:
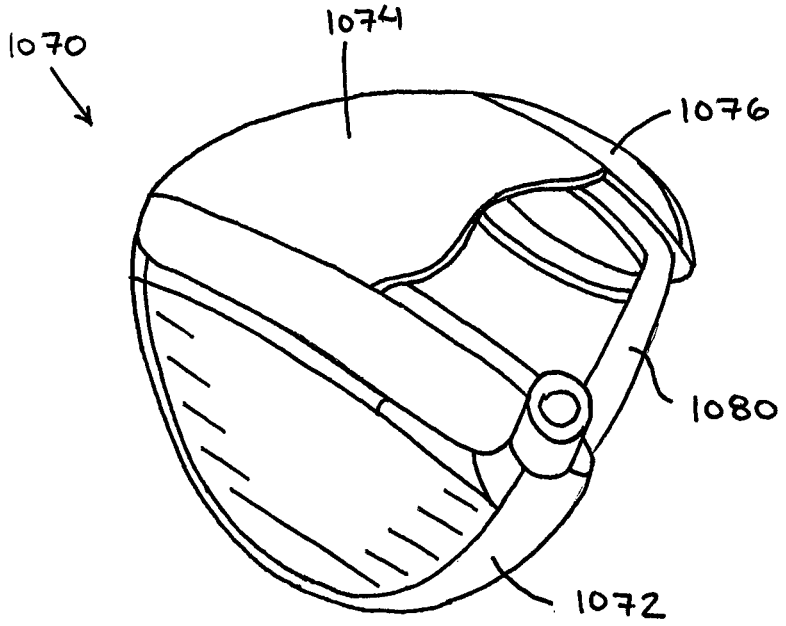
FIG. 76 is a perspective view of a construction of another embodiment of the golf club head of the present invention.
Figure 77:
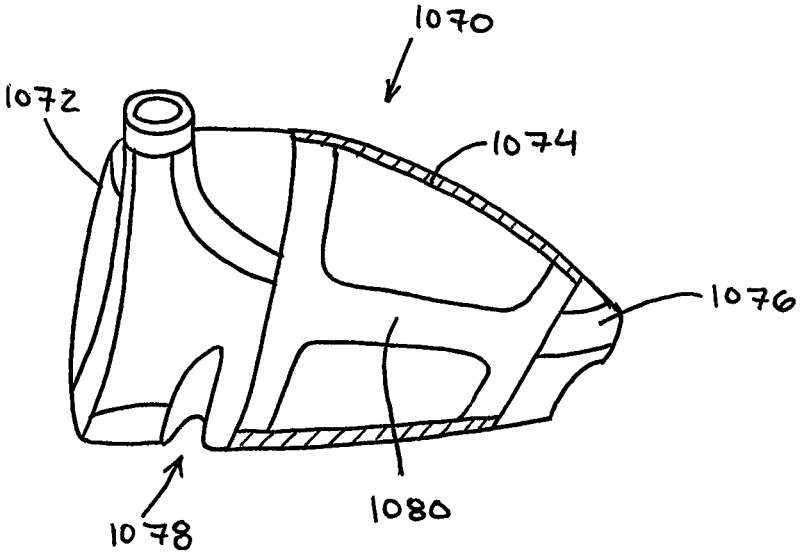
FIG. 77 is a side view of the golf club of FIG. 76.
Figure 78:
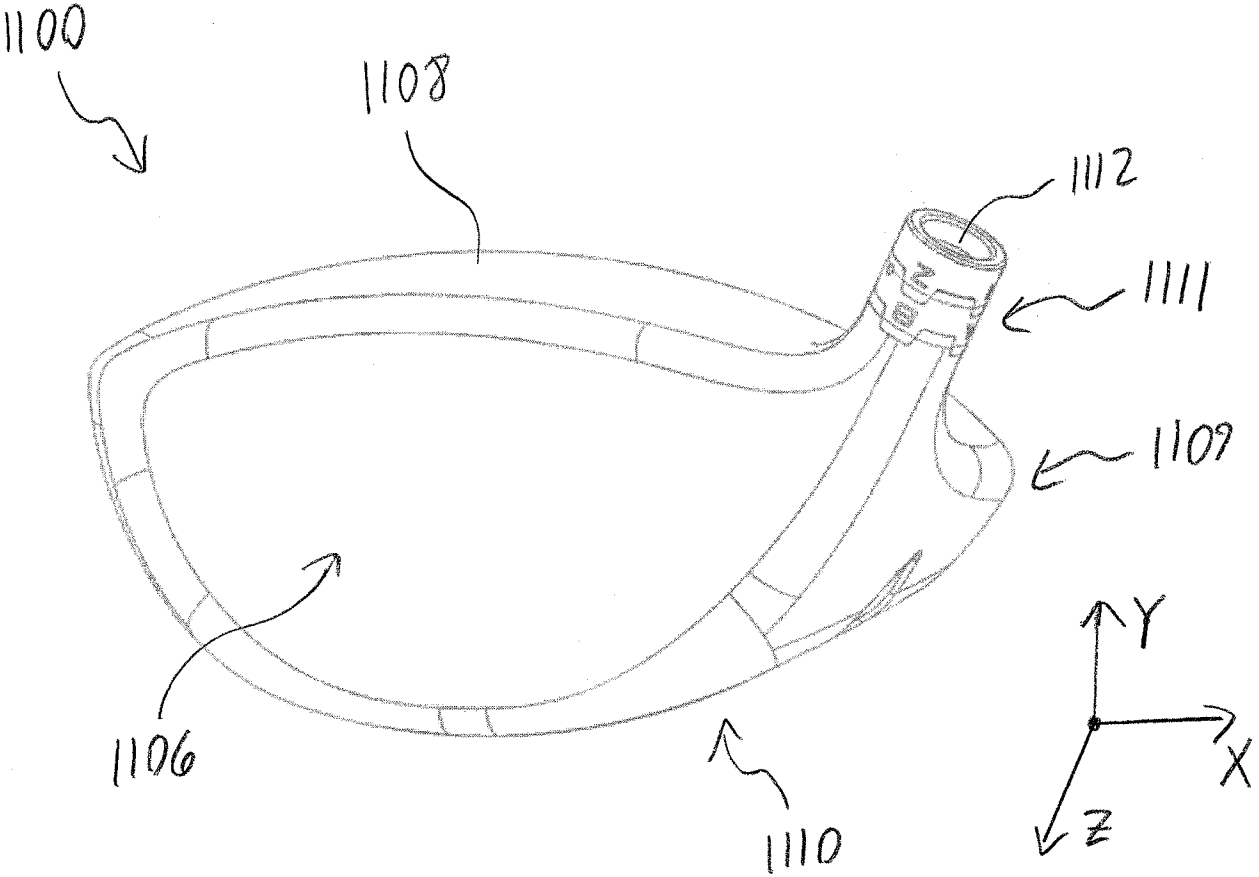
FIG. 78 is a perspective view of an additional embodiment of a golf club head.

In another embodiment, shown in FIGS. 76 and 77, a golf club head 1070 will be described. In this alternative embodiment, golf club head 1070 includes a front hitting cup 1072, a midsection 1074, an aft cup 1076, and a flexure 1078. Front hitting cup 1072 and aft cup 1076 may be coupled, such as by a bridge member 1080, so that the front hitting cup 1072 and aft cup 1076 are joined independent of midsection 1074. Bridge member 1080 may be located at any location around the golf club head, for example by forming a support on the interior of the crown, sole or skirt of golf club head 1070. It should be appreciated that a bridge member may alternatively be located within or exterior of the crown, sole or skirt of the golf club head, such as to alter the mass distribution and/or moment of inertia of the golf club head. As illustrated, golf club head 1070 includes a bridge member 1080 that extends along a heel side skirt portion of the golf club head. It should be appreciated, that bridge member 1080 may be located at different locations across midsection 1074 to alter the contribution of bridge member 1080 to mass distribution and structural rigidity, for example bridge member 1080 may extend across midsection 1074 in the crown and/or sole portion of the golf club head, and a plurality of bridge members 1080 may be included.

As described above, the flexure of the present invention provides lower stiffness locally in a portion of the golf club head. Generally the lower stiffness may be achieved by selecting the geometry of the flexure, such as by altering the shape and/or cross-sectional thickness, and/or by selecting the material of portions of the flexure. Materials that may be selected to provide the lower stiffness flexure include low Young's modulus beta (β), or near beta (near-β), titanium alloys.

Beta titanium alloys are preferable because they provide a material with relatively low Young's modulus. The deflection of a plate supported at its perimeter under an applied stress is a function of the stiffness of the plate. The stiffness of the plate is directly proportional to the Young's modulus and the cube of the thickness (i.e., $t^3$). Therefore, when comparing two material samples that have the same thickness and differing Young's moduli, the material having the lower Young's modulus will deflect more under the same applied force. The energy stored in the plate is directly proportional to the deflection of the plate as long as the material is behaving elastically and that stored energy is released as soon as the applied stress is removed. Thus, it is desirable to use materials that are able to deflect more and consequently store more elastic energy.

The construction of the flexure generally results in material extending into the cavity of the golf club, and it generally raises the CG when the flexure is located in the sole or the crown of the golf club head. The increase in CG height is more substantial when a flexure is included in the crown. Preferably, in embodiments utilizing a crown flexure, the portion of the crown rearward of the flexure is lowered relative to the portion of the crown forward of the flexure to lower the overall CG of the golf club head. In particular, the height of the forward edge of the crown flexure is greater than the height of the rearward edge of the crown flexure. Preferably, the difference in height is greater than 1.0 mm, and more preferably greater than 2.0 mm, and the location of the crown having a maximum height from the ground surface is between the face of the golf club head and the flexure.

As shown in previous embodiments, a golf club head may be constructed with one or more mounting features for removable weights to alter the overall golf club head weight and/or the location of the CG, in addition to a flexure. In an embodiment, a golf club head including a flexure in the sole of the golf club head has a CG-C-sa value that is greater than 18.0 mm behind the shaft axis, and preferably a CG-Z-fc value greater than 33.0 mm rearward of face center, and/or a moment-of-inertia value about the Y-axis of the golf club head of at least 450 kg-mm$^2$. Additionally, the golf club head has a at least one weight mounting feature and at least one removable weight that allows the CG of the golf club head to be altered by at least 2.0 mm in a direction.

Additionally, it is preferable to match the frequency of vibration of a golf club face with the frequency of vibration of a golf ball to maximize the golf ball speed off the face after an impact. The frequency of vibration of the face depends on the face parameters, such as the material's Young's modulus and Poisson's ratio, and the face geometry. The alpha-beta (α-β) Ti alloys typically have a modulus in the range of 105-120 GPa. In contrast, current β-Ti alloys have a Young's modulus in the range of 48-100 GPa.

The material selection for a golf club head must also account for the durability of the golf club head through many impacts with golf balls. As a result, the fatigue life of the face must be considered, and the fatigue life is dependent on the strength of the selected material. Therefore, materials for the golf club head must be selected that provide the maximum ball speed from a face impact and adequate strength to provide an acceptable fatigue life.

The β-Ti alloys generally provide low Young's modulus, but are also usually accompanied by low material strength. The β-Ti alloys can generally be heat treated to achieve increases in strength, but the heat treatment also generally causes an increase in Young's modulus. However, β-ti alloys can be cold worked to increase the strength without significantly increasing the Young's modulus, and because the alloys generally have a body centered cubic crystal structure they can generally be cold worked extensively.

Preferably, a material having strength in a range of about 900-1200 MPa and a Young's modulus in a range of about 48-100 GPa is utilized for portions of the golf club head. For example, it would be preferably to use such a material for the face and/or flexure and/or flexure cover of the golf club head. Materials exhibiting characteristics in those ranges include titanium alloys that have generally been referred to as Gum Metals.

Although less preferable, heat treatment may be used on β-Ti to achieve an acceptable balance of strength and Young's modulus in the material. Previous applications of β-titanium alloys generally required heat treating to maximize the strength of the material without controlling Young's modulus. Titanium alloys go through a phase transition from hexagonal close packed crystal structure a phase to a body centered cubic β phase when heated. The temperature at which this transformation occurs is called the β-transus temperature. Alloying elements added to titanium generally show either a preference to stabilize the α phase or the β phase, and are therefore referred to as α stabilizers or β stabilizers. It is possible to stabilize the β phase even at room temperature by alloying titanium with a certain amount of β stabilizers. However, if such an alloy is re-heated to elevated temperature, below the β-transus temperature, the β phase decomposes and transforms into a phase as dictated by the thermodynamic rules. Those alloys are referred to as metastable β titanium alloys.

While the thermodynamic laws only predict the formation of α phase, in reality a number of non-equilibrium phases appear on the decomposition of the β phase. These non-equilibrium phases are denoted by α', α", and ω. It has been reported that each of these phases has different Young's moduli and that the magnitude of the Young's modulus generally conforms with $\beta<\alpha''<\alpha<\omega$. Thus, it is speculated that if one desires to increase the strength of β-titanium through heat treatment, it would be advantageous to do it in such a manner that the material includes α" phase as a preferred decomposition product and we eliminate, or minimize the formation of α and ω phases. The formation of α" phase is facilitated by quenching from the α+β region on the material phase diagram, which means the alloy should be quenched from below the β-transus temperature. Therefore, preferably a β-Ti alloy that has been heat treated to maximize the formation of α" phase from the β phase is used for a portion of the golf club head.

The heat treatment process is selected to provide the desired phase transformation. Heat treatment variables such as maximum temperature, time of hold, heating rate, quench rate are selected to create the desired material composition. Further, the heat treatment process may be specific to the alloy selected, because the effect of different β stabilizing elements is not the same. For example, a Ti—Mo alloy would behave differently than Ti—Nb alloy, or a Ti—V alloy, or a Ti—Cr alloy; Mo, Nb, V and Cr are all β stabilizers but have an effect of varying degree. The β-transus temperature range for metastable β-Ti alloys is about 700° C. to about 800° C. Therefore, for such alloys the solution treating temperature range would be about 25-50 Celsius degrees below the β-transus temperature, in practical terms the alloys would be solution treated in the range of about 650° C. to about 750° C. Following water quenching, it is possible to age the β-Ti alloys at low temperature to further increase strength. Strength of the solution treated material was measured to be about 650 MPa, while the heat treated alloy had a strength of 1050 MPa.

Examples of suitable beta titanium alloys include: Ti-15Mo-3Al, Ti-15Mo-3Nb-0.3O, Ti-15Mo-5Zr-3Al, Ti-13Mo-7Zr-3Fe, Ti-13Mo, Ti-12Mo-6Zr-2Fe, Ti—Mo, Ti-35Nb-5Ta-7Zr, Ti-34Nb-9Zr-8Ta, Ti-29Nb-13Zr-2Cr, Ti-29Nb-15Zr-1.5Fe, Ti-29Nb-10Zr-0.5Si, Ti-29Nb-10Zr-0.5Fe-0.5Cr, Ti-29Nb-18Zr—Cr-0.5Si, Ti-29Nb-13Ta-4.6Zr, Ti—Nb, Ti-22V-4Al, Ti-15V-6Cr-4Al, Ti-15V-3Cr-3Al-3Sn, Ti-13V-11Cr, Ti-10V-2Fe-3Al, Ti-5Al-5V-5Mo-3Cr, Ti-3Al-8V-6Cr-4Mo-4-Zr, Ti-1.5Al-5.5Fe-6.8Mo, Ti-13Cr-1Fe-3Al, Ti-6.3Cr-5.5Mo-4.0Al-0.2Si, Ti—Cr, Ti—Ta alloys, the Gum Metal family of alloys represented by Ti+25 mol % (Ta, Nb, V)+(Zr, Hf, O), for example, Ti-36Nb-2Ta-3Zr-0.35O, etc. (by weight percent). Near beta titanium alloys may include: SP-700, TIMET 18, etc.

In general, it is preferred that a face cup or face insert of the inventive golf club head be constructed from α-β or near-β titanium alloys due to their high strength, such as Ti-64, Ti-17, ATI425, TIMET 54, Ti-9, TIMET 639, VL-Ti, KS ELF, SP-700, etc. Further, the rear portion of the golf club body (i.e., the portion other than the face cup, face insert, flexure and flexure cover) is preferably made from α, α-β, or β titanium alloys, such as Ti-8Al-1V-1Mo, Ti-8Al-1Fe, Ti-5Al-1Sn-1Zr-1V-0.8Mo, Ti-3Al-2.5Sn, Ti-3Al-2V, Ti-64, etc.

As described previously, the flexure may be constructed as a separate component and attached to the remainder of a golf club head body. For example, the flexure component may be stamped and formed from wrought sheet material and the remainder of the body constructed as one or more cast components. Stamping a flexure component may be preferable over casting the flexure because casting can introduce mechanical shortcomings. For example, cast materials often suffer from lower mechanical properties as compared to the same material in a wrought form. As an example, Ti-64 in cast form has mechanical properties about 10%-20% lower as compared to wrought Ti-64. This is because the grain size in castings is significantly larger as compared to the wrought forms, and generally finer grain size results in higher mechanical properties in metallic materials.

Further, titanium castings also develop a surface layer called "alpha case", a region at the surface that has predominantly alpha phase of titanium that results from titanium that is enriched with interstitial oxygen. The alpha phase in and of itself is not detrimental, but it tends to be very hard and brittle so in fatigue applications, such as repeated golf ball impacts that cause repeated flexing, the alpha case can compromise the durability of the component.

Most titanium alloys are almost impossible to form at room temperature. Thus, the titanium alloys have to be heated to an elevated temperature to form them. The temperature necessary to form the alloy will depend on the alloy's composition, and alloys that have higher beta transus temperature typically require higher forming temperatures. Exposure to elevated temperature results in lowered mechanical properties when the material is cooled down to ambient temperature. Additionally, the exposure to elevated temperature results in the formation of an oxide layer at the surface. This oxide layer is almost like the "alpha case" discussed above except that it typically does not extend as deep into the material. Thus, it is beneficial if the forming temperature can be lowered.

Generally, if using Ti-64 as a baseline since it is commonly used in the construction of metal wood type golf club heads, alloys that have beta transus temperatures that are lower than that of Ti-64 can provide a significant benefit. For example, one such alloy is ATI 425, which has a beta transus temperature in the range of about 957°–971° C., while Ti-64 has a beta transus temperature of about 995° C. Thus, it can be expected that ATI 425 can be formed at a lower temperature as compared to Ti-64. Since ATI 425 has mechanical properties comparable to Ti-64 at room temperature, it is expected that a sole fabricated from ATI 425 alloy will be stronger as compared to a sole made from Ti-64. In addition, ATI 425 generally has better formability as compared to Ti-64, so in an example, a flexure is formed of ATI 425 sheet material and will experience less cross-sectional thinning than a flexure formed of a Ti-64 sheet material. Further, ATI 425 may be cold formable which would further result in a stronger component.

In an example, a multi-material golf club head is constructed from components constructed of Ti-64 and ATI 425. A body including a crown, a sole or partial sole, a skirt, a hosel and a face flange may be cast of Ti-64. Then a portion of the sole may be formed by a flexure component that is constructed from ATI 425 sheet material and welded to the cast Ti-64 body, such as in a slot or recess, such as in the configuration shown in FIGS. 5 and 6. A forged face insert is then welded to the face flange of the cast Ti-64 to complete the head.

Various manufacturing methods may be used to construct the various components of the golf club head of the present invention. Preferably all of the components are joined by welding. The welding processes may be manual, such as TIG or MIG welding, or they may be automated, such as laser, plasma, e-beam, ion beam, or combinations thereof. Other joining processes may also be utilized if desired or required due to the material selections, such as brazing and adhesive bonding.

The components may be created using stamping and forming processes, casting processes, molding processes and/or forging processes. As used herein, forging is a process that causes a substantial change to the shape of a specimen, such as starting with a bar and transforming it into a sheet, that characteristically includes both dimensional and shape changes. Additionally, forging generally is performed at higher temperature and may include a change in the microstructure of the material, such as a change in the grain shape. Forming is generally used to describe a process in which a material is shaped while generally retaining the dimension of the material, such as by starting with a sheet material and shaping the sheet without significantly changing the thickness. The following are examples of material selections for the portions of the golf club head utilizing stamping and forming processes:

a) α-β face member+β flexure+α-β rear body b) β face member+α-β face insert+β flexure+α-β rear body c) β face member+α-β face insert+β flexure+β rear body d) β face member+α-β face insert+β flexure+α-β rear body (Heat Treated)

The following are examples of material selections for the portions of the golf club head utilizing cast components:

a) Cast α-β face member+Cast β flexure+Cast α-β rear body b) Formed α-β face member+Cast β flexure+Cast α-β rear body c) Formed α-β face member+Cast β flexure+Formed α-β rear body d) Cast α-β face member+Cast β flexure+Formed α-β rear body The following are examples of material selections for the portions of the golf club head utilizing forged components:

a) Forged α-β face member+Cast β flexure+Cast α-β rear body b) Forged α-β face member+Cast β flexure+Formed α-β rear body The density of β alloys is generally greater than the density of α-β or α alloys. As a result, the use of β alloys in various portions of the golf club head will result in those portions having a greater mass. Light weight alloys may be used in the rear portion of the body so that the overall golf club head mass may be maintained in a desired range, such as between about 170 g and 210 g for driver-type golf club heads. Materials such as aluminum alloys, magnesium alloys, carbon fiber composites, carbon nano-tube composites, glass fiber composites, reinforced plastics and combinations of those materials may be utilized.

Acoustic behavior of a golf club head can be important to consumers. Generally, if portions of a golf club head are not stiff enough, particularly the sole, the acoustic behavior of the golf club head can be unappealing. Some golf club features can further influence acoustic behavior of a golf club head including for example: flexures, weight pads, weight ports, and adjustable weights. Flexures, weight pads, weight ports, and adjustable weights located on the sole can increase the amplitude as well as affect the frequency of the sole vibration after the golf club head strikes a golf ball, affecting the acoustic behavior of the golf club head. Flexures in particular, due to the increased compliance they add to the sole of the golf club, can allow the sole to vibrate with increased amplitude producing a more intense sound as the golf club head strikes a golf ball. FIGS. 78-89 illustrate various embodiments of a golf club head incorporating a depression formed in the sole of the golf club head. The depression can alter the acoustic behavior of the golf club head, making the sound of the golf club head produced when impacting a golf ball more appealing to consumers. FIGS. 78-89 also include a coordinate system wherein the z-axis extends forward, the y-axis extends upward perpendicular to the ground plane, and the x-axis extends in the heel-ward direction.

FIGS. 78-83 illustrate one embodiment of a golf club head 1100 incorporating a depression 1102 formed in the sole 1110 of the golf club head 1100. The golf club head 1100 illustrated in FIGS. 78-83 are hollow, and include a golf club head interior cavity 1104 surrounded by the face 1106, the crown 1108, the skirt 1109, and the sole 1110. The golf club head 1100 also includes a hosel 1111 incorporating a hosel bore 1112. The golf club head 1100 can also include a flexure 1113, as illustrated in FIGS. 78-83 and as described above. The flexure 1113 is spaced aftward of the face 1106 by a transmittal portion 1114. The flexure 1113 extends in a generally heel-to-toe direction and is substantially parallel to the leading edge 1116 of the golf club head 1100. The flexure 1113 is defined by a front wall 1118, a rear wall 1120, and an apex 1122, wherein the front wall 1118 and rear wall 1120 extend into the interior cavity 1104, and wherein the rear portion 1124 of the sole 1110 is located aft of the flexure 1113.

The sole 1110 of the golf club head 1100 is convex, such that it bulges outward towards the ground plane 1126. In some embodiments, as illustrated in FIGS. 79-83, the sole 1110 includes a depression 1102 formed in the sole 1110 of the golf club head 1100. The depression 1102 is concave, such that it protrudes inward towards the golf club head interior cavity 1104. The perimeter 1128 of the depression 1102 can be defined by the inflection border where the concavity inverts between the convex sole 1110 and the concave depression 1102. The flexure 1113 can also be concave in shape, as illustrated in FIG. 82. The flexure 1113 creates a flexure channel 1130, defined as the empty space inside the walls 1118, 1120 of the flexure 1113 and external to the surface of the golf club head 1100. The depression 1102 creates a depression channel 1132 defined as the empty space between the walls of the depression 1102 and external to the surface of the golf club head 1100. In some embodiments, as illustrated in FIGS. 79-83, the depression channel 1132 can communicate with the flexure channel 1130. In such embodiments, the perimeter 1128 of the depression 1102 can be further defined as the edge of the depression 1102 which crosses the rear wall 1120 of the flexure 113. In other embodiments, such as the one illustrated in FIGS. 87-89, the depression 1102 can be spaced from the flexure 1113.

Figure 79:
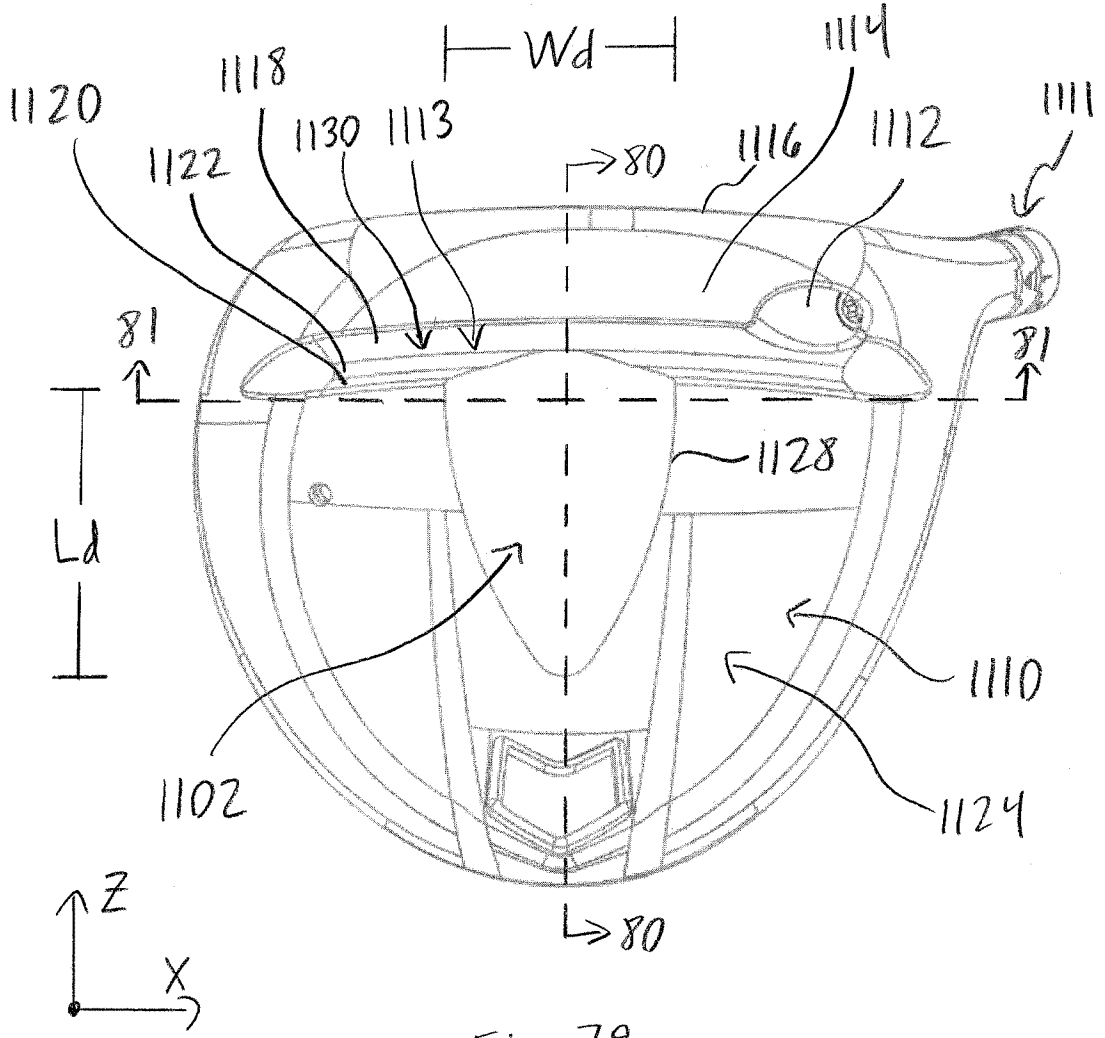
FIG. 79 is a bottom view of the golf club head of FIG. 78.
Figure 80:
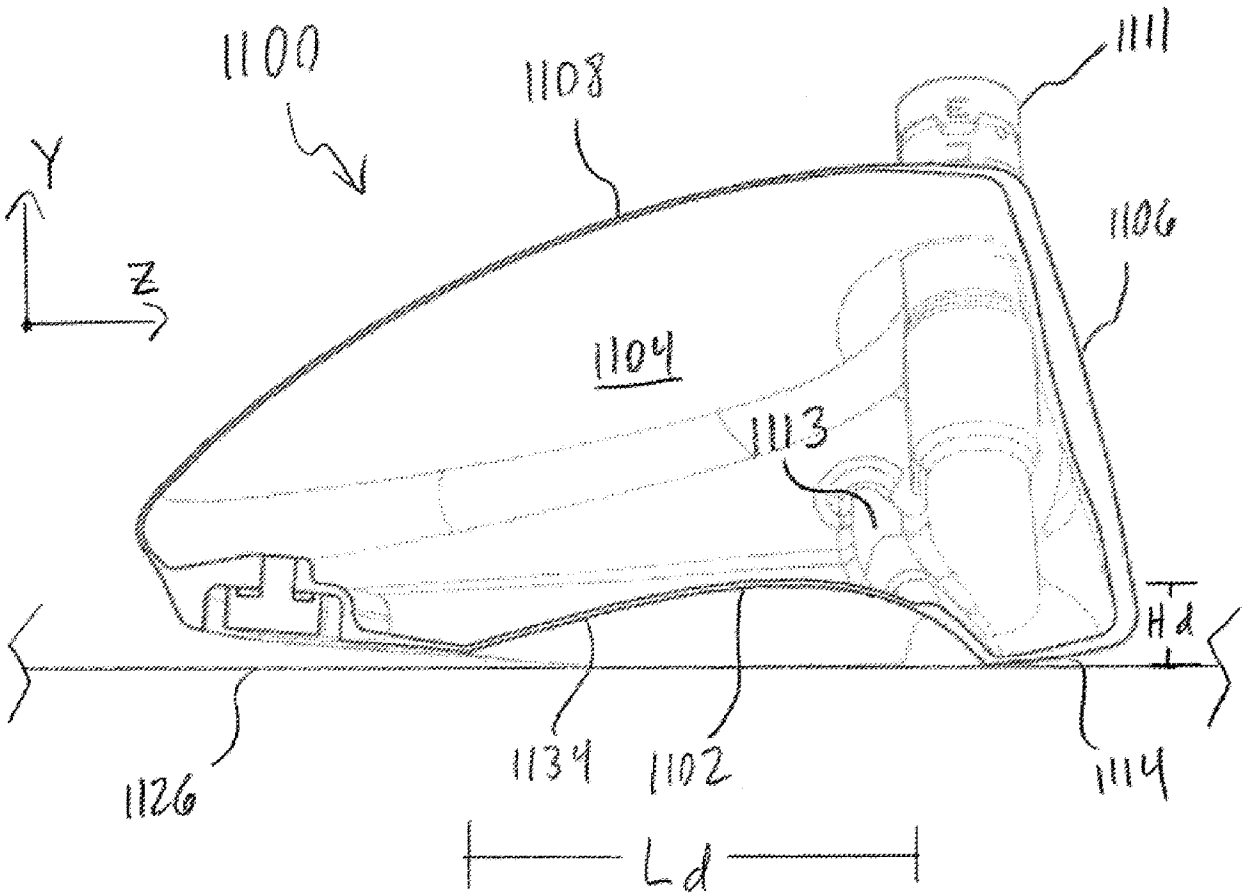
FIG. 80 is a cross-sectional view of the golf club head of FIG. 78, generally corresponding to line 80-80.
Figure 81:
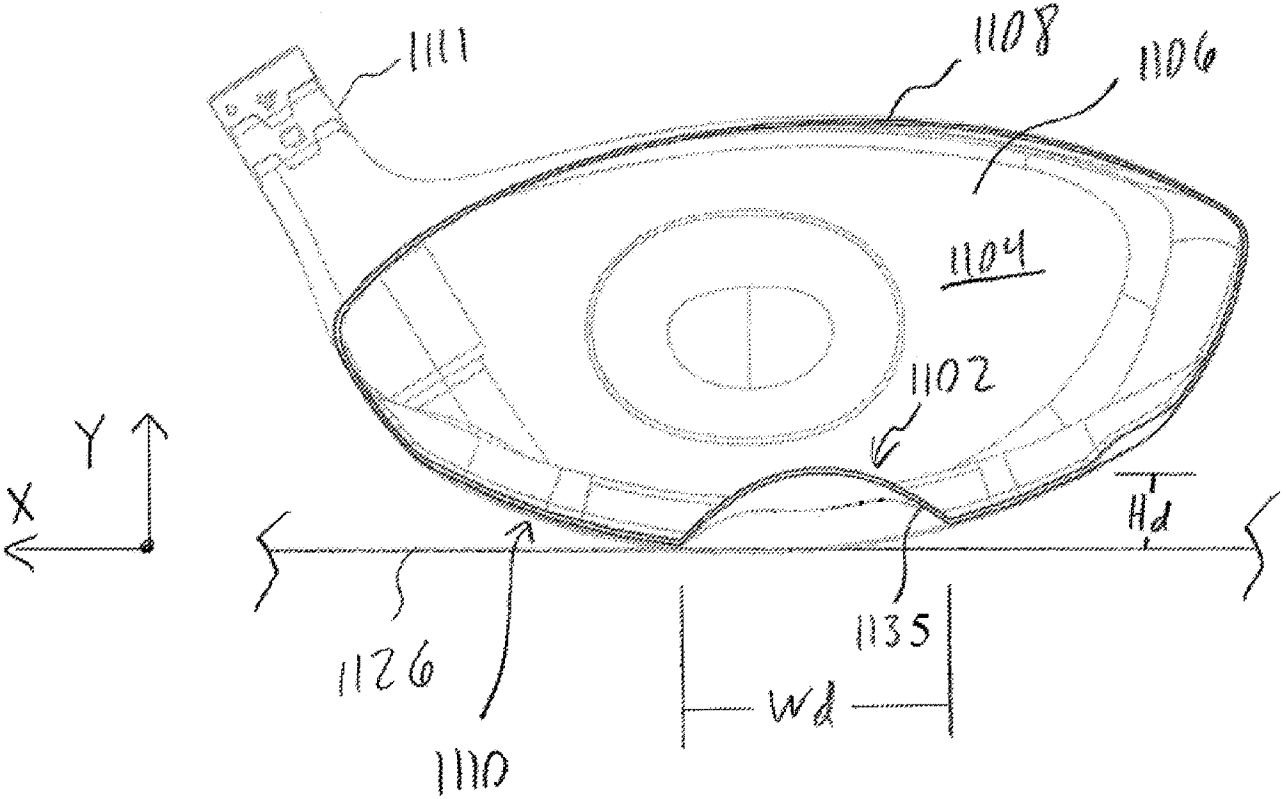
FIG. 81 is a cross-sectional view of the golf club head of FIG. 78, generally corresponding to line 81-81.
Figure 82:
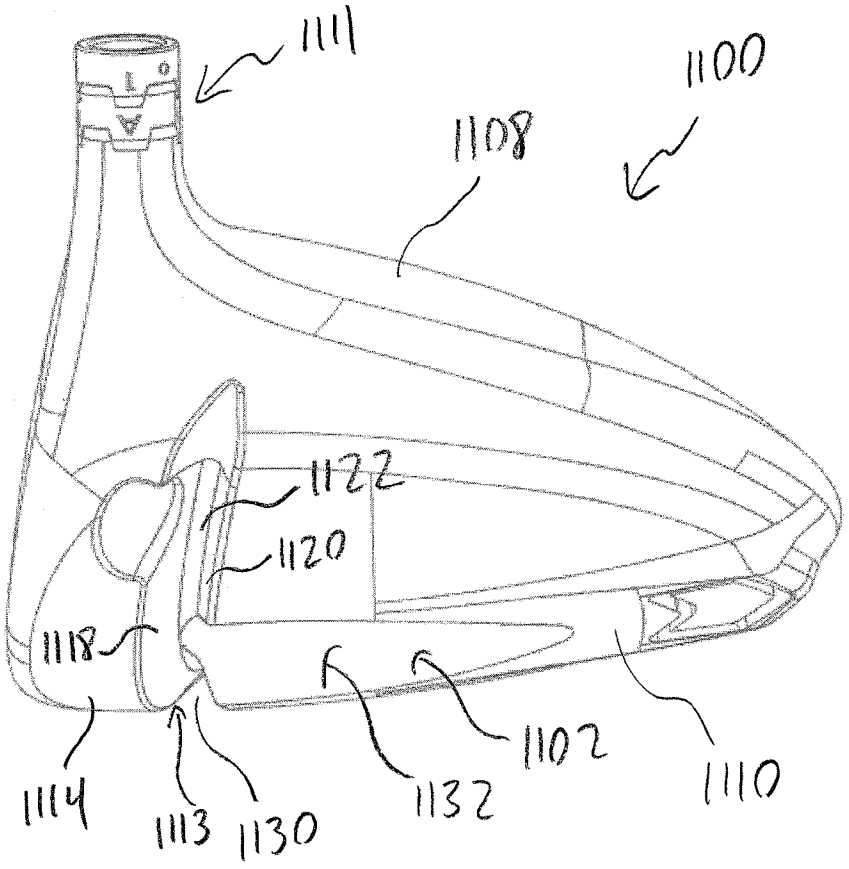
FIG. 82 is a side view of the golf club head of FIG. 78.
Figure 83:
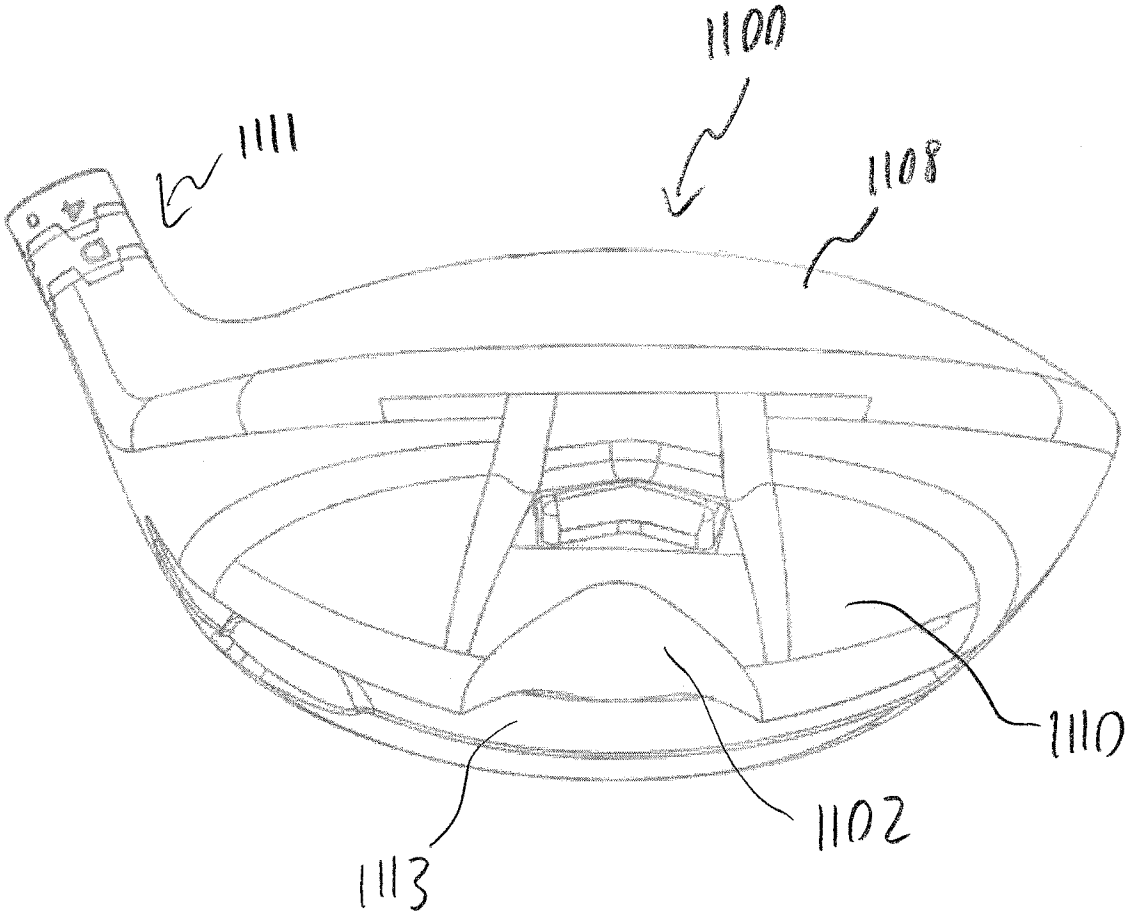
FIG. 83 is a rear view of the golf club head of FIG. 78.
Figure 24:
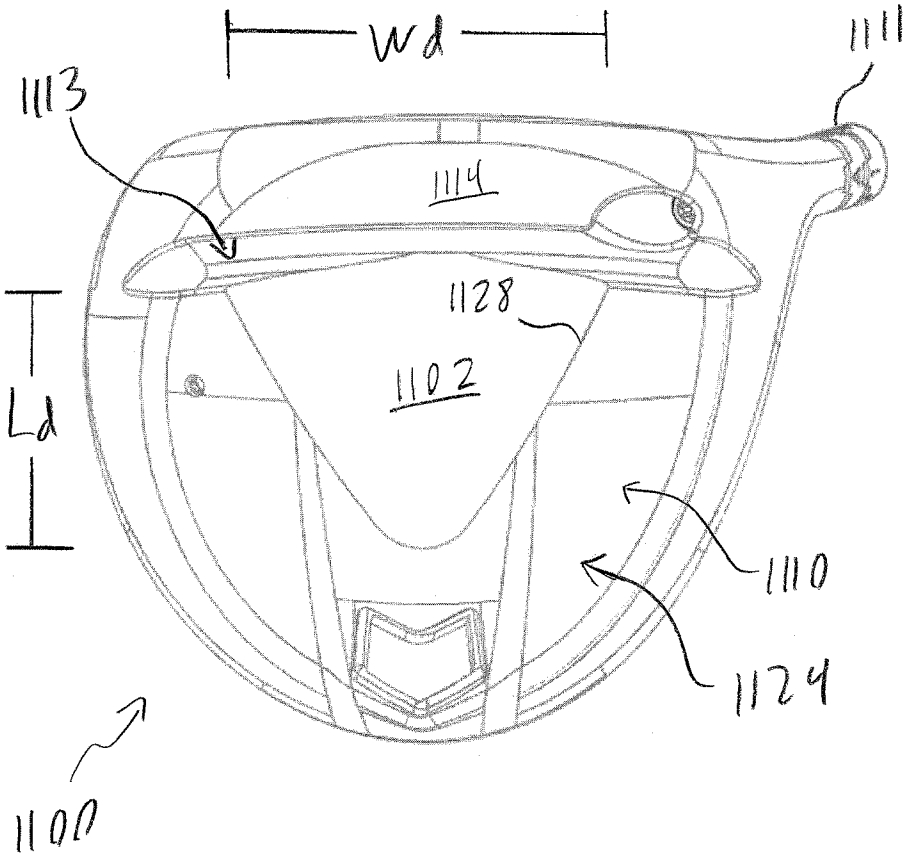

As illustrated in FIGS. 79-81, the depression 1102 can be defined by a plurality of measurements. These measurements are also illustrated on additional embodiments of the depression 1102 in FIGS. 84-89. The depression 1102 can have a length, Ld, which in some embodiments is greater than 20 mm. The depression 1102 can have a width, Wd, which is greater than about 10 mm and less than about 80 mm. The depression 1102 can have a height, Hd, which is greater than about 4 mm and less than about 20 mm. More preferably, Ld is greater than about 30 mm, Wd is between about 20 mm and 60 mm, and Hd is between about 6 mm and 14 mm. Even more preferably, Ld is greater than about 40 mm, Wd is between about 30 mm and 50 mm, and Hd is between about 6 mm and 10 mm.

Figure 80B:
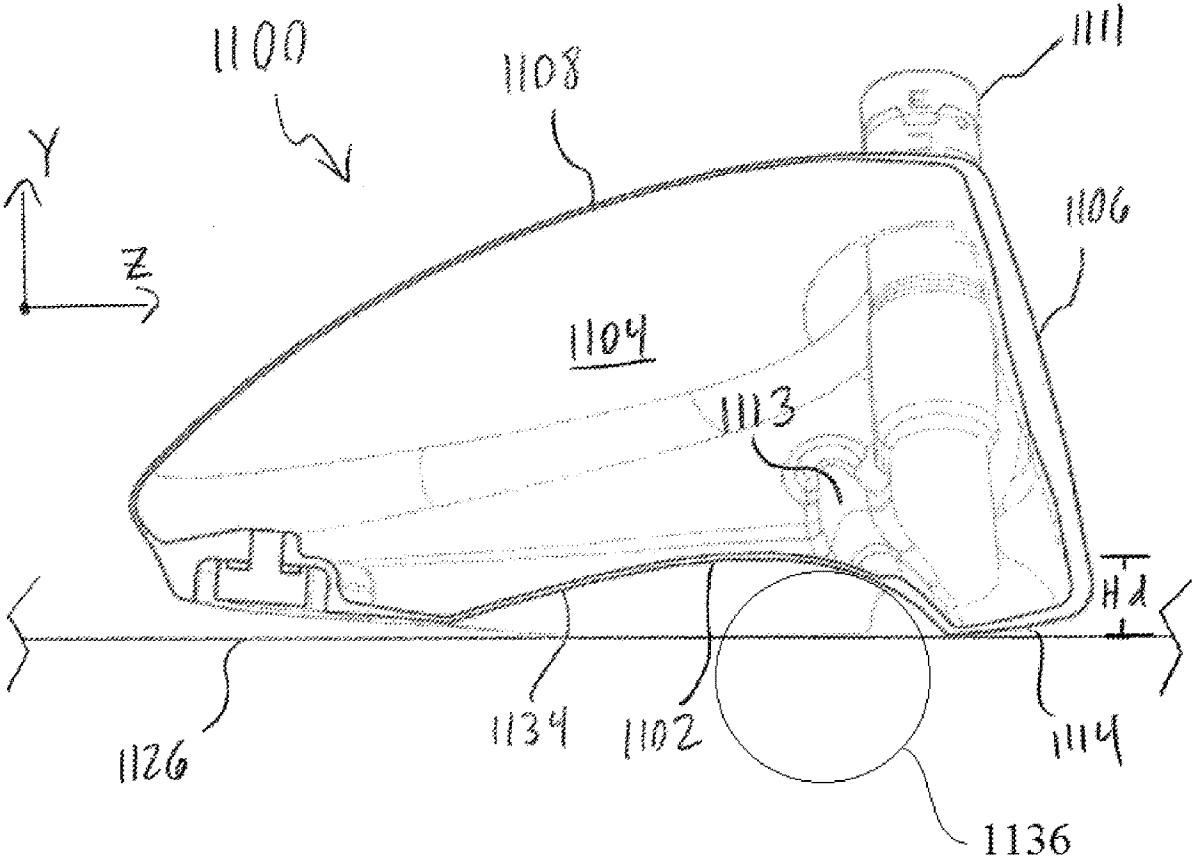
FIG. 80B illustrates the cross section of FIG. 80, including a fore-aft radius gauge.

FIG. 80 illustrates a cross section of the golf club head 1100 of FIG. 79, the cross section cut along a fore-aft plane parallel to the y-axis and z-axis through the center of the depression 1102. The fore-aft depression curve 1134 is defined by the intersection of the outer surface of the depression 1102 and the fore-aft plane. FIG. 80B illustrates the cross section of FIG. 80, including a fore-aft radius gauge 1136. The fore-aft radius gauge 1136 comprises a circle with a specific radius. The fore-aft radius gauge 1136 is to be placed at a variety of random locations along the fore-aft depression curve 1134. If the fore-aft radius gauge 1136 contacts the fore-aft depression curve 1134 at more than one point, than the depression 1102 fails the fore-aft radius gauge test. To pass, the fore-aft radius gauge 1136 may only contact the fore-aft depression curve 1134 at a single point. In some embodiments, the depression 1102 passes the fore-aft radius gauge test with a fore-aft radius gauge 1136 having a radius of 10 mm. In some embodiments, the depression 1102 passes the fore-aft radius gauge test with a fore-aft radius gauge 1136 having a radius of 20 mm. In some embodiments, the depression 1102 passes the fore-aft radius gauge test with a fore-aft radius gauge 1136 having a radius of 30 mm. In some embodiments, the depression 1102 passes the fore-aft radius gauge test with a fore-aft radius gauge 1136 having a radius of 40 mm. In some embodiments, the depression 1102 passes the fore-aft radius gauge test with a fore-aft radius gauge 1136 having a radius of 60 mm.

Figure 81B:
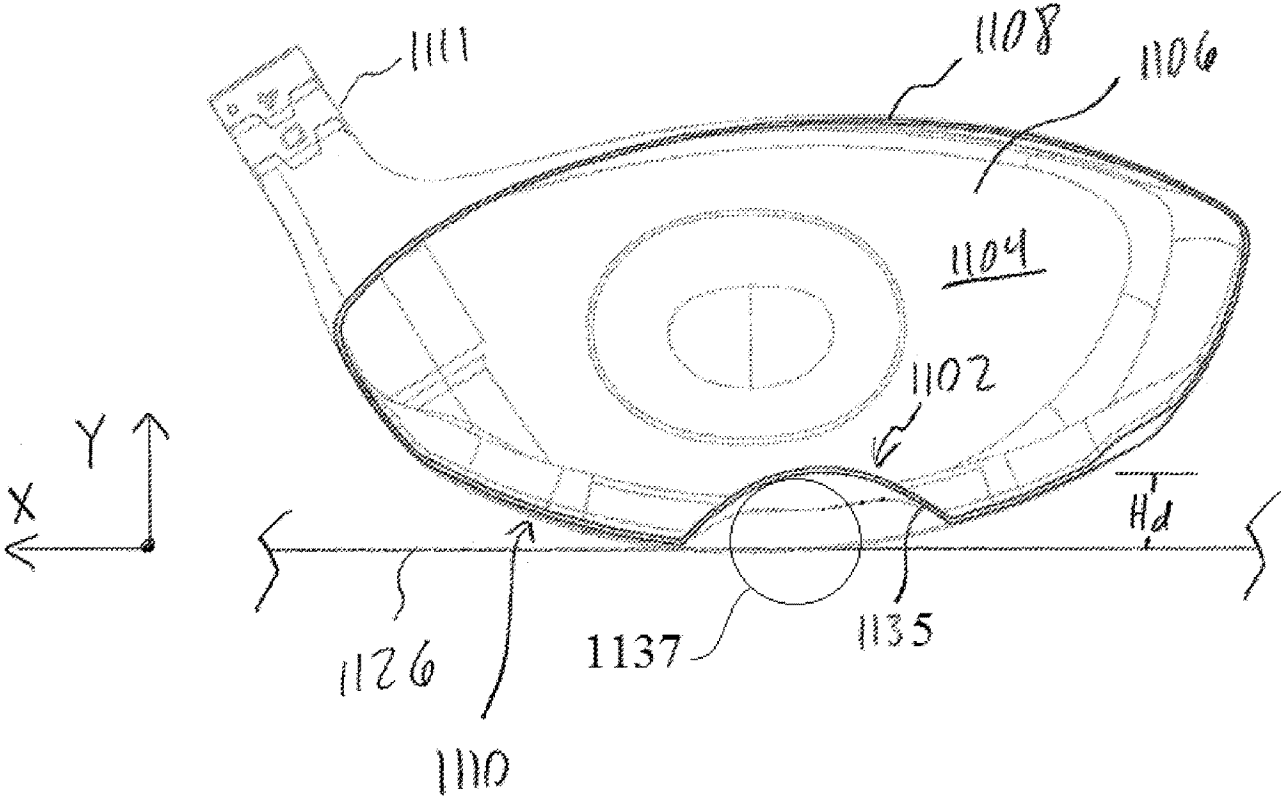
FIG. 81B illustrates the cross section of FIG. 81, including a heel-toe radius gauge.

FIG. 81 illustrates a cross section of the golf club head of FIG. 79 cut along a heel-toe plane parallel to the y-axis and x-axis located at the widest portion of the depression 1102. The heel-toe depression curve 1135 is defined by the intersection of the outer surface fo the depression 1102 and the heel-toe plane. FIG. 81B illustrates the cross section of FIG. 81, including a heel-toe radius gauge 1137. The heel-toe radius gauge 1137 comprises a circle with a specific radius. The heel-toe radius gauge 1137 is to be placed at a variety of random location along the heel-toe depression curve 1135. If the heel-toe radius gauge 1137 contacts the heel-toe depression curve 1135 at more than one point, than the depression 1102 fails the heel-toe radius gauge test. To pass, the heel-toe radius gauge 1137 may only contact the heel-toe depression curve 1135 at a single point. In some embodiments, the depression 1102 passes the heel-toe radius gauge test with a heel-toe radius gauge 1137 having a radius of 5 mm. In some embodiments, the depression 1102 passes the heel-toe radius gauge test with a heel-toe radius gauge 1137 having a radius of 10 mm. In some embodiments, the depression 1102 passes the heel-toe radius gauge test with a heel-toe radius gauge 1137 having a radius of 15 mm. In some embodiments, the depression 1102 passes the heel-toe radius gauge test with a heel-toe radius gauge 1137 having a radius of 20 mm. In some embodiments, the depression 1102 passes the heel-toe radius gauge test with a heel-toe radius gauge 1137 having a radius of 30 mm.

The size of the depression 1102 can be related to the size of the flexure 1113. Generally, a larger flexure 1113 will cause more compliance, therefore allowing the golf club head 1100 to benefit from a larger and more effective depression 1102. In some embodiments, the height, Hd, of the depression 1102 can correlate with the height, H, of the flexure 1113, which has been described above, and illustrated in FIG. 4. In some embodiments, the height of the depression, Hd, can be between 50% and 150% of the height of the flexure. In some embodiments, the height of the depression, Hd, can be between 60% and 120% of the height of the flexure. In some embodiments, the height of the depression, Hd, can be between 80% and 100% of the height of the flexure.

In some embodiments, the width, Wd, of the depression 1102 can correlate with the width, W, of the flexure 1113, which has been described above, and illustrated in FIG. 4. In some embodiments, the width of the depression, Wd, can be at least two times the width of the flexure. In some embodiments, the width of the depression, Wd, can be at least three times the width of the flexure. In some embodiments, the width of the depression, Wd, can be at least four times the width of the flexure.

Figure 85:
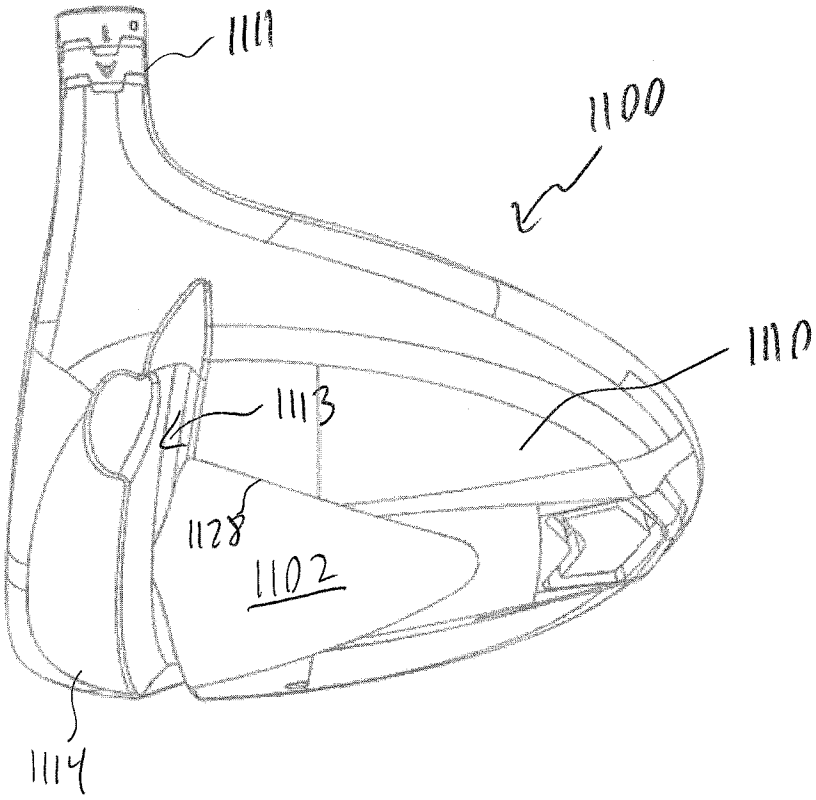
FIG. 85 is a side view of the golf club head of FIG. 84.
Figure 86:
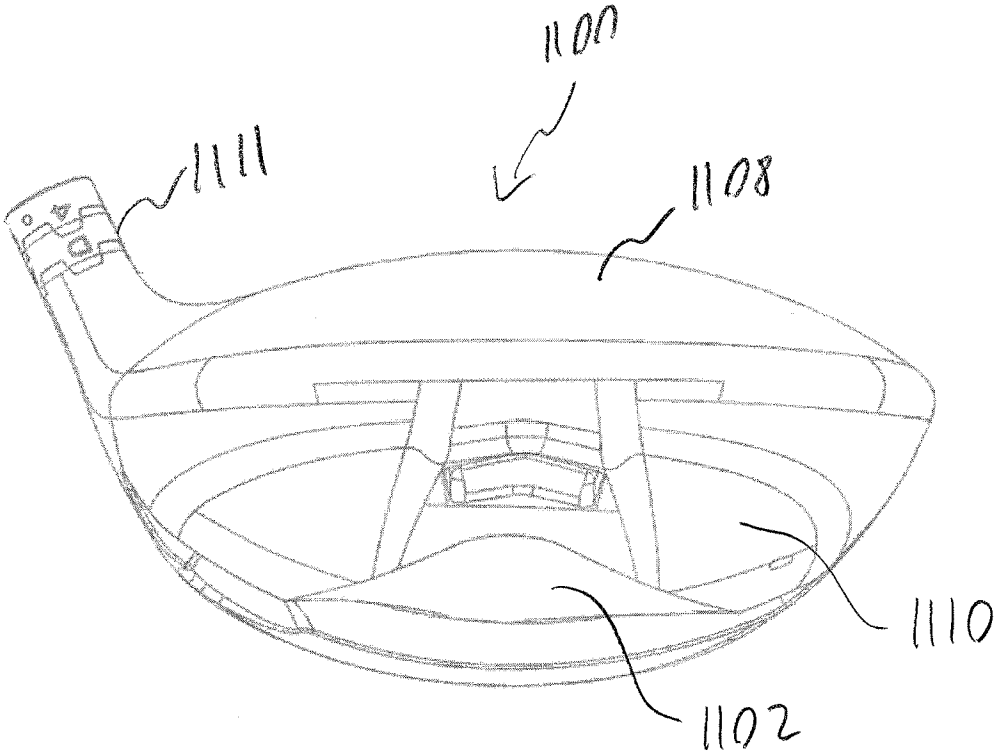
FIG. 86 is a rear view of the golf club head of FIG. 84.
Figure 87:
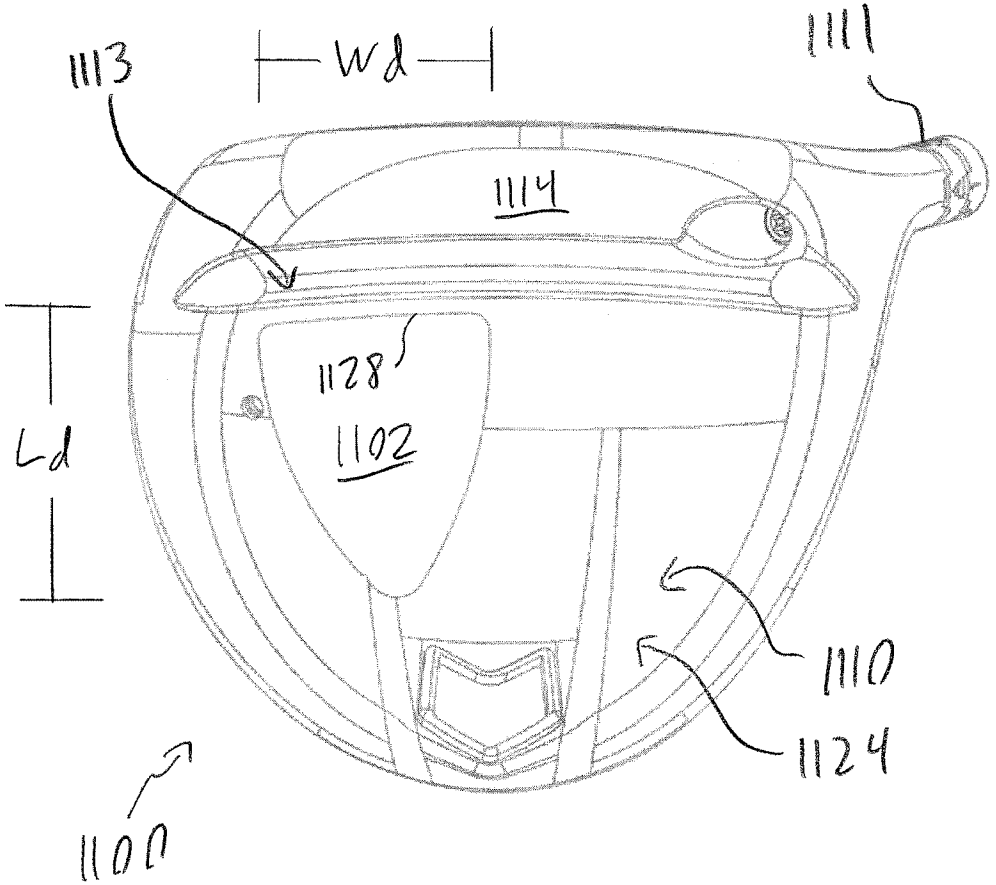
FIG. 87 is a bottom view of an additional embodiment of a golf club head.
Figure 88:
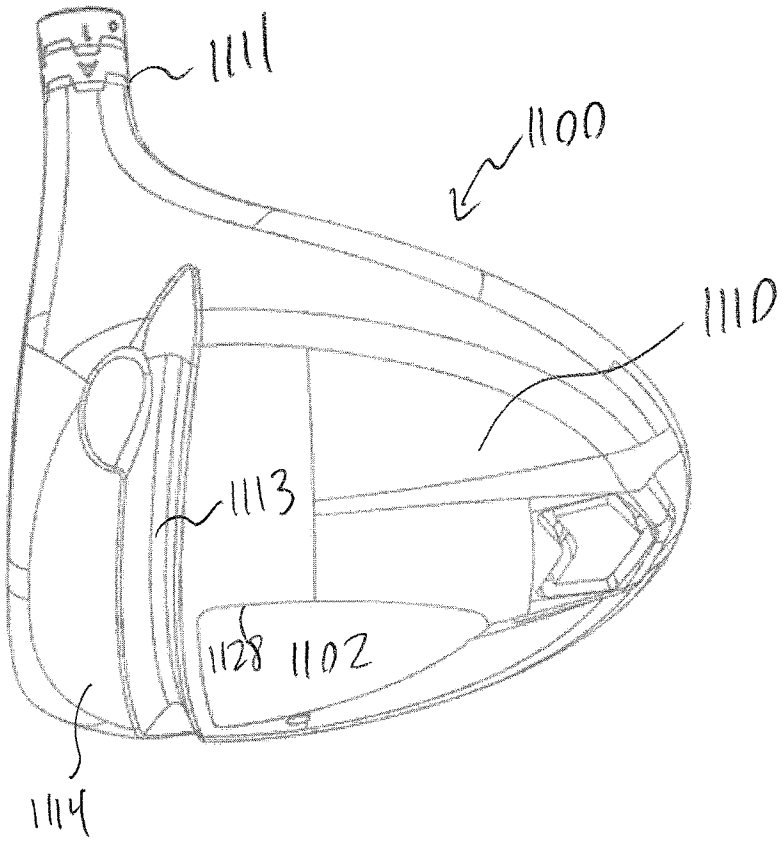
FIG. 88 is a side view of the golf club head of FIG. 87.
Figure 29:
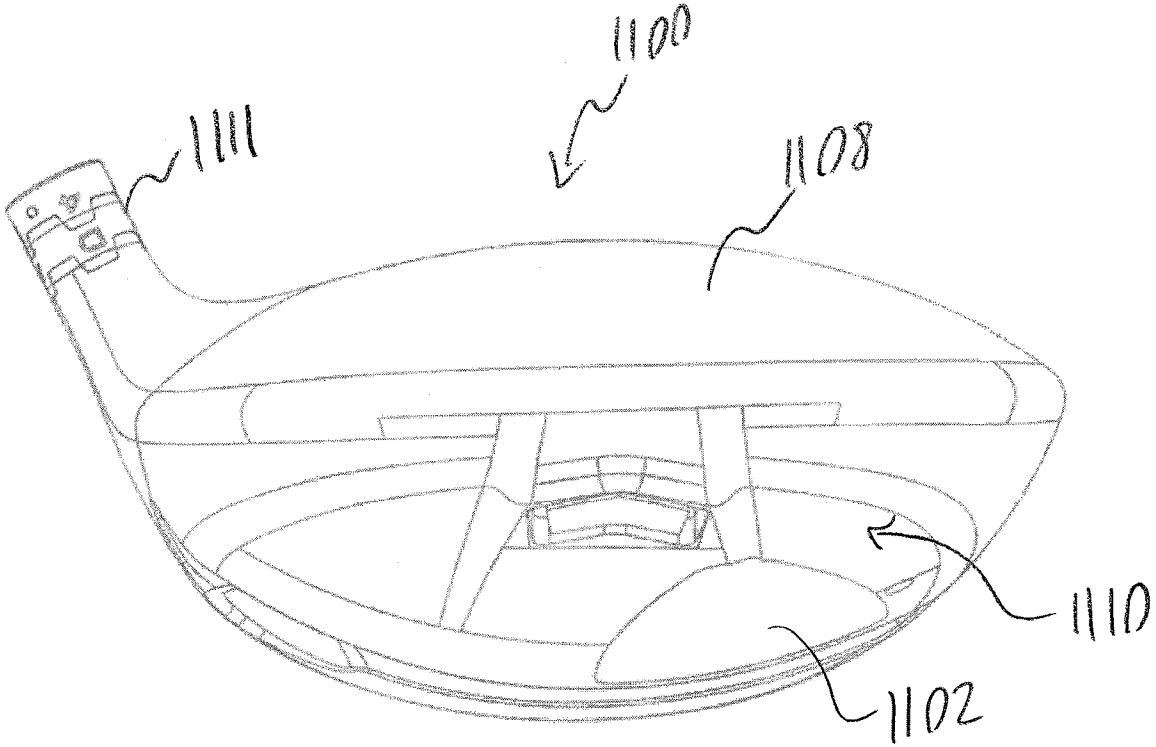

Additional embodiments of a depression 1102 are illustrated in FIGS. 84-89, which incorporate similar qualities to the depression 1102 described in FIGS. 78-83. FIGS. 84-86 illustrate an additional embodiment of a golf club head 1100 incorporating a depression 1102 formed in the sole 1110 of the golf club head 1100. The depression 1102 illustrated in FIGS. 84-86 is larger in width than the depression 1102 illustrated in FIGS. 78-83. FIGS. 87-89 illustrate an additional embodiment of a golf club head 1100 incorporating a depression 1102 formed in the sole 1110 of the golf club head 1100. The depression 1102 illustrated in FIGS. 87-89 is spaced from the flexure 1113 and the depression channel 1132 does not communicate with the flexure channel 1130 as illustrated in FIGS. 78-89. The depression 1102 in FIGS. 87-89 is also located towards the toe portion of the sole 1110, offering the advantage of not complicating sole interaction with the ground plane 1126 at address, and thus not affecting loft, face angle, etc.

While various descriptions of the present invention are described above, it should be understood that the various features of each embodiment could be used alone or in any combination thereof. Therefore, this invention is not to be limited to only the specifically preferred embodiments depicted herein. Further, it should be understood that variations and modifications within the spirit and scope of the invention might occur to those skilled in the art to which the invention pertains. For example, the face insert may have thickness variations in a step-wise continuous fashion. In addition, the shapes and locations of the slots are not limited to those disclosed herein. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

We claim:

1. A golf club head, comprising:

a crown defining an upper surface of the golf club head;

a sole defining a lower surface of the golf club head, said sole comprising a transmittal portion, a flexure, and a rear portion;

a skirt extending between the crown and the sole;

a hosel extending from the crown and including a shaft bore;

a face defining a ball-striking surface and intersecting said sole at a leading edge;

an interior cavity defined by said crown, sole, skirt, and face;

a coordinate system with an x-axis located horizontal to said face, a y-axis located vertical to said face, and a z-axis located through said face, said z-axis and said x-axis parallel to a ground plane when said golf club head is held at address on said ground plane;

wherein said flexure is spaced aftward of said face by said transmittal portion, extending in a generally heel-to-toe direction and substantially parallel to the leading edge of the golf club head, wherein said flexure is defined by a front wall and a rear wall coupled by an apex, wherein said front wall and said rear wall extend into said interior cavity, wherein said rear portion of said sole is located aft of said flexure, wherein said rear portion of said sole is substantially convex;

a depression formed in said rear portion of said sole, wherein said depression is substantially concave and protrudes inwards towards said interior cavity of said golf club head;

wherein said depression comprises an outer surface, said depression further comprising a fore-aft depression curve defined by the intersection of said outer surface and a fore-aft plane, said fore-aft plane parallel to said y-axis and said z-axis, said fore-aft plane passing through the center of said depression, said fore-aft depression curve passing a fore-aft radius gauge test utilizing a circular fore-aft radius gauge having a radius of 10 mm, said depression further comprising a heel-toe depression curve defined by the intersection of said outer surface and a heel-toe plane, said heel-toe plane parallel to said y-axis and said x-axis, and located at the widest portion of said depression, said heel-toe depression curve passing a heel-toe radius gauge test utilizing a circular heel-toe radius gauge having a radius of 5 mm.

2. The golf club head of claim 1, wherein said fore-aft depression curve passes a fore-aft radius gauge test utilizing a circular fore-aft radius gauge having a radius of 20 mm, and said heel-toe depression curve passes a heel-toe radius gauge test utilizing a circular heel-toe radius gauge having a radius of 10 mm.

3. The golf club head of claim 1, wherein a height of said depression, Hd, is between 60% and 120% of the height, H, of the flexure.

4. The golf club head of claim 1, wherein a width, Wd, of said depression is at least two times the width, W, of the flexure.

5. The golf club head of claim 1, wherein said flexure further comprises a flexure channel, said flexure channel located between said front wall and said rear wall and external to said golf club head; wherein said depression further comprises a depression channel, said depression channel located inside said depression and external to said golf club head; wherein said depression channel communicates with said flexure channel.

6. A golf club head, comprising:

a crown defining an upper surface of the golf club head;

a sole defining a lower surface of the golf club head, said sole comprising an interior surface and an exterior surface, wherein said sole is substantially convex in shape;

a skirt extending between the crown and the sole;

a hosel extending from the crown and including a shaft bore;

a face defining a ball-striking surface and intersecting said sole at a leading edge;

an interior cavity defined by said crown, sole, skirt, and face;

a coordinate system with an x-axis located horizontal to said face, a y-axis located vertical to said face, and a z-axis located through said face, said z-axis and said x-axis parallel to a ground plane when said golf club head is held at address on said ground plane;

a depression formed in said sole, wherein said depression is substantially concave and protrudes inwards towards said interior cavity of said golf club head;

wherein said depression comprises an external surface opposite said interior cavity, wherein said external surface of said depression comprises a perimeter defined by an inflection border where the concavity of the sole inverts between said convex sole and said concave depression, wherein said depression comprises a length, Ld, measured along said z-axis from the aft most portion of said depression to the forward most portion of said depression, wherein said depression comprises a width, Wd, measured along said x-axis from the toe most portion of said depression to the heel most portion of said depression, wherein said depression comprises a height, Hd, measured along said y-axis from said ground plane to the highest point of said external surface of said depression, wherein Ld is greater than about 20 mm, Wd is greater than about 10 mm and Wd is less than about 80 mm, and Hd is greater than about 4 mm and less than about 20 mm.

7. The golf club head of claim 6, wherein Ld is greater than about 30 mm, Wd is greater than about 20 mm and less than about 60 mm, and Hd is greater than about 6 mm and less than about 14 mm.

8. The golf club head of claim 7, wherein Ld is greater than about 40 mm, Wd is greater than about 30 mm and less than about 50 mm, and Hd is greater than about 6 mm and less than about 10 mm.

9. The golf club head of claim 6, wherein said depression comprises an outer surface, said depression further comprising a fore-aft depression curve defined by the intersection of said outer surface and a fore-aft plane, said fore-aft plane parallel to said y-axis and said z-axis, said fore-aft plane passing through the center of said depression, said fore-aft depression curve passing a fore-aft radius gauge test utilizing a circular fore-aft radius gauge having a radius of 10 mm, said depression further comprising a heel-toe depression curve defined by the intersection of said outer surface and a heel-toe plane, said heel-toe plane parallel to said y-axis and said x-axis, and located at the widest portion of said depression, said heel-toe depression curve passing a heel-toe radius gauge test utilizing a circular heel-toe radius gauge having a radius of 5 mm.

10. A golf club head, comprising:

a crown defining an upper surface of the golf club head;

a sole defining a lower surface of the golf club head, said sole comprising a transmittal portion, a flexure, and a rear portion;

a skirt extending between the crown and the sole;

a hosel extending from the crown and including a shaft bore;

a face defining a ball-striking surface and intersecting said sole at a leading edge;

an interior cavity defined by said crown, sole, skirt, and face;

a coordinate system with an x-axis located horizontal to said face, a y-axis located vertical to said face, and a z-axis located through said face, said z-axis and said x-axis parallel to a ground plane when said golf club head is held at address on said ground plane;

wherein said flexure is spaced aftward of said face by said transmittal portion, extending in a generally heel-to-toe direction and substantially parallel to the leading edge of the golf club head, wherein said flexure is defined by a front wall and a rear wall coupled by an apex, wherein said front wall and said rear wall extend into said interior cavity, and wherein said rear portion of said sole is located aft of said flexure wherein said rear portion of said sole is substantially convex;

a depression formed in said rear portion of said sole, wherein said depression is substantially concave and protrudes inwards towards said interior cavity of said golf club head;

wherein said flexure further comprises a flexure channel, said flexure channel located between said front wall and said rear wall and external to said golf club head;

wherein said depression further comprises a depression channel, said depression channel located inside said depression and external to said golf club head;

wherein said depression channel does not communicate with said flexure channel.

11. The golf club head of claim 10, wherein said depression is located towards on a toe side of said sole.

12. The golf club head of claim 10, wherein said depression comprises an outer surface, said depression further comprising a fore-aft depression curve defined by the intersection of said outer surface and a fore-aft plane, said fore-aft plane parallel to said y-axis and said z-axis, said fore-aft plane passing through the center of said depression, said fore-aft depression curve passing a fore-aft radius gauge test utilizing a circular fore-aft radius gauge having a radius of 10 mm, said depression further comprising a heel-toe depression curve defined by the intersection of said outer surface and a heel-toe plane, said heel-toe plane parallel to said y-axis and said x-axis, and located at the widest portion of said depression, said heel-toe depression curve passing a heel-toe radius gauge test utilizing a circular heel-toe radius gauge having a radius of 5 mm.

13. The golf club head of claim 12, wherein said fore-aft depression curve passes a fore-aft radius gauge test utilizing a circular fore-aft radius gauge having a radius of 20 mm, and said heel-toe depression curve passes a heel-toe radius gauge test utilizing a circular heel-toe radius gauge having a radius of 10 mm.

14. The golf club head of claim 12, wherein a height of said depression, Hd, is between 60% and 120% of the height, H, of the flexure.

15. The golf club head of claim 12, wherein a width, Wd, of said depression is at least two times the width, W, of the flexure.

16. The golf club head of claim 10, wherein said depression comprises an external surface opposite said interior cavity, wherein said external surface of said depression comprises a perimeter defined by an inflection border where the concavity of the sole inverts between said convex sole and said concave depression, wherein said depression comprises a length, Ld, measured along said z-axis from the aft most portion of said depression to the forward most portion of said depression, wherein said depression comprises a width, Wd, measured along said x-axis from the toe most portion of said depression to the heel most portion of said depression, wherein said depression comprises a height, Hd, measured along said y-axis from said ground plane to the highest point of said external surface of said depression, wherein Ld is greater than about 20 mm, Wd is greater than about 10 mm and Wd is less than about 80 mm, and Hd is greater than about 4 mm and less than about 20 mm.

17. The golf club head of claim 16, wherein Ld is greater than about 30 mm, Wd is greater than about 20 mm and less than about 60 mm, and Hd is greater than about 6 mm and less than about 14 mm.

18. The golf club head of claim 16, wherein Ld is greater than about 40 mm, Wd is greater than about 30 mm and less than about 50 mm, and Hd is greater than about 6 mm and less than about 10 mm.

* * * * *